US007457565B2

(12) United States Patent
Fujii et al.

(10) Patent No.: US 7,457,565 B2
(45) Date of Patent: Nov. 25, 2008

(54) IMAGE FORMING APPARATUS

(75) Inventors: Ichiroh Fujii, Gose (JP); Takatsugu Obata, Nara (JP); Mikio Kakui, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 356 days.

(21) Appl. No.: 11/051,640

(22) Filed: Jan. 27, 2005

(65) Prior Publication Data

US 2005/0232657 A1 Oct. 20, 2005

(30) Foreign Application Priority Data

Jan. 29, 2004 (JP) ..... P2004-022033

(51) Int. Cl.
*G03G 15/00* (2006.01)

(52) U.S. Cl. ..... 399/159; 430/58.85; 430/72

(58) Field of Classification Search ..... 430/58.65, 430/58.85, 110.4, 72, 73; 399/159
See application file for complete search history.

(56) References Cited

U.S. PATENT DOCUMENTS

| | | | | |
|---|---|---|---|---|
| 3,824,099 | A | 7/1974 | Champ et al. | |
| 4,123,269 | A | 10/1978 | Von Hoene et al. | |
| 4,150,987 | A | 4/1979 | Anderson et al. | |
| 4,278,747 | A | 7/1981 | Murayama et al. | 430/82 |
| 4,338,388 | A | 7/1982 | Sakai et al. | |
| 4,367,273 | A | 1/1983 | Murayama et al. | |
| 4,859,556 | A | 8/1989 | Sasaki | 430/73 |
| 4,892,949 | A | 1/1990 | Sasaki | 546/98 |
| 6,852,462 | B2 * | 2/2005 | Emoto et al. | 430/109.4 |
| 7,157,199 | B2 * | 1/2007 | Emoto et al. | 430/108.22 |
| 7,175,956 | B2 * | 2/2007 | Obata et al. | 430/58.5 |
| 2003/0138718 | A1 * | 7/2003 | Yagi et al. | 430/125 |
| 2004/0101770 | A1 | 5/2004 | Obata et al. | 430/58.85 |

FOREIGN PATENT DOCUMENTS

| | | | |
|---|---|---|---|
| JP | 52-4188 | B2 | 2/1977 |
| JP | 54-150128 | A | 11/1979 |
| JP | 54-151955 | A | 11/1979 |
| JP | 55-52063 | A | 4/1980 |
| JP | 55-42380 | B2 | 10/1980 |
| JP | 58-32372 | B2 | 7/1983 |
| JP | 58-198043 | A | 11/1983 |
| JP | 2-51162 | A | 2/1990 |
| JP | 2-190862 | A | 7/1990 |
| JP | 6-43674 | A | 2/1994 |
| JP | 7-48324 | A | 2/1995 |
| JP | 7-134430 | A | 5/1995 |
| JP | 10-69107 | A | 3/1998 |
| JP | 2787305 | A | 6/1998 |
| JP | 2003-12619 | * | 1/2003 |
| JP | 2004-004266 | A | 1/2004 |

OTHER PUBLICATIONS

USPTO English-language translation of JP 2003-12619 (pub. Jan. 2003).*

* cited by examiner

*Primary Examiner*—Janis L Dote
(74) *Attorney, Agent, or Firm*—Nixon & Vanderhye P.C.

(57) ABSTRACT

An image forming apparatus having excellent chargeability, sensitivity and light responsivity of an electrophotographic photoconductor and capable of forming images of high quality and high resolution at a high speed in various circumstances, is provided. An electrophotographic photoconductor having a photosensitive layer containing the enamine compound represented by the following general formula (1), for example, the enamine compound represented by the following structural formula (1-1) as a charge transportation substance is mounted to an image forming apparatus and the volume average particle size of the toner contained in a developer 50 housed in a developing device 33 is set to a size from 4 to 7 μm.

(1)

(1-1)

6 Claims, 16 Drawing Sheets

IMAGE FORMING APPARATUS

BACKGROUND OF THE INVENTION

1. Field of the Invention

The present invention concerns an electrophotographic image forming apparatus, for example, in a copying machine.

2. Description of the Related Art

An electrophotographic image forming apparatus for forming images by using the electrophotographic technique (hereinafter referred to as electrophotographic apparatus) are used generally as copying machines, printers or facsimile apparatus. In an electrophotographic apparatus, images are formed by way of an electrophotographic process described below. At first a photosensitive layer of a photoconductor provided in the apparatus (hereinafter also referred to simply as a photoconductor) is uniformly charged to a predetermined potential by charging means such as a charging roller, applied with exposure in accordance with image information by exposure means to form electrostatic latent images. A developer is supplied to the formed electrostatic latent images and toners which are a component of the developer are deposited on the surface of the photoconductor to develop the electrostatic latent images and visualized as toner images. The formed toner images are transferred by transfer means from the surface of the photoconductor to a recording medium, for example, recording paper and fixed by fixing means. Further, cleaning is applied by cleaning means having a cleaning blade or the like to the photoconductor after transfer of toner images to remove toners etc. remaining on the surface of the photoconductor not being transferred to a recording medium during transfer operation. Then, the surface of the photosensitive layer is charge-eliminated to eliminate electrostatic latent images by a charge eliminator or the like.

In recent years, the electrophotographic technique has been utilized not being restricted only to the field of the image forming apparatus such as copying machines but has also been utilized in the field of printing print materials, slide films or microfilms for which the photographic technique was used so far, and it is applied also to high speed printers using lasers, Light Emitting Diodes (referred to simply as LED), or Cathode Ray Tubes (referred to simply as CRT). Along with the extension of the application range of the electrophotographic technique, the demand for the electrophotographic photoconductor has become higher and versatile.

An electrophotographic photoconductor is constituted by laminating a photosensitive layer containing a photoconductive material on a conductive support comprising a conductive material. As the electrophotographic photosensitive material, inorganic photoconductors having photosensitive layers comprising, as the main ingredient, inorganic photoconductive materials such as selenium, zinc oxide or cadmium have been used generally. While the inorganic photoconductors have a basic characteristics as the photoconductor to some extent, they involve a problem that the film formation of the photosensitive layer is difficult, the plasticity is poor and the manufacturing cost is expensive. Further, the inorganic photoconductive materials are generally highly toxic and impose large restriction in view of manufacture and handling.

Since the inorganic photoconductive materials and inorganic photoconductors using them have various drawbacks as described above, research and development have been progressed for organic photoconductive materials. The organic photoconductive materials are studied and developed widely in recent years and they are utilized not only for electrophotographic photoconductors but are started to be applied to electrostatic recording devices, sensor materials or organic Electro Lumiscent (simply referred to as EL) devices. Since the organic photoconductors using the organic photoconductive materials has good property for forming the film of the photosensitive layer, are excellent also in the flexibility, as well as photoconductors have advantages such as they are reduced in the weight and have good transparency and photoconductors showing favorable sensitive to a wide range of wavelength region by an appropriate sensitizing method can be designed easily, they have been developed gradually as a main stream of electrophotographic photoconductors.

Though the organic photoconductor has drawbacks in sensitivity and durability in the early stages, the drawbacks are being eliminated by the development of function-separated electrophotographic photoconductors of which charge generation function and charge transportation function thereof are separately attained by different substances. In addition to the above-mentioned advantages of organic photoconductors such function-separated photoconductors have broad latitude in selecting the materials constituting photosensitive layer and have an advantage in that those having any desired characteristics are relatively readily produced. The function separated type photoconductors include a lamination type and a single layer type. In the lamination type function separated photoconductor, a lamination type photosensitive layer constituted by lamination of a charge generation layer containing a charge generation substance for charge generation function and a charge transportation layer containing a charge transportation substance for charge transportation function is provided. The charge generation layer and the charge transportation layer are usually formed such that the charge generation substance and the charge transportation substance are formed respectively being dispersed in binder resins as the binding agent. Further, in the single layer type function-separated photoconductor, a photosensitive layer of a single layer type formed by dispersing the charge generation substance and the charge transportation substance in a binder resin together is provided.

A variety of substances have heretofore been investigated for the charge generation substances that may be used in the function-separated photoconductors, including, for example, phthalocyanine pigments, squarylium dyes, azo pigments, perylene pigments, polycyclic quinone pigments, cyanine dyes, squaric acid dyes and pyrylium salt dyes, and various materials of good light fastness and good charge generation ability have been proposed.

On the other hand, various compounds are proposed for the charge transportation substances, including, for example, pyrazoline compounds (e.g., refer to Japanese Examined Patent Publication JP-B2 52-4188 (1977)), hydrazone compounds (e.g., refer to Japanese Unexamined Patent Publication JP-A 54-150128 (1979), Japanese Examined Patent Publication JP-B2 55-42380 (1980), and Japanese Unexamined Patent Publication JP-A 55-52063 (1980)), triphenylamine compounds (e.g., refer to Japanese Examined Patent Publication JP-B2 58-32372 (1983) and Japanese Unexamined Patent Publication JP-A 2-190862 (1990)) and stilbene compounds (e.g., refer to Japanese Unexamined Patent Publications JP-A 54-151955 (1979) and JP-A 58-198043 (1983)). Recently, pyrene derivatives, naphthalene derivatives and terphenyl derivatives that have a condensed polycyclic hydrocarbon structure as the center nucleus have been developed (e.g., refer to Japanese Unexamined Patent Publication JP-A 7-48324 (1995)).

The charge transportation substances must satisfy the following requirements:

(1) being stable to light and heat;
(2) being stable to active substances such as ozone, nitrogen oxides (NOx) and nitric acid that may be generated in corona discharging on a photoconductor;
(3) good charge transportation ability;
(4) being compatible with organic solvents and binder resins;
(5) being easy to produce and are inexpensive. Though partly satisfying some of these, however, the charge transportation substances disclosed in the above-mentioned patent publications such as Japanese Examined Patent Publication JP-B2 52-4188 (1977), Japanese Unexamined Patent Publication JP-A 54-150128 (1979), Japanese Examined Patent Publication JP-B2 55-42380 (1980), Japanese Unexamined Patent Publication JP-A 55-52063 (1980), Japanese Examined Patent Publication JP-B2 58-32372 (1983), Japanese Unexamined Patent Publication JP-A 2-190862 (1990), Japanese Unexamined Patent Publications JP-A 54-151955 (1979), Japanese Unexamined Patent Publication JP-A 58-198043 (1983) and Japanese Unexamined Patent Publication JP-A 7-48324 (1995) could not satisfy all of these at high level.

Further, in the electrophotographic apparatus for the copying machines and printers, it has been demanded for reducing the size and increasing the image forming speed. For realizing the increase in the image forming speed of the electrophotographic apparatus, it is necessary to increase the speed in each of the steps of the electrophotographic process. For this purpose, it has been demanded for the photoconductor that it is excellent in the chargeability, can be charged uniformly and rapidly, has high sensitivity and light responsivity in the surface potential of the photosensitive layer is delayed rapidly by exposure.

Further, also for realizing the scale or size reduction of the electrophotographic apparatus, it has been demanded for the photoconductor to have high sensitivity and light responsivity. In the electrophotographic apparatus for copying machines and printers, a cylindrical or square cylindrical photoconductor has been used generally and in order to realize the reduction of the size for the electrophotograhic apparatus, it is necessary to decrease the diameter of the photoconductor. In a photoconductor of a small diameter, since the distance between the exposure position and developing position is short, the time from exposure to development is short. In a case of conducting an electrophotographic process at a high speed for increasing the image forming speed, the time from exposure to development is further shortened. In a case where the sensitivity and the light responsivity of the photoconductor are poor, since the decay speed of the surface potential of the photosensitive layer by exposure is retarded, in a case where the time from the exposure to the development is short, development is conducted in a state where the surface potential of the photosensitive layer is not yet decayed sufficiently. Accordingly, in normal development, a phenomenon that is referred to as background contamination where toners are deposited to a portion of images which is to be a white portion occurs, whereas the image density is lowered in a case of a reversal development. Accordingly, in order to make the reduction of the size and the increase in the image forming speed compatible in the electrophotographic apparatus, it requires a photoconductor having high sensitivity and high light responsivity.

In the function separated type photoconductor, since the charges generated in the charge generation substance by light absorption are transported by the charge transportation substance to the surface of the photosensitive layer thereby eliminating the surface charges of the photosensitive layer at a light irradiated portion, the charge mobility of the charge transportation substance gives a significant effect on the sensitivity and the light responsivity. Accordingly, for attaining a photoconductor of high sensitivity and light responsivity, it is demanded for a charge transportation substance having high charge mobility.

Further, high durability is also required for the electrophotographic apparatus and for realizing the high durability of the electrophotographic apparatus, it is demanded for the photoconductor to be excellent in the durability to electrical and mechanical external forces and capable of operating stably for a long time. In a case where the photoconductor is used being mounted on the electrophotographic apparatus, the surface layer of the photoconductor is obliged to be partially scraped off by a contact member such as a cleaning blade or a charging roller. When the amount of film reduction in the surface layer of the photoconductor is large, since the charge retainability of the photoconductor is lowered, failing to provide images at high quality, for attaining high durability of the electrophotographic apparatus, it is demanded for a photoconductor of high mechanical durability having a surface layer resistant to the contact member, that is, a surface layer of high printing resistance with less amount of film reduction described above.

In order to increase the printing resistance of the surface layer thereby improve the mechanical durability of the photoconductor, it is generally necessary to increase the ratio of the binder resin in the charge transportation layer as the surface layer of the photoconductor. However, as the ratio of the binder resin increases, since the ratio of the charge transportation substance is lowered relatively in the charge transportation layer, it results in a problem that the charge mobility of the charge transportation layer is deteriorated to lower the sensitivity and light responsivity. Accordingly, for increasing the ratio of the binder resin thereby improving the mechanical durability of the photoconductor without lowering the sensitivity and the light responsivity, a charge transportation substance having particularly high charge mobility is required.

As the charge transportation substance capable of satisfying such demands, enamine compounds having higher charge mobility than the charge transportation substances disclosed, for example, in Japanese Examined Patent Publication JP-B2 52-4188 (1977), Japanese Unexamined Patent Publication JP-A 54-150128 (1979), Japanese Examined Patent Publication JP-B2 55-42380 (1980), Japanese Unexamined Patent Publication JP-A 55-52063 (1980), Japanese Examined Patent Publication JP-B2 58-32372 (1983), Japanese Unexamined Patent Publication JP-A 2-190862 (1990), Japanese Unexamined Patent Publications JP-A 54-151955 (1979), Japanese Unexamined Patent Publication JP-A 58-198043 (1983) and Japanese Unexamined Patent Publication JP-A 7-48324 (1995) described above are proposed (refer for example to Japanese Unexamined Patent Publication JP-A 2-51162 (1990), Japanese Unexamined Patent Publication JP-A 6-43674 (1994), and Japanese Unexamined Patent Publication JP-A 10-69107 (1998)). Further, in another prior art, incorporation of polysilane and an enamine compound having a specified structure to a light sensitive layer is proposed for improving the hole transportability of the photoconductor (for example, refer to Japanese Unexamined Patent Publication JP-A 7-134430(1995)).

Further, in recent years, digitalization of the image information has been proceeded rapidly with an aim of easily storing or editing the image information, and digital electrophotogrpahic apparatus forming images by using digitalized image information have been used frequently. The digital electrophotographic apparatus have been utilized for the output means not only of monochromatic images but also color images and the demand for higher quality and higher resolution for the images to be formed has been increased more and more. Means for providing higher quality and higher resolution of images include decrease of the particle size of toners as the ingredient of a developer used for the development of electrostatic latent images as typical means. In a case of using toners of small particle size, it is necessary to reduce the beam diameter of a laser beam light mainly used for exposure, that is, optical writing in digital electrophotographic apparatus.

As one of prior arts of forming images by using toners of small particle size, an electrophotographic developing method of visualizing images while providing a specified relation between the minimum beam diameter and the toner particle size in digital writing is proposed (refer to Japanese Examined Patent Publication JP-B2 2787305). Japanese Examined Patent Publication JP-B2 2787305 discloses to obtain images of high picture quality with good gradation reproducibility without degradation of gradation due to dot gain and excellent in resolution and sharpness, by satisfying a specified relation between the minimum spot diameter on electrostatic latent images and the average volume particle size of the toners. The dot gain means that each of dots in toner images obtained by development is larger compared with each dot in electrostatic latent images formed on a photoconductor.

However, according to the technique disclosed in Japanese Examined Patent Publication JP-B2 2787305, since the performance of the photoconductor is not taken into consideration, images at high quality and high resolution cannot sometimes be obtained depending on the photoconductor. This is attributable to the decrease of the beam diameter for the laser beam light. In a case where the beam diameter of the laser beam light is reduced without changing the scanning speed of the laser beam light, the exposure area per unit time is decreased to require a longer time for exposure, so that the scanning speed of the laser beam light has to be increased in a case of reducing the beam diameter of the laser beam light. On the other hand, in a case of increasing the scanning speed of the laser beam light, since the irradiation time per unit area of the laser beam light is shortened, the amount of the laser light irradiated per one dot of the photoconductor is decreased. Accordingly, in a case where the sensitivity and the light responsivity of the photoconductor are poor, since it takes a longer time from exposure to the formation of electrostatic latent images, development is conducted in a state where the surface potential of the photosensitive layer is not sufficiently decayed to result in a problem such as lowering of the density and the resolution of the images to be formed. Recently, a resolution of more than 1200 dpi (dot per inch) has been required and it is necessary to further reduce the beam diameter of the laser beam light, so that degradation of picture qualities is remarkable.

Accordingly, for forming images at high quality and high resolution, it is necessary to reduce the toner particle size and to use a photoconductor of high sensitivity and light responsivity capable of rapidly forming electrostatic latent images even when the amount of the laser light to be irradiated per one dot is small. Particularly, in a case of conducting the electrophotographic process at a high speed in order to increase the image forming speed of the electrophotographic apparatus as described above, since the time from exposure to the development is shortened, a photoconductor of particularly high sensitivity and light responsivity is required.

Since the sensitivity and the light responsivity of a photoconductor depends on the charge mobility of the charge transportation substance as described above, it is considered that a photoconductor having a sufficient sensitivity and light responsivity to attain higher quality and higher resolution can be obtained by using a charge transportation substance having high charge mobility as disclosed in Japanese Unexamined Patent Publication JP-A 2-51162, Japanese Unexamined Patent Publication JP-A 6-43674, and Japanese Unexamined Patent Publication JP-A 10-69107 as described above. However, the charge mobility of the enamine compounds disclosed in Japanese Unexamined Patent Publication JP-A 2-51162, Japanese Unexamined Patent Publication JP-A 6-43674, and Japanese Unexamined Patent Publication JP-A 10-69107 are not sufficient and even when such enamine compounds are used, it is not possible to attain a photoconductor having sufficient sensitivity and light responsivity. Further, while it may be considered to incorporate a polysilane and an enamine compound having a specific structure to a photosensitive layer as in the photoconductor disclosed in Japanese Unexamined Patent Publication JP-A 7-134430, a photoconductor using a polysilane is sensible to light exposure to bring about another problem that various characteristics as the photoconductor are deteriorated by exposure to external light, for example, during maintenance.

Further, since the electrophotographic apparatus are exposed to various circumstances, it is demanded for the photoconductor to show less change of characteristics upon fluctuation of circumstances such as temperature and humidity and to be excellent in the circumstantial stability but a photoconductor also having such characteristics has not yet been obtained.

SUMMARY OF THE INVENTION

An object of the invention is to provide an image forming apparatus having excellent chargeability, sensitivity and light responsivity of an electrophotographic photoconductor and capable of forming images of high quality and high resolution at high speed in various circumstances.

The invention provides an image forming apparatus comprising an electrophotographic photoconductor having a conductive support and a photosensitive layer disposed on the conductive support and containing a charge generation substance and a charge transportation substance, charging means for charging the electrophotographic photoconductor, exposure means for forming electrostatic latent images by applying exposure corresponding to image information to the charged electrophotographic photoconductor, developing means for containing toners, and developing the electrostatic latent images by supplying toners to the surface of the electrophotographic photoconductor thereby forming toner images, and transfer means for transferring the toner images from the surface of the electrophotographic photoconductor to a recording medium, wherein, the charge transportation substance contained in the photosensitive layer of the electrophotographic photoconductor contains an enamine compound represented by the following general formula (1), and a volume average particle diameter of the toners contained in the developing means is in a range from 4 μm to 7 μm.

(1)

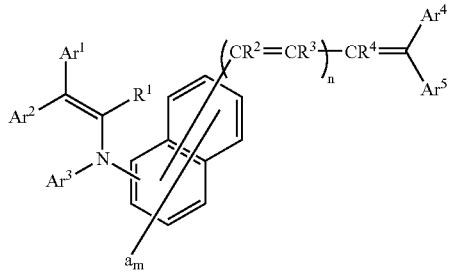

wherein $Ar^1$ and $Ar^2$ each represent an optionally-substituted aryl group or an optionally-substituted heterocyclic group;

$Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; "a" represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, then the $R^2$s may be the same or different and the $R^3$s may be the same or different, but when n is 0, $Ar^3$ is an optionally-substituted heterocyclic group.

Further, in the invention, it is preferable that the enamine compound represented by the general formula (1) is an enamine compound represented by the following general formula (2).

(2)

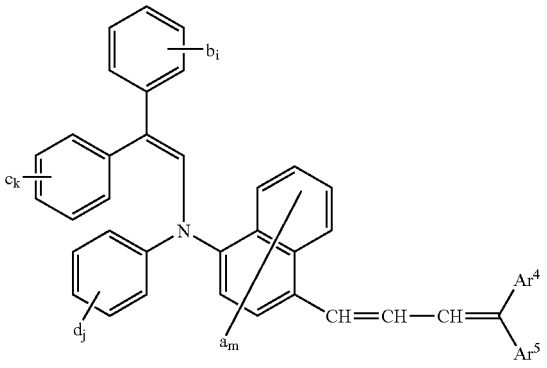

wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

Further, in the invention it is preferable that the charge generation substance contained in the photosensitive layer of the electrophotographic photoconductor contains a phthalocyanine compound.

Further, in the invention it is preferable that the phthalocyanine compound is an oxotitanium phthalocyanine compound.

Further, in the invention it is preferable that the photosensitive layer of the electrophotographic photoconductor is constituted by laminating a charge generation layer containing a charge generation substance and a charge transportation layer containing a charge transportation substance containing an enamine compound represented by the general formula (1).

Further, in the invention it is preferable that the charge transportation layer further contains a binder resin, and a ratio (A/B) between a weight A for the enamine compound represented by the general formula (1) and a weight B for the binder resin in the charge transportation layer is in a range from 10/30 to 10/12.

Further, in the invention it is preferable that the electrophotographic photoconductor further has an intermediate layer between the conductive support and the photosensitive layer.

According to the invention, in the photosensitive layer of the electrophotographic photoconductor provided to the image forming apparatus is incorporated with the enamine compound represented by the general formula (1), preferably, the enamine compound represented by the general formula (2) as a charge transportation substance. Further, the developing means contains toners with a volume average particle size of from 4 μm to 7 μm, which are used for the development of electrostatic latent images.

The enamine compound represented by the general formula (1) contained in the photosensitive layer of the electrophotographic photoconductor has a high charge mobility. Further, the enamine compound represented by the general formula (2) has a particularly high charge mobility among the enamine compounds represented by the general formula (1). Accordingly, an electrophotographic photoconductor excellent in chargeability, sensitivity and light responsivity is attained by incorporating the enamine compound represented by the general formula (1), preferably, the enamine compound represented by the general formula (2) in the photosensitive layer. That is, since the electrophotographic photoconductor used in the image forming apparatus of the invention is excellent in the chargeability, uniform and rapid charging is possible. Further, since the electrophotographic photoconductor used in the image forming apparatus of the invention is excellent in the sensitivity and the light responsivity and the decaying speed of the surface potential of the photosensitive layer due to exposure is fast, electrostatic latent images can be formed rapidly even in a case where the volume average particle size of the toners is set to the range from 4 μm to 7 μm, which is suitable to higher quality and higher resolution of images and the amount of light to be irradiated per one dot upon exposure is decreased. Accordingly, since the electrophotographic process can be conducted at a high speed, it is possible to attain an image forming apparatus capable of forming images at high quality and high-resolution at a high-speed. Further, since the electrophotographic process can be conducted at a high speed even in a case of reducing the size of the electrophotographic photoconductor, it is possible to attain a image forming apparatus small in the size and operating at high speed.

Further, since the favorable electric characteristics of the electrophotographic photoconductor described above are not deteriorated even when surrounding circumstances such as temperature and humidity are changed or even when it is used repetitively, the image forming apparatus according to the invention can stably form images of high quality and high resolution for a long period of time under various circumstances such as low temperature/low humidity circumstances. Further, since the good electric characteristics of the electrophotographic photoconductor described above can be attained with no incorporation of a polysilane to the photosensitive layer, they are not deteriorated even when exposed to the external light. Accordingly, deterioration of the picture quality due to exposure of the electrophotographic photoconductor to the external light, for example, during maintenance can be suppressed.

Further, according to the invention, a phthalocyanine compound, preferably, an oxotitanium phthalocyanine compound is contained as a charge generation substance in the photosensitive layer of the electrophotographic photoconductor. Since the phthalocyanine compound, particularly, the oxotitanium phthalocyanine compound has high charge generation efficiency and a high charge injection efficiency, it generates a great amount of charges by light absorption, and efficiently injects the generated charges to the charge transportation substance without accumulating them to the inside thereof. Further, since the enamine compound represented by the general formula (1) having high charge mobility is contained as the charge transportation substance in the photosensitive layer, charges generated in the phthalocyanine compound by light absorption are efficiently injected to the enamine compound represented by the general formula (1) and transported smoothly to the surface of the photosensitive layer. Accordingly, since the electrophotographic photoconductor equipped in the image forming apparatus of the invention has particularly high sensitivity and light responsivity, it is possible to attain an image forming apparatus capable of forming images with a further higher resolution.

Further, according to the invention, the photosensitive layer of the electrophotographic photoconductor comprises a charge generation layer containing a charge generation substance and a charge transportation layer containing a charge transportation substance including the enamine compound represented by the general formula (1) in stack. As described above, since the charge generation function and the charge transportation function are shared on separate layers, it is possible to select an optimal material to each of the charge generation function and the charge transportation function as the material constituting each of the layers, so that it is possible to attain an electrophotographic photoconductor having particularly high sensitivity and light responsivity and high electric durability also with enhanced stability during repetitive use. Accordingly, images of further higher quality and resolution can be formed. Further, the durability of the image forming apparatus is improved.

Further, according to the invention, the ratio (A/B) between the weight A for the enamine compound represented by the general formula (1) and the weight B for the binder resin in the charge transportation layer of the electrophotographic photoconductor is in the range from 10/30 to 10/12. Since this can improve the printing resistance of the charge transportation layer, the mechanical durability of the electrophotographic photoconductor is improved. Further, since the enamine compound represented by the general formula (1) has a high charge mobility, even when the ratio of the binder resin in the charge transportation layer is increased with the ratio A/B being 10/12 or less, the electrophotographic photoconductor shows sufficiently high sensitivity and light responsivity. That is, since the ratio A/B can be in the range from 10/30 to 10/12 without lowering the sensitivity and the light responsivity, an electrophotographic photoconductor having high sensitivity and light responsivity and excellent in the mechanical durability is attained. Accordingly, the durability of the image forming apparatus can be improved further without deteriorating the quality and the resolution of images.

Further, according to the invention, an intermediate layer is provided between the conductive support and the photosensitive layer of the electrophotographic photoconductor. Since this can prevent injection of charges from the conductive support to the photosensitive layer, degradation of the chargeability of the photosensitive layer can be prevented and decrease of the surface charges in the portion other than the portion to be exposed can be suppressed and occurrence of defects such as fogging in the images can be prevented. Further, since the defects on the surface of the conductive support can be covered to obtain a uniform surface, the film formation property of the photosensitive layer can be improved. Further, since the intermediate layer functions as an adhesive between the conductive support and the photosensitive layer, peeling of the photosensitive layer from the conductive support can be suppressed. Accordingly, since images at high quality and high resolution can be provided further stably, the reliability of the image forming apparatus is improved.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
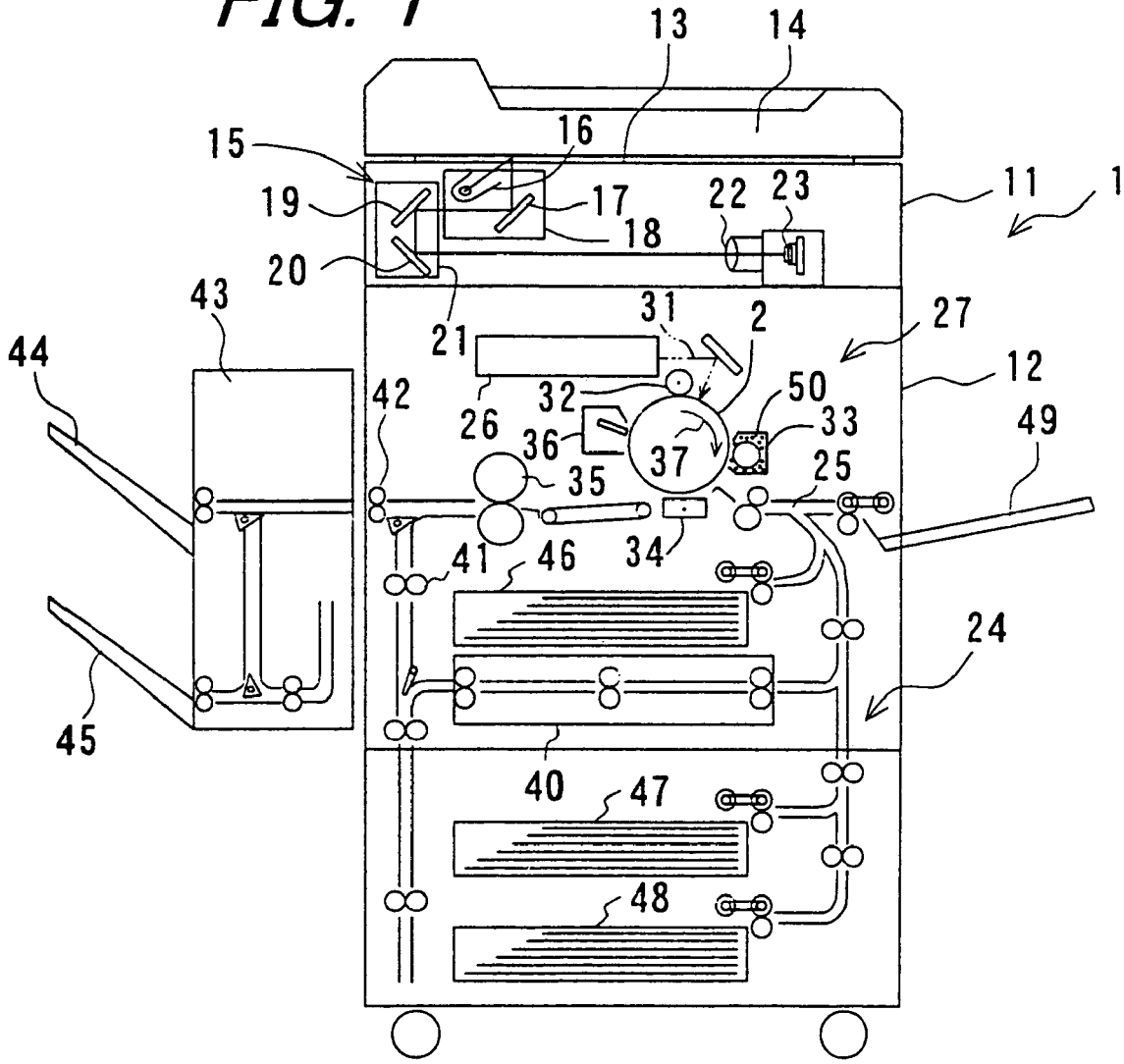
FIG. 1 is a schematic side view showing the constitution of an image forming apparatus according to a first embodiment of the invention.

Now referring to the drawings, preferred embodiments of the invention are described below.

Figure 2:
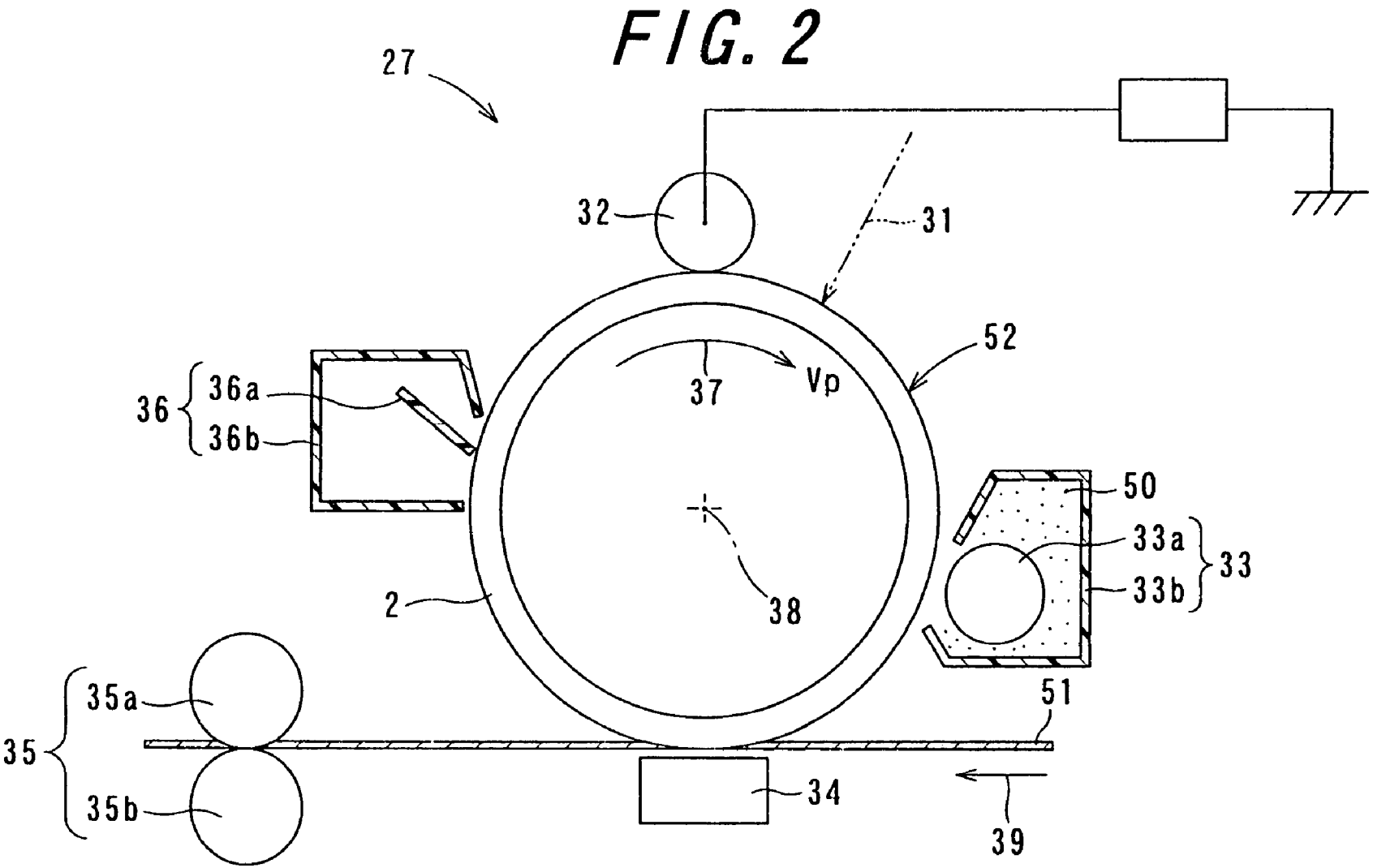
FIG. 2 is an enlarged view showing the constitution of an electrophotographic processing section equipped with image forming apparatus shown in FIG. 1.
Figure 3:
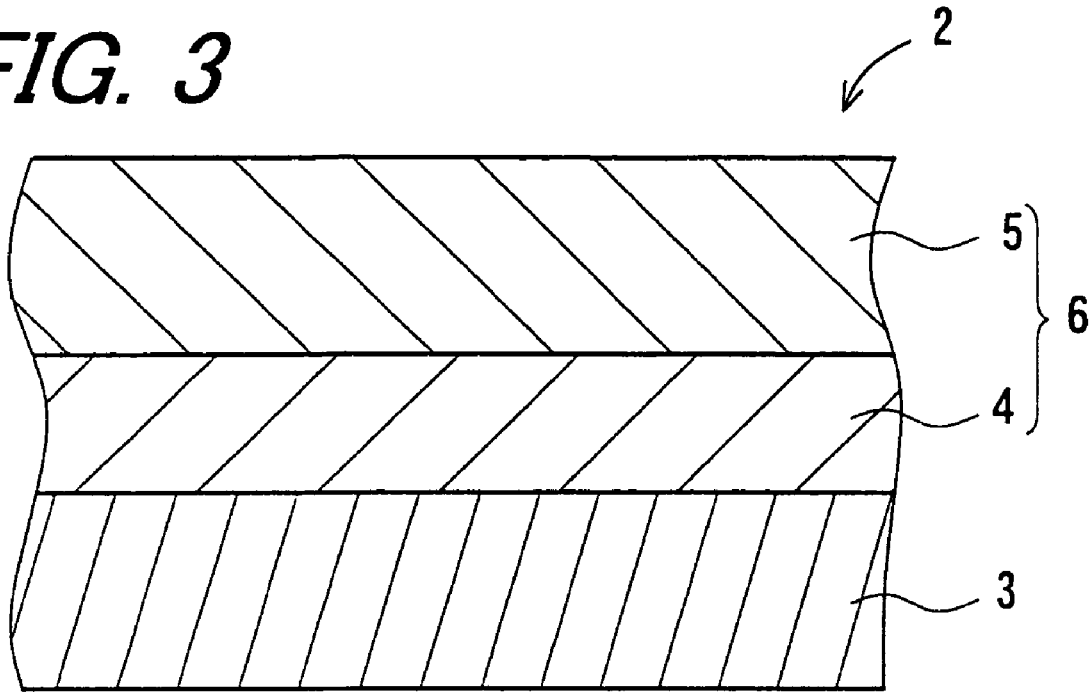
FIG. 3 is a schematic partial cross sectional view showing the constitution of an electrophotographic photoconductor equipped with the electrophotographic processing section shown in FIG. 2.

FIG. 1 is a schematic side view showing the constitution of an image forming apparatus 1 according to a first embodiment of the invention; FIG. 2 is an enlarged view showing the constitution of an electrophotographic processing section 27 equipped with image forming apparatus 1 shown in FIG. 1; and FIG. 3 is a schematic partial cross sectional view showing the constitution of an electrophotographic photoconductor 2 equipped with the electrophotographic processing section 27 shown in FIG. 2.

At first, an electrophotographic photoconductor 2 as a main constituent member of an image forming apparatus 1 in the invention (hereinafter simply referred to as a photoconductor) is to be described. The photoconductor 2 includes a cylindrical conductive support 3 comprising a conductive material, a charge generation layer 4 laminated on the outer circumferential surface of the conductive support 3 and containing a charge generation substance, and a charge transportation layer 5 laminated further on the charge generation layer 4 and containing a charge transportation substance. The charge generation layer 4 and the charge transportation layer 5 constitute a photosensitive layer 6. That is, the photoconductor 2 is a lamination type photoconductor.

The conductive support 3 serves as an electrode for the photoconductor 2 and also functions as a support member for each of other layers 4 and 5. Though the conductive support 3 is formed in a cylindrical shape in this embodiment, this is not restricted thereto but may be, for example, a column-like, sheet-like or endless belt shape.

As the conductive material constituting the conductive support 3, an elemental metal such as aluminum, copper, zinc or titanium, or an alloy such as an aluminum alloy or stainless steel can be used. Further, with no restriction to the metal materials described above, those laminated with a metal foil, those vapor deposited with a metal material, or those vapor deposited or coated with a conductive compound such as a conductive polymer, tin oxide or indium oxide on a surface of polymeric materials such as polyethylene terephthalate, nylon and polystyrene, hard paper or glass can also be each used. The conductive materials can be used being fabricated into a predetermined shape.

On a surface of the conductive support 3, anodized film treatment, surface treatment with chemicals or hot water, coloring treatment or diffuse reflection treatment such as surface roughening may be applied optionally within a range not giving effects on the picture quality. In the electrophotographic process using laser as an exposure light source, since the wavelength of the laser beam light is uniform, laser beam light reflected on the surface of the photoconductor and laser beam light reflected inside the photoconductor may sometimes cause interference and interference fringes caused by the interference appear on the images to form image defects. By applying the treatment described above to the surface of the conductive support 3, image defects caused by the interference of the laser beam light having uniform wavelength can be prevented.

The charge-generating layer 4 chiefly contains a charge generation substance for generating charges by absorbing a light. A substance effective as the charge generation substance includes organic photoconductive materials, for example, azo pigments such as monoazo pigments, bisazo pigments and trisazo pigments, indigo pigments such as indigo and thioindigo, perylene pigment such as perylene imide and perylene acid anhydride, polycyclic quinone pigments such as anthraquinone and pyrene quinone, phthalocyanine compounds such as metal phthaloycyanine and non-metal phthalocyanine, and squalirium dye, pirylium salts and thiopirylium salts and triphenylmethane dyes, and inorganic photoconductive materials such as selenium and amorphous silicone. These charge generation substances may be used each alone or as a combination of two or more of them.

In the present specification, the phthalocyanine compound includes metal phthalocyanine, non-metal phthalocyanines, as well as derivatives thereof and they also include those in which hydrogen atoms on a benzene ring contained in the phthalocyanine group are substituted with substituents such as halogen atoms, for example, chlorine atoms or fluorine atoms, nitro group, cyano group or sulfonic acid group. Further, the metal phthalocyanine compounds may be those in which ligands are coordinated to the center metal.

Among the charge generation substances described above, it is preferred to use a phthalocyanine compound, and it is more preferred to use an oxotitanium phthalocyanine compound represented by the following general formula (A).

(A)

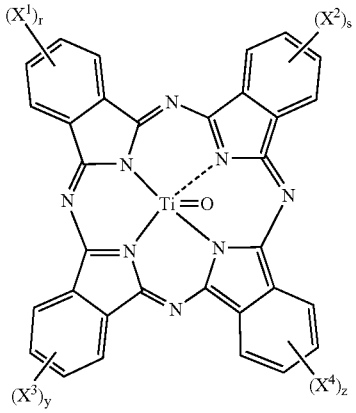

In the general formula (A), $X^1$, $X^2$, $X^3$ and $X^4$ each represent a hydrogen atom, halogen atom, alkyl group or alkoxy group, r, s, y and z each represent an integer of from 0 to 4.

The phthalocyanine compound, especially the oxotitanium phthalocyanine compound represented by the general formula (A) has a high charge generation efficiency and a high charge injection efficiency. Therefore, it generates large amount of charges by absorbing a light, and injects the generated charges efficiently to the charge transportation substance contained in the charge transportation layer 5, without being accumulated therein. Further, since the enamine compound represented by the general formula (1) having high charge mobility contained in the charge transportation layer 5 is used for the charge transportation substance in the embodiment of the invention. Accordingly, the charges generated in the oxotitanium phthalocyanine compound by absorption of a light is injected effectively to the enamine compound represented by the general formula (1), and transported smoothly to the surface of the photosensitive layer 6. Accordingly, a photoconductor 2 having high sensitivity and high resolution is obtained by using the phthalocyanine compound, preferably oxotitanium phthalocyanine compound represented by the general formula (A) as the charge generation substance and the enamine compound represented by the general formula (1) to be described later as the charge transportation substance.

The phthalocyanine compound preferably has a specified crystal structure. Those preferred among the non-metal phthalocyanine compounds include those of X-type, α-type, β-type, γ-type, τ-type, π-type, τ'-type, η-type or η'-type. Among them, the X-type non-metal phthalocyanine is used preferably. Further, those preferred among the oxotitanium phthalocyanine compounds represented by the general formula (A) in the X-ray diffraction spectrum for Cu-Kα special X-ray (wavelength: 1.54 Å), include those having a crystal structure showing a distinct diffraction peak at least at a Bragg angle 2θ (error: 2θ±0.2°) of 27.2°. In the specification, the Bragg angle 2θ is an angle formed between incident X-ray and diffraction X-rays, which represents a so-called diffraction angle.

The phthalocyanine compound, such as the oxotitanium phthalocyanine compound represented by the general formula (A) can be produced by a production process known so far such as a process described in "Phthalocyanine Compound" written by Moser and Thomas. For example, among oxotitanium phthalocyanine compounds represented by the general formula (A), oxotitanium phthalocyanine in which $X^1$, $X^2$, $X^3$ and $X^4$ each represents a hydrogen atom is obtained by synthesizing dichlorotitanium phthalocyanine by melting under heating of phthalonitrile and titanium tetrachloride or reacting them under heating in an appropriate solvent such as α-chloronaphthalene, and thereafter hydrolyzing the same with a base or water. Further, the oxotitanium phthalocyanine can also be produced by reacting under heating isoindoline and titanium tetraalkoxide such as tetrabuthoxytitanium in an appropriate solvent such as N-methylpyrrolidone.

The charge generation substance may also be used in combination with sensitizing dyes such as triphenyl methane dyes typically represented by methyl violet, crystal violet, night blue and Victoria blue, an acridine dyes typically represented by erythrocin, rhodamine B, rhodamine 3R, acridine orange and flapeocin, thiazine dyes typically represented by methylene blue and methyl green, oxadine dyes typically represented by capriblue and Meldora's blue, cyanine dyes, styryl dyes, pyrylium salt dyes or thiopyrylium salt dyes.

A method of forming the charge generation layer 4 usable herein can include a method of vapor-depositing the charge generation substance on the surface of the conductive support 3 or a method of coating a coating liquid for charge generation layer obtained by dispersing the charge generation substance described above in an appropriate solvent on the surface of the conductive support 3. Among them, preferably used is a method of dispersing the charge generation substance in a binder resin solution obtained by mixing a binder resin as a binder in a solvent by a method known so far to prepare a coating liquid for charge generation layer and coating the obtained coating liquid on the surface of the conductive support 3. Explanation will be made to the method below.

The binder resin to be used for the charge generation layer 4 can include, for example, resins such as polyester resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinyl butyral resin and polyvinyl formal resin and copolymer resins containing two or more repetitive units constituting these resins. Specific examples of the copolymer resin can include insulating resins such as vinyl chloride-vinyl acetate copolymer resin, vinyl chloride-vinyl acetate-maleic acid anhydride copolymer resin and acrylonitrile-styrene copolymer resin. The binder resin is not limited to them, but generally used resins can e used as a binder resin. These resins can be used alone or two or more of them may be used as a mixture.

As a solvent for the coating liquid for charge generation layer, for example, halogenated hydrocarbons such as dichloromethane or dichloroethane, ketones such as acetone, methyl ethyl ketone or cyclohexanone, esters such as ethyl acetate or butyl acetate, ethers such as tetrahydrofuran (referred to as THF) or dioxane, alkylethers of ethylene glycol such as 1,2-dimethoxyethane, aromatic hydrocarbons such as benzene, toluene or xylene, or aprotonic polar solvents such as N,N-dimethyl formamide (referred as to DMF) or N,N-dimethylacetoamide, etc, are used. The solvents may be used alone or two or more of them may be mixed and used as a mixed solvent.

In the charge generation layer 4 constituted by containing the charge generation substance and the binder resin, a ratio W1/W2 between a weight W1 of charge generation substance and a weight W2 of binder resin is preferably in a range of 10/100 or more and 99/100 or less. In a case where the ratio W1/W2 is less than 10/100, the sensitivity of the photoconductor 2 is lowered. In a case where the ratio W1/W2 exceeds 99/100, since not only the film strength of the charge generation layer 4 is lowered but also the dispersibility of charge generation substance is lowered to increase the coarse particles, surface charges in the portions other than those to be eliminated by exposure are decreased to increase image defects, particularly, fogging of images referred to as black spots formed as minute black spots by the adhesion of the toner on the white background. Accordingly, the preferred range for the ratio W1/W2 is defined as 10/100 or more and 99/100 or less.

The charge generation substance may be pulverized previously by a pulverizer before dispersion in a binder resin solution. The pulverizer used for the pulverization can include, for example, a ball mill, sand mill, attritor, vibration mill and supersonic dispersing machine.

The dispersing machine used upon dispersion of the charge generation substance in the binder resin solution can include, for example, a paint shaker, ball mill or sand mill. As the dispersion condition in this case, appropriate conditions are selected so that impurities are not mixed, for example, by abrasion of members constituting a vessel and a dispersing machine to be used.

The coating method of the coating liquid for charge generation layer can include, for example, spray methods, bar coat methods, roll coat methods, blade methods, wring methods or dip coating methods. Among the coating methods, an optimal method can be selected while taking the physical property of coating and productivity into consideration. Among the coating methods, particularly, the dip coating method is used preferably since this method is relatively simple and excellent in view of the productivity and the cost. It is noted that this method is a method of dipping a support to a coating tank filled with a coating liquid and then pulling up it at a constant speed or a successively changing speed thereby forming a layer on the surface of the support. As the apparatus used for the dip coating method, a coating liquid dispersion apparatus typically represented by a supersonic wave generation apparatus may also be provided.

The thickness of the charge generation layer 4 is, preferably, in a range of 0.05 μm or more and 5 μm or less, more preferably, 0.1 μm or more and 1 μm or less. In a case where the thickness of the charge generation layer 4 is less than 0.05 μm, the light absorption efficiency is lowered to lower the sensitivity of the photoconductor 2. In a case where the thickness of the charge generation layer 4 exceeds 5 μm, charge transfer inside the charge generation layer 4 forms a rate-determining step in the process of eliminating the surface charges of the photosensitive layer 6 to lower the sensitivity of photoconductor 2. Accordingly, suitable range for the thickness of the charge generation layer 4 is defined as 0.05 μm or more and 5 μm or less.

The charge transportation layer 5 is provided on the charge generation layer 4. The charge transportation layer 5 can be constituted with a charge transportation substance having a function of receiving charges generated from the charge generation substance contained in the charge generation layer 4 and transporting them and a binder resin for binding charge transportation substance. An enamine compound represented by the following general formula (1) is used as the charge transportation substance.

(1)

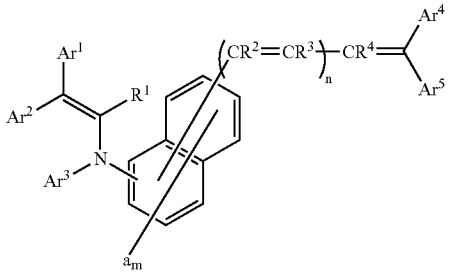

In the general formula (1), $Ar^1$ and $Ar^2$ each represent an optionally-substituted aryl group or an optionally-substituted heterocyclic group; $Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; "a" represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, then the $R^2$s may be the same or different and the $R^3$s may be the same or different, but when n is 0, $Ar^3$ is an optionally-substituted heterocyclic group.

For the charge transportation substance, an enamine compound represented by the following general formula (2), among enamine compounds represented by the general formula (1), is preferably used.

(2)

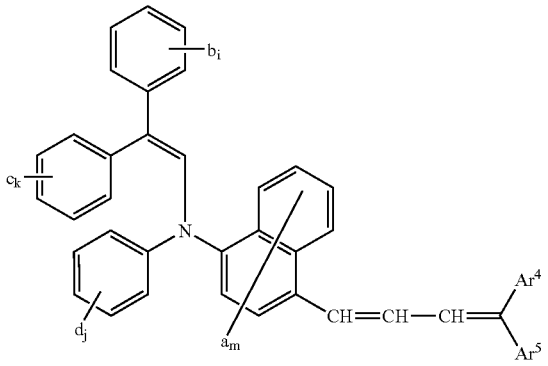

In the general formula (2), b, c and d each represent optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

Enamine compounds represented by the general formula (1) have a high charge transportation ability. In the enamine compounds represented by the general formula (1), enamine compounds represented by the general formula (2) have particularly high charge transportation ability. Accordingly, a photoconductor 2 of high sensitivity, excellent in light responsiveness and chargeability can be obtained by incorporating any of the enamine compounds represented by the general formula (1), preferably, any of the enamine compounds represented by general formula (2) as the charge transportation substance into the charge transportation layer 5. Particularly, a photoconductor 2 of high sensitivity, particularly excellent in light responsiveness can be obtained by using the phthalocyanine compound described above as the charge generation substance contained in the charge generation layer 4. The good electric characteristics of the photoconductor 2 are maintained even when the circumstances surrounding the photoconductor 2, for example, temperature and humidity are changed, or maintained without degradation even after repetitive use photoconductor Further, a photoconductor 2 having good electric characteristics described above can be obtained with no incorporation of polysilicone to the charge transportation layer 5, using any of the enamine compounds represented by the general formula (1), preferably, any of the enamine compounds represented by the general formula (2). Accordingly, a photoconductor 2 having good electric characteristics as described above even when exposed to light can be obtained.

Further, among enamine compounds represented by the general formula (1), enamine compounds represented by the general formula (2) can be synthesized relatively easily, and have a high production yield, they can be produced at a reduced cost. Accordingly, since the photoconductor 2 having good electric characteristics as described above can be produced at a low production cost using any of the enamine compounds represented by the general formula (2) as the charge transportation substance, the production cost of the image forming apparatus 1 can be reduced.

In the present specification, the aryl group can include, for example, phenyl, naphthyl, biphenyl, terphenyl, pyrenyl and anthryl. The substituent that can be present on the aryl group can include, for example, an alkyl group such as methyl, ethyl and propyl, a halogenated alkyl group such as trifluoromethyl, an alkenyl group such as 2-propenyl and styryl, an alkoxy group such as methoxy, ethoxy and propoxy, a dialkylamino group such as dimethylamino, diethylamino and diisopropylamino, a halogen atom such as fluorine atom, chlorine atom and bromine atom, an aryloxy group such as phenoxy, and an arylthio group such as phenylthio. The aryl group having the substituent can include, for example, tolyl, methoxyphenyl, phenoxyphenyl, p-(phenylthio)phenyl and p-styrylphenyl.

The heterocyclic group can include, 5-membered, 6-membered or condensed ring, preferably, 5-membered heterocyclic group such as furyl, thienyl, thiazolyl, benzofuryl, benzothiophenyl, benzothiazolyl, benzooxazolyl and benzopyranyl having, as a hetero atom, oxygen atom, nitrogen atom, sulfur atom, selenium atom or tellurium atom, preferably, oxygen atom, nitrogen atom or sulfur atom. The substituent that can be present on the heterocyclic ring can include those identical with the substituents that can be present on the aryl group described above. The heterocyclic group having the substituent can include, for example, N-methylindolyl and N-ethylcarbazolyl.

The aralkyl group can include, for example, benzyl and 1-naphthylmethyl. The substituent that can be present on the aralkyl group can include those identical with the substituent that can be present in the aryl group as described above. The aralkyl group having the substituent can include, for example, p-methoxybenzyl.

The alkyl group is preferably an alkyl group of from 1 to 6 carbon atoms and can include, for example, a chained alkyl group such as methyl, ethyl, n-propyl, isopropyl, and t-butyl, and a cycloalkyl group such as cyclohexyl and cyclopentyl. The substituent that can be present on the alkyl group can include those identical with the substituent that can be present on the aryl group. The alkyl group having the substituent can include, for example, a halogenated alkyl group such as trifluoromethyl, fluoromethyl, and 2,2,2-trifluoroethyl, an alkoxyalkyl group such as 1-methoxyethyl and methoxymethyl, and an alkyl group substituted with a heterocyclic group such as 2-thienylmethyl.

The alkoxy group is preferably an alkoxy group of from 1 to 4 carbon atoms and can include, for example, methoxy, ethoxy, n-propoxy and iso-propoxy. The substituent that can be present on the alkoxy group can include those identical with the substituents that can be present in the aryl group.

The dialkylamino group is an amino group in which two hydrogen atoms are substituted with alkyl groups, and the dialkylamino group having the substituent is an amino group substituted with an alkyl group having a substituent. The dialkylamino group is preferably those substituted with an alkyl group of from 1 to 4 carbon atoms and can include, for example, dimethylamino, diethylamino and diisopropylamino.

The halogen atoms can include, for example, fluorine atom and chlorine atom.

In the general formula (1), the atom bonding $Ar^4$ and $Ar^5$ can include, for example, an oxygen atom, sulfur atom and nitrogen atom. The nitrogen atom bonds as a bivalent group such as N-alkylimino group or an N-arylimino group, $Ar^4$ and $Ar^5$. The atom group bonding $Ar^4$ and $Ar^5$ can include those bivalent groups, for example, an alkylene group such as methylene, ethylene and methylmethylene, an alkenylene group such as vinylene and propenylene, an alkylene group bonded with a hetero atom such as oxymethylene (chemical formula: —O—$CH_2$—), and an alkenylene group bonded with a hetero atom such as thiovinylene (chemical formula: —S—CH═CH—).

Among the enamine compounds represented by the general formula (1), particularly excellent compounds in view of the characteristics, cost and the productivity can include those in which $Ar^1$ and $Ar^2$ are phenyl, $Ar^3$ is phenyl, tolyl, p-methoxyphenyl, biphenylyl, naphthyl or thienyl, at least one of $Ar^4$ and $Ar^5$ is phenyl, p-tolyl, p-methoxyphenyl, naphthyl, thienyl or thiazolyl, $R^1$, $R^2$, $R^3$ and $R^4$ are each hydrogen atom, and n is 1.

Specific examples of the enamine compound represented by the general formula (1), while exemplified compounds No. 1 to No. 220 shown in the following Table 1 to Table 32 can be mentioned, the enamine compounds shown by the general formula (1) are not restricted to them. In Table 1 to Table 32, each of the exemplified compounds is expressed by the group corresponding to each group in the general formula (1). For example, Exemplified compound No. 1 shown in Table 1 is an enamine compound represented by the following structural formula (1-1). However, Table 1 to Table 32, in a case of exemplifying those in which $Ar^4$ and $Ar^5$ are bonded to each other, carbon-carbon double bond to which $Ar^4$ and $Ar^5$ are bonded and carbon atoms of the carbon-carbon double bond, as well as a ring structure formed with $Ar^4$ and $Ar^5$ are shown together from the column for $Ar^4$ to the column for $Ar^5$.

(1-1)

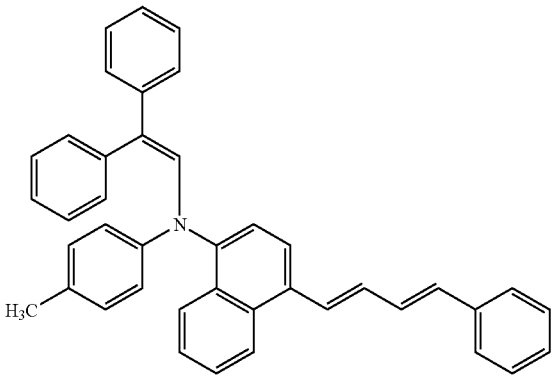

TABLE 1
| Compound No. | $Ar^1$ | $Ar^2$ | $R^1$ | $Ar^3$ | 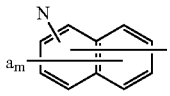 | n | $-(CR^2=CR^3)_n-$ | $R^4$ | $Ar^4$ | $Ar^5$ |
|---|---|---|---|---|---|---|---|---|---|---|
| 1 | 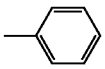 | 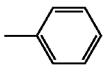 | H | 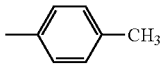 | 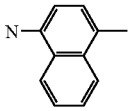 | 1 | CH=CH | H | H | 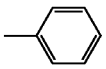 |
| 2 | 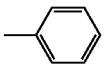 | 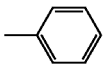 | H | 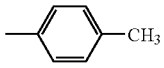 | 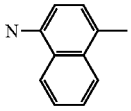 | 1 | CH=CH | H | H | 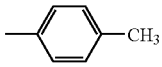 |
| 3 | 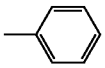 | 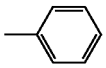 | H | 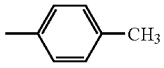 | 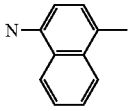 | 1 | CH=CH | H | $-CH_3$ | 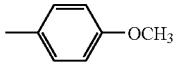 |
| 4 | 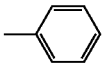 | 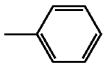 | H | 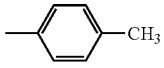 | 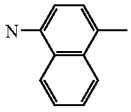 | 1 | CH=CH | H | H | 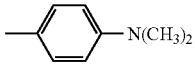 |
| 5 | 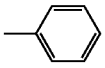 | 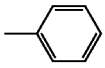 | H | 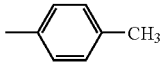 | 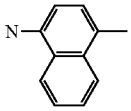 | 1 | CH=CH | H | H | 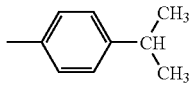 |
| 6 | 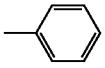 | 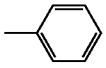 | H | 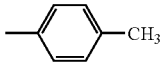 | 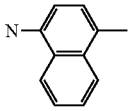 | 1 | CH=CH | H | H | 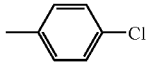 |
| 7 | 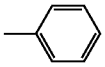 | 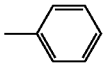 | H | 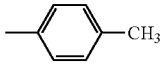 | 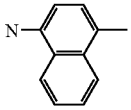 | 1 | CH=CH | H | $-CH_3$ | 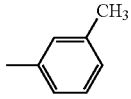 |

TABLE 2
| Compound No. | $Ar^1$ | $Ar^2$ | $R^1$ | $Ar^3$ | 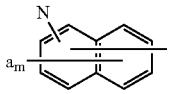 | n | $-(CR^2=CR^3)_n-$ | $R^4$ | $Ar^4$ | $Ar^5$ |
|---|---|---|---|---|---|---|---|---|---|---|
| 8 | 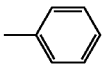 | 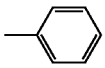 | H | 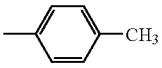 | 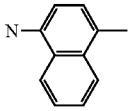 | 1 | CH=CH | H | H | 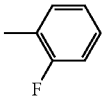 |
| 9 | 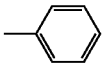 | 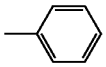 | H | 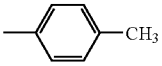 | 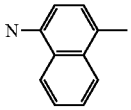 | 1 | CH=CH | H | $-CH_3$ | 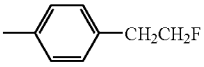 |
| 10 | 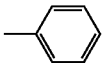 | 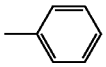 | H | 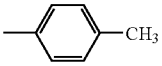 | 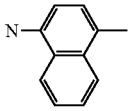 | 1 | CH=CH | H | $-CH_3$ | 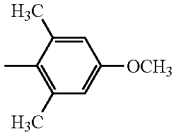 |
| 11 | 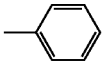 | 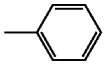 | H | 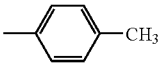 | 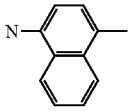 | 1 | CH=CH | H | H | 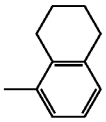 |
| 12 | 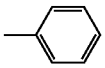 | 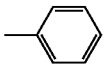 | H | 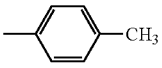 | 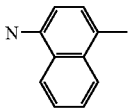 | 1 | CH=CH | H | H | 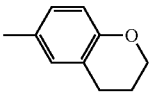 |
| 13 | 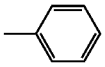 | 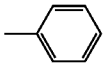 | H | 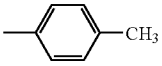 | 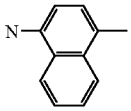 | 1 | CH=CH | H | H | 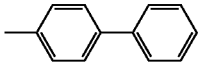 |
| 14 | 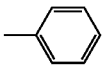 | 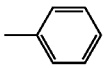 | H | 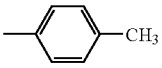 | 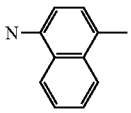 | 1 | CH=CH | H | H | 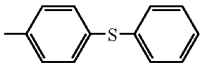 |

TABLE 3
| Compound No. | $Ar^1$ | $Ar^2$ | $R^1$ | $Ar^3$ | 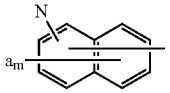 | n | $-(CR^2{=}CR^3)_n-$ | $R^4$ | $Ar^4$ | $Ar^5$ |
|---|---|---|---|---|---|---|---|---|---|---|
| 15 | 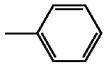 | 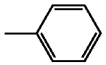 | H | 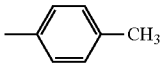 | 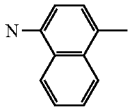 | 1 | CH═CH | H | H | 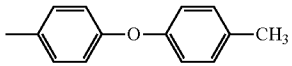 |
| 16 | 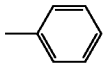 | 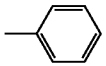 | H | 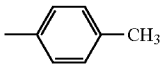 | 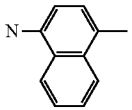 | 1 | CH═CH | H | —$CH_3$ | 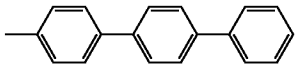 |
| 17 | 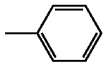 | 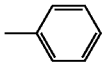 | H | 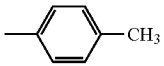 | 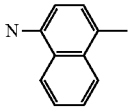 | 1 | CH═CH | H | H | 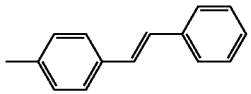 |
| 18 | 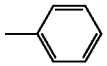 | 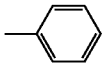 | H | 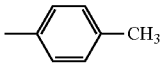 | 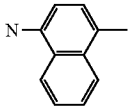 | 1 | CH═CH | H | —$CH_3$ | 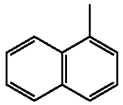 |
| 19 | 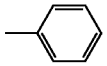 | 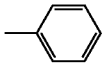 | H | 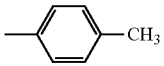 | 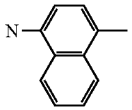 | 1 | CH═CH | H | H | 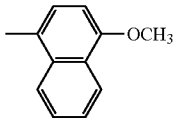 |
| 20 | 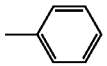 | 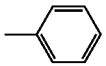 | H | 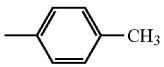 | 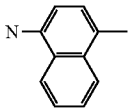 | 1 | CH═CH | H | H | 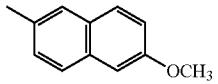 |
| 21 | 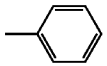 | 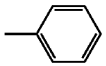 | H | 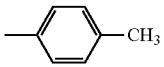 | 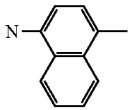 | 1 | CH═CH | H | H | 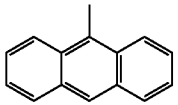 |

TABLE 4
| Compound No. | $Ar^1$ | $Ar^2$ | $R^1$ | $Ar^3$ | 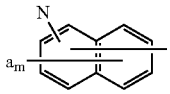 | n | $-(CR^2=CR^3)_n-$ | $R^4$ | $Ar^4$ | $Ar^5$ |
|---|---|---|---|---|---|---|---|---|---|---|
| 22 | 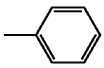 | 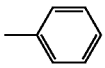 | H | 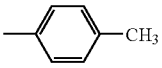 | 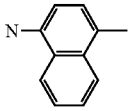 | 1 | CH=CH | H | H | 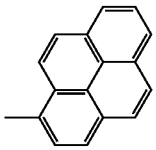 |
| 23 | 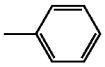 | 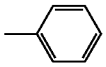 | H | 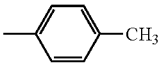 | 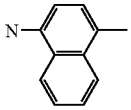 | 1 | CH=CH | H | $-CH_3$ | 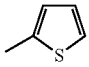 |
| 24 | 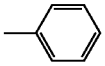 | 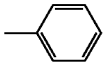 | H | 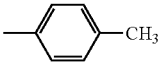 | 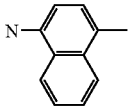 | 1 | CH=CH | H | $-CH_3$ | 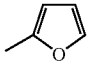 |
| 25 | 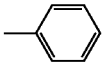 | 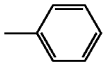 | H | 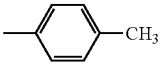 | 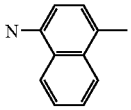 | 1 | CH=CH | H | H | 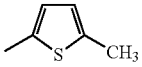 |
| 26 | 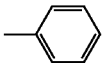 | 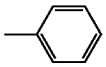 | H | 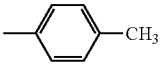 | 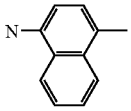 | 1 | CH=CH | H | H | 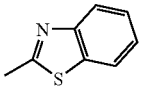 |
| 27 | 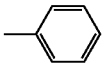 | 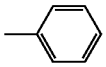 | H | 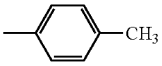 | 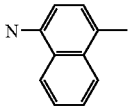 | 1 | CH=CH | H | H | 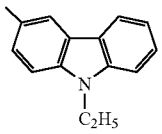 |
| 28 | 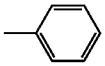 | 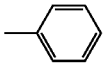 | H | 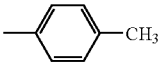 | 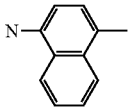 | 1 | CH=CH | H | 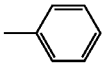 | 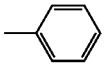 |

TABLE 5
| Compound No. | $Ar^1$ | $Ar^2$ | $R^1$ | $Ar^3$ | 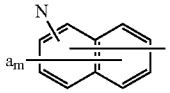 | n | $-(CR^2{=}CR^3)_n-$ | $R^4$ | $Ar^4$ | $Ar^5$ |
|---|---|---|---|---|---|---|---|---|---|---|
| 29 | 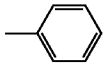 | 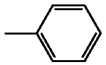 | H | 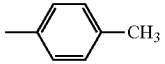 | 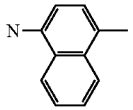 | 1 | CH═CH | H | 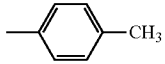 | 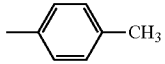 |
| 30 | 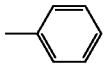 | 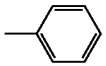 | H | 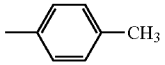 | 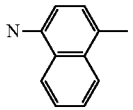 | 1 | CH═CH | H | 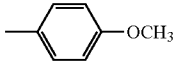 | 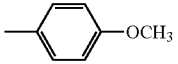 |
| 31 | 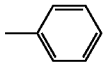 | 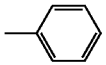 | H | 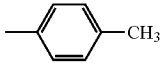 | 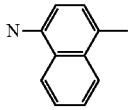 | 1 | CH═CH | H | 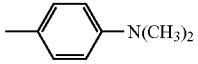 | 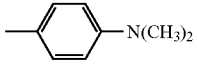 |
| 32 | 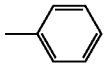 | 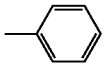 | H | 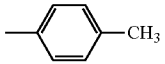 | 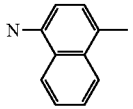 | 1 | CH═CH | H | 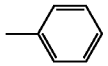 | 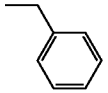 |
| 33 | 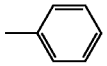 | 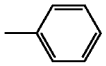 | H | 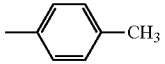 | 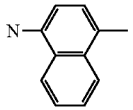 | 1 | CH═CH | H | 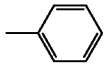 | 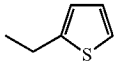 |
| 34 | 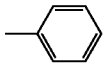 | 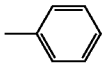 | H | 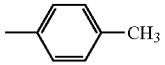 | 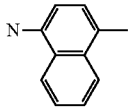 | 1 | CH═CH | H | 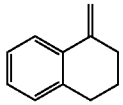 | |
| 35 | 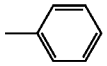 | 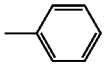 | H | 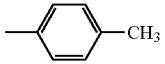 | 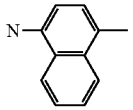 | 1 | CH═CH | H | 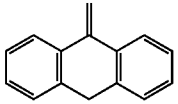 | |

TABLE 6
| Compound No. | $Ar^1$ | $Ar^2$ | $R^1$ | $Ar^3$ | 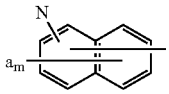 | n | $-(CR^2{=}CR^3)_n-$ | $R^4$ | $Ar^4$ | $Ar^5$ |
|---|---|---|---|---|---|---|---|---|---|---|
| 36 | 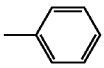 | 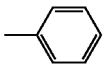 | H | 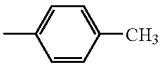 | 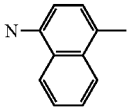 | 1 | CH=CH | H | 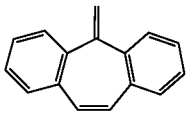 | |
| 37 | 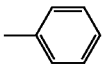 | 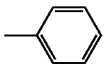 | H | 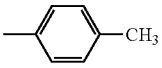 | 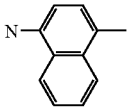 | 1 | CH=CH | H | 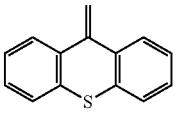 | |
| 38 | 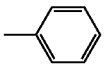 | 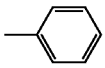 | H | 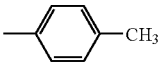 | 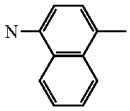 | 1 | CH=CH | H | 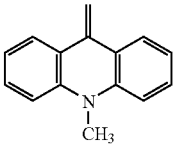 | |
| 39 | 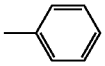 | 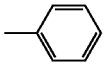 | H | 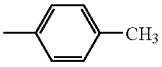 | 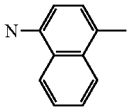 | 1 | CH=CH | $-CH_3$ | H | 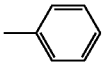 |
| 40 | 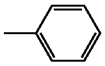 | 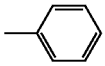 | H | 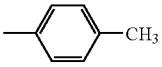 | 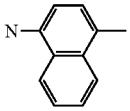 | 1 | CH=CH | 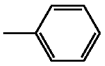 | H | 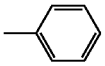 |
| 41 | 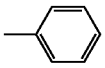 | 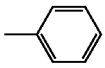 | H | 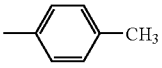 | 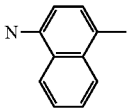 | 1 | 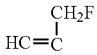 | H | H | 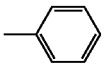 |
| 42 | 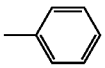 | 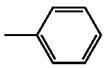 | H | 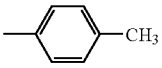 | 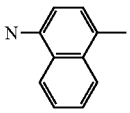 | 1 | 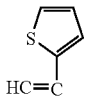 | H | H | 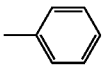 |

TABLE 7
| Compound No. | $Ar^1$ | $Ar^2$ | $R^1$ | $Ar^3$ | 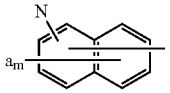 | n | $-(CR^2{=}CR^3)-_n$ | $R^4$ | $Ar^4$ | $Ar^5$ |
|---|---|---|---|---|---|---|---|---|---|---|
| 43 | 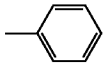 | 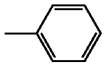 | H | 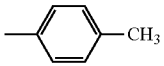 | 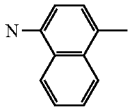 | 1 | 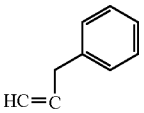 | H | H | 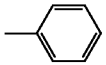 |
| 44 | 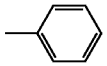 | 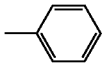 | H | 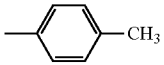 | 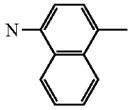 | 1 | 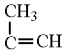 | H | H | 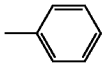 |
| 45 | 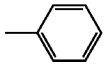 | 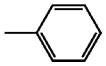 | H | 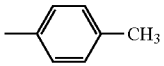 | 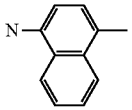 | 1 | 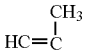 | 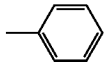 | H | 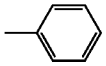 |
| 46 | 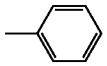 | 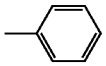 | H | 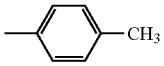 | 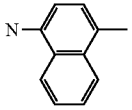 | 2 | CH═CH—CH═CH | H | H | 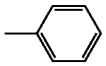 |
| 47 | 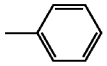 | 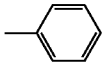 | H | 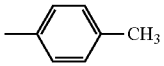 | 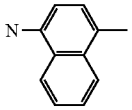 | 2 | CH═CH—CH═CH | H | H | 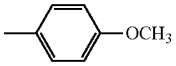 |
| 48 | 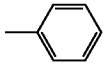 | 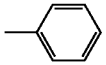 | H | 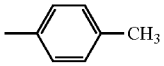 | 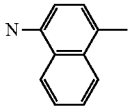 | 2 | CH═CH—CH═CH | H | —$CH_3$ | 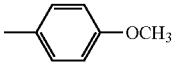 |
| 49 | 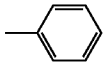 | 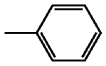 | H | 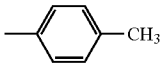 | 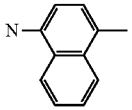 | 2 | CH═CH—CH═CH | H | —$CH_3$ | 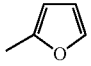 |

TABLE 8
| Compound No. | $Ar^1$ | $Ar^2$ | $R^1$ | $Ar^3$ | 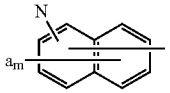 | n | $-(CR^2=CR^3)_n-$ | $R^4$ | $Ar^4$ | $Ar^5$ |
|---|---|---|---|---|---|---|---|---|---|---|
| 50 | 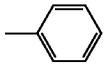 | 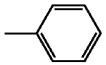 | H | 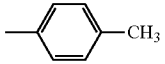 | 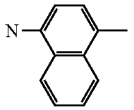 | 2 | CH=CH—CH=CH | H | —$CH_3$ | 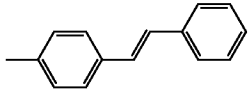 |
| 51 | 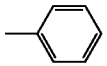 | 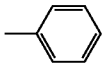 | H | 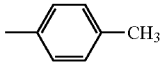 | 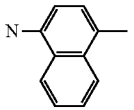 | 2 | CH=CH—CH=CH | H | —$CH_3$ | 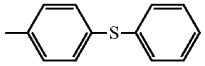 |
| 52 | 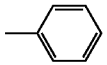 | 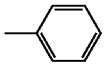 | H | 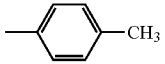 | 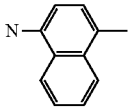 | 2 | $HC=C(CH_3)-CH=CH$ | H | H | 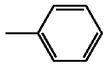 |
| 53 | 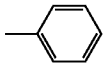 | 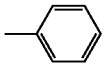 | H | 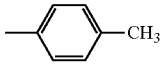 | 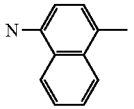 | 2 | $HC=C(CH_3)-C(CH_2OCH_3)=CH$ | H | H | 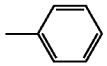 |
| 54 | 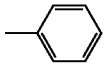 | 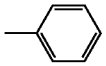 | H | 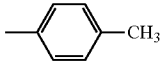 | 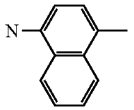 | 3 | $-(HC=CH)_3-$ | H | H | 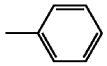 |
| 55 | 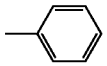 | 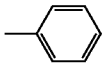 | H | 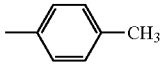 | 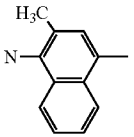 | 1 | CH=CH | H | H | 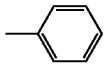 |
| 56 | 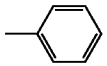 | 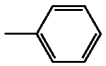 | H | 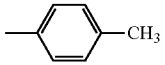 | 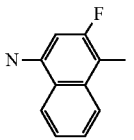 | 1 | CH=CH | H | H | 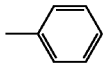 |

TABLE 9
| Compound No. | $Ar^1$ | $Ar^2$ | $R^1$ | $Ar^3$ | 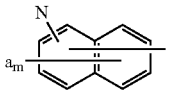 | n | $-(CR^2=CR^3)_n-$ | $R^4$ | $Ar^4$ | $Ar^5$ |
|---|---|---|---|---|---|---|---|---|---|---|
| 57 | 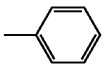 | 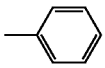 | H | 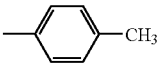 | 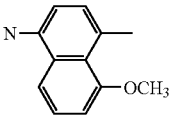 | 1 | CH=CH | H | H | 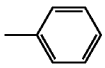 |
| 58 | 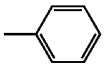 | 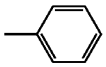 | H | 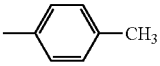 | 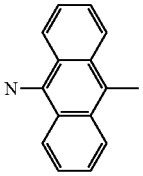 | 1 | CH=CH | H | H | 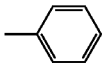 |
| 59 | 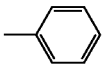 | 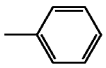 | H | 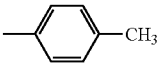 | 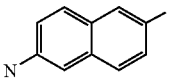 | 1 | CH=CH | H | H | 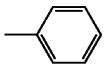 |
| 60 | 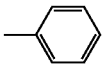 | 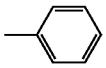 | H | 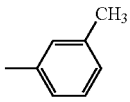 | 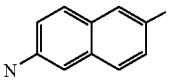 | 1 | CH=CH | H | H | 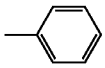 |
| 61 | 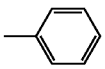 | 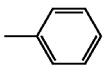 | H | 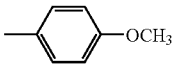 | 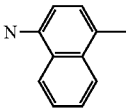 | 1 | CH=CH | H | H | 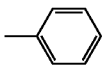 |
| 62 | 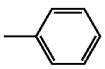 | 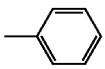 | H | 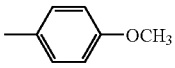 | 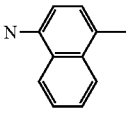 | 1 | CH=CH | H | H | 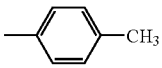 |
| 63 | 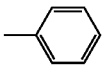 | 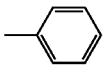 | H | 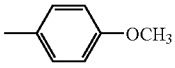 | 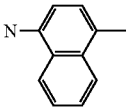 | 1 | CH=CH | H | $-CH_3$ | 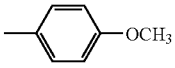 |

TABLE 10
| Compound No. | $Ar^1$ | $Ar^2$ | $R^1$ | $Ar^3$ | 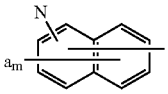 | n | $-(CR^2{=}CR^3)_n-$ | $R^4$ | $Ar^4$ | $Ar^5$ |
|---|---|---|---|---|---|---|---|---|---|---|
| 64 | 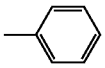 | 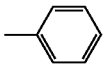 | H | 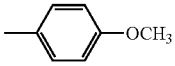 | 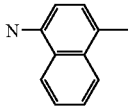 | 1 | CH═CH | H | H | 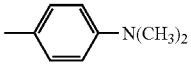 |
| 65 | 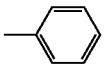 | 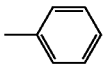 | H | 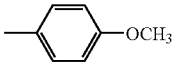 | 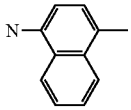 | 1 | CH═CH | H | H | 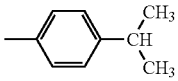 |
| 66 | 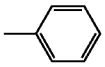 | 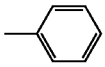 | H | 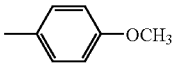 | 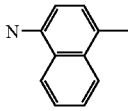 | 1 | CH═CH | H | $-CH_3$ | 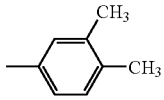 |
| 67 | 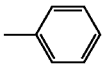 | 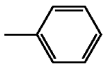 | H | 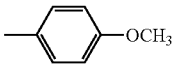 | 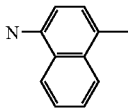 | 1 | CH═CH | H | H | 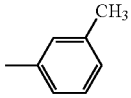 |
| 68 | 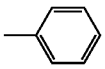 | 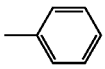 | H | 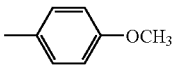 | 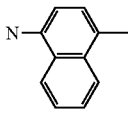 | 1 | CH═CH | H | H | 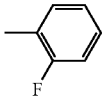 |
| 69 | 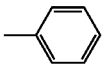 | 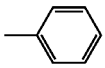 | H | 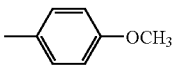 | 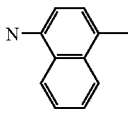 | 1 | CH═CH | H | H | 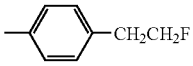 |
| 70 | 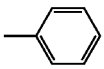 | 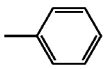 | H | 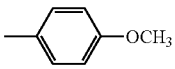 | 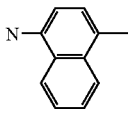 | 1 | CH═CH | H | H | 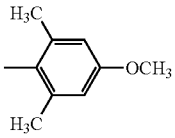 |

TABLE 11
| Compound No. | $Ar^1$ | $Ar^2$ | $R^1$ | $Ar^3$ | 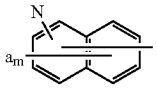 | n | $-(CR^2{=}CR^3)_n-$ | $R^4$ | $Ar^4$ | $Ar^5$ |
|---|---|---|---|---|---|---|---|---|---|---|
| 71 | 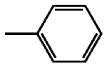 | 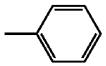 | H | 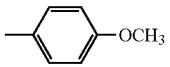 | 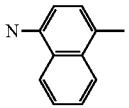 | 1 | CH═CH | H | H | 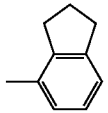 |
| 72 | 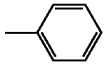 | 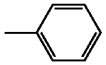 | H | 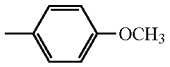 | 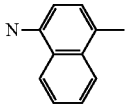 | 1 | CH═CH | H | H | 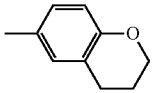 |
| 73 | 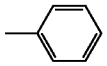 | 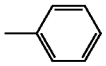 | H | 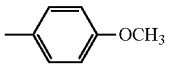 | 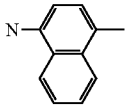 | 1 | CH═CH | H | H | 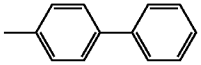 |
| 74 | 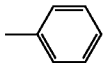 | 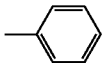 | H | 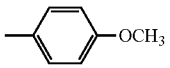 | 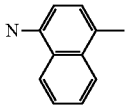 | 1 | CH═CH | H | H | 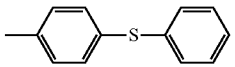 |
| 75 | 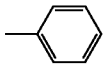 | 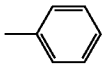 | H | 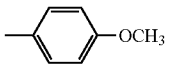 | 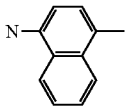 | 1 | CH═CH | H | H | 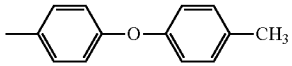 |
| 76 | 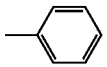 | 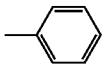 | H | 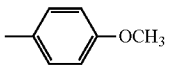 | 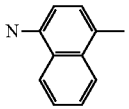 | 1 | CH═CH | H | H | 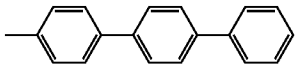 |
| 77 | 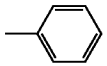 | 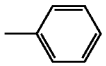 | H | 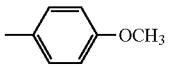 | 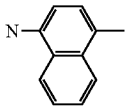 | 1 | CH═CH | H | H | 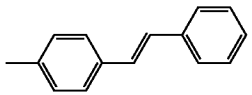 |

TABLE 12
| Compound No. | $Ar^1$ | $Ar^2$ | $R^1$ | $Ar^3$ | 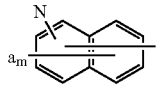 | n | $-(CR^2=CR^3)_n-$ | $R^4$ | $Ar^4$ | $Ar^5$ |
|---|---|---|---|---|---|---|---|---|---|---|
| 78 | 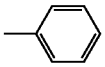 | 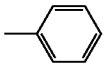 | H | 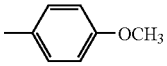 | 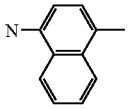 | 1 | CH=CH | H | H | 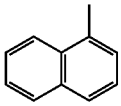 |
| 79 | 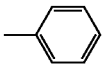 | 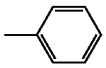 | H | 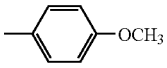 | 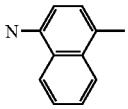 | 1 | CH=CH | H | H | 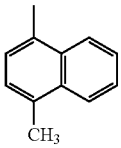 |
| 80 | 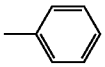 | 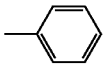 | H | 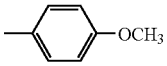 | 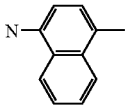 | 1 | CH=CH | H | H | 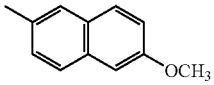 |
| 81 | 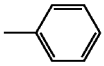 | 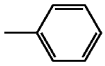 | H | 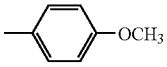 | 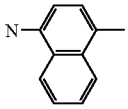 | 1 | CH=CH | H | H | 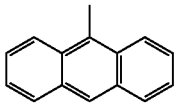 |
| 82 | 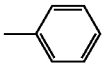 | 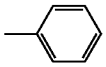 | H | 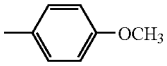 | 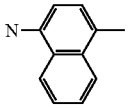 | 1 | CH=CH | H | H | 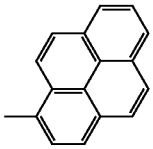 |
| 83 | 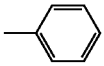 | 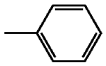 | H | 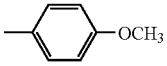 | 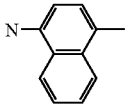 | 1 | CH=CH | H | H | 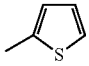 |
| 84 | 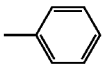 | 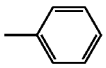 | H | 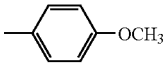 | 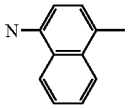 | 1 | CH=CH | H | H | 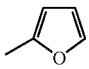 |

TABLE 13
| Compound No. | $Ar^1$ | $Ar^2$ | $R^1$ | $Ar^3$ | 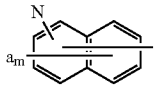 | n | $-(CR^2{=}CR^3)_n-$ | $R^4$ | $Ar^4$ | $Ar^5$ |
|---|---|---|---|---|---|---|---|---|---|---|
| 85 | 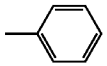 | 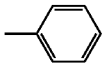 | H | 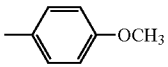 | 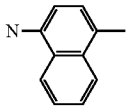 | 1 | CH═CH | H | —$CH_3$ | 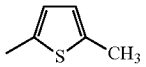 |
| 86 | 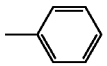 | 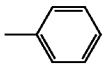 | H | 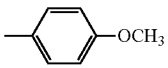 | 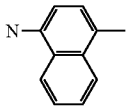 | 1 | CH═CH | H | —$CH_3$ | 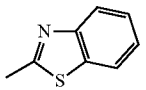 |
| 87 | 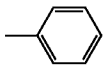 | 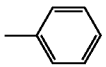 | H | 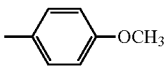 | 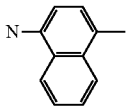 | 1 | CH═CH | H | —$CH_3$ | 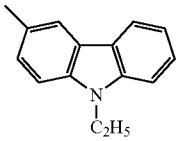 |
| 88 | 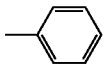 | 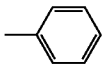 | H | 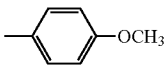 | 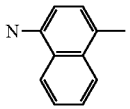 | 1 | CH═CH | H | 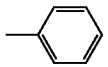 | 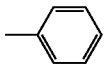 |
| 89 | 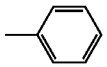 | 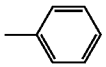 | H | 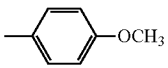 | 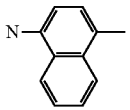 | 1 | CH═CH | H | 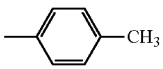 | 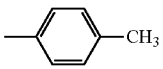 |
| 90 | 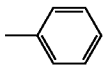 | 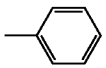 | H | 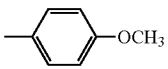 | 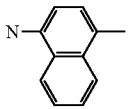 | 1 | CH═CH | H | 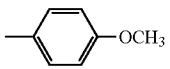 | 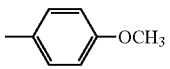 |
| 91 | 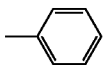 | 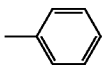 | H | 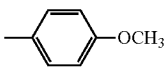 | 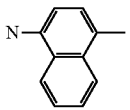 | 1 | CH═CH | H | 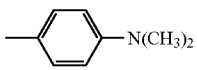 | 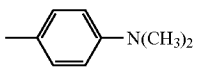 |

TABLE 14
| Compound No. | $Ar^1$ | $Ar^2$ | $R^1$ | $Ar^3$ | 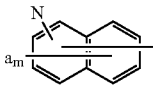 | n | $-(CR^2=CR^3)_n-$ | $R^4$ | $Ar^4$ | $Ar^5$ |
|---|---|---|---|---|---|---|---|---|---|---|
| 92 | 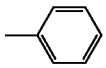 | 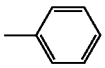 | H | 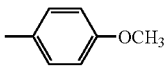 | 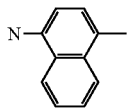 | 1 | CH=CH | H | 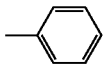 | 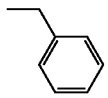 |
| 93 | 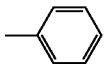 | 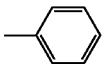 | H | 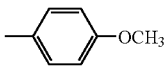 | 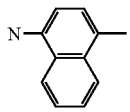 | 1 | CH=CH | H | 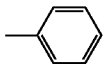 | 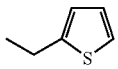 |
| 94 | 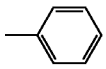 | 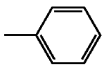 | H | 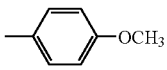 | 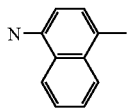 | 1 | CH=CH | H | 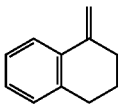 | |
| 95 | 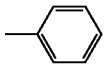 | 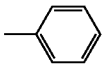 | H | 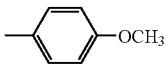 | 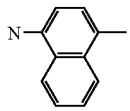 | 1 | CH=CH | H | 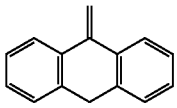 | |
| 96 | 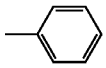 | 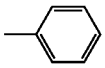 | H | 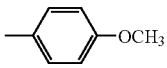 | 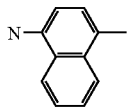 | 1 | CH=CH | H | 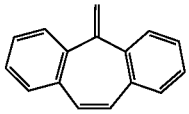 | |
| 97 | 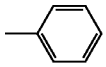 | 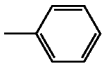 | H | 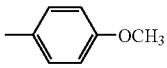 | 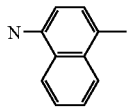 | 1 | CH=CH | H | 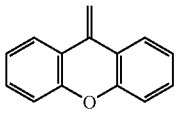 | |
| 98 | 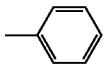 | 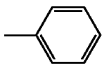 | H | 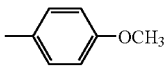 | 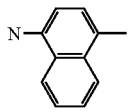 | 1 | CH=CH | H | 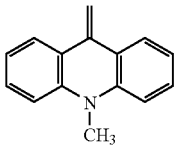 | |
TABLE 15
| Compound No. | $Ar^1$ | $Ar^2$ | $R^1$ | $Ar^3$ | 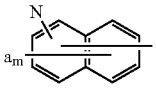 | n | $-(CR^2=CR^3)_n-$ | $R^4$ | $Ar^4$ | $Ar^5$ |
|---|---|---|---|---|---|---|---|---|---|---|
| 99 | 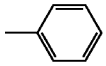 | 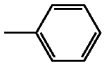 | H | 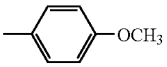 | 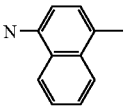 | 1 | CH=CH | $-CH_3$ | H | 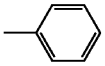 |
| 100 | 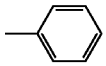 | 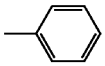 | H | 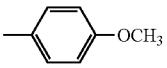 | 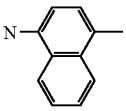 | 1 | CH=CH | 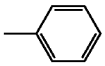 | H | 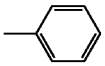 |
| 101 | 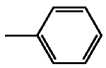 | 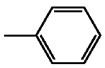 | H | 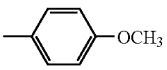 | 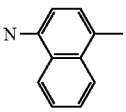 | 1 | 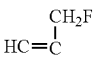 | H | H | 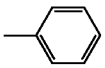 |

TABLE 15-continued
| Compound No. | $Ar^1$ | $Ar^2$ | $R^1$ | $Ar^3$ | 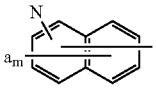 | n | $-(CR^2{=}CR^3)_n-$ | $R^4$ | $Ar^4$ | $Ar^5$ |
|---|---|---|---|---|---|---|---|---|---|---|
| 102 | 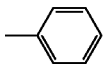 | 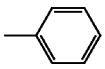 | H | 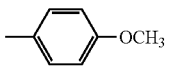 | 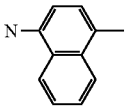 | 1 | 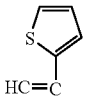 | H | H | 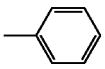 |
| 103 | 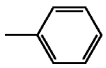 | 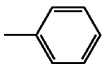 | H | 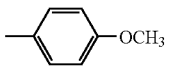 | 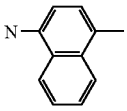 | 1 | 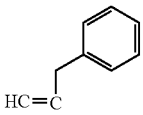 | H | H | 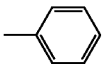 |
| 104 | 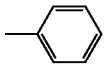 | 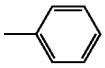 | H | 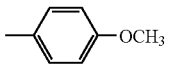 | 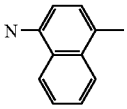 | 1 | 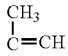 | H | H | 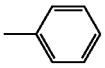 |
| 105 | 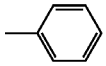 | 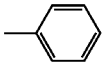 | H | 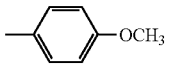 | 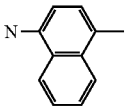 | 1 | 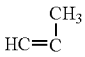 | 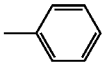 | H | 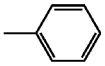 |
TABLE 16
| Compound No. | $Ar^1$ | $Ar^2$ | $R^1$ | $Ar^3$ | 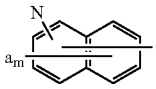 | n | $-(CR^2{=}CR^3)_n-$ | $R^4$ | $Ar^4$ | $Ar^5$ |
|---|---|---|---|---|---|---|---|---|---|---|
| 106 | 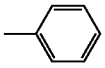 | 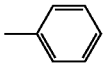 | H | 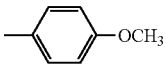 | 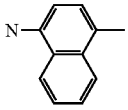 | 2 | CH═CH—CH═CH | H | H | 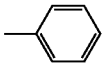 |
| 107 | 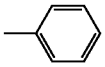 | 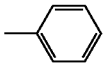 | H | 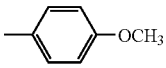 | 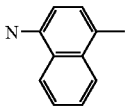 | 2 | CH═CH—CH═CH | H | H | 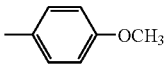 |
| 108 | 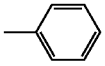 | 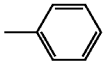 | H | 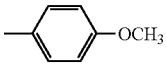 | 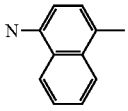 | 2 | CH═CH—CH═CH | H | —$CH_3$ | 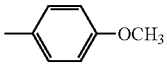 |
| 109 | 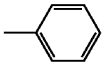 | 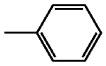 | H | 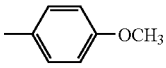 | 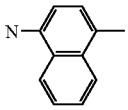 | 2 | CH═CH—CH═CH | H | —$CH_3$ | 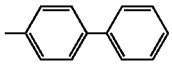 |
| 110 | 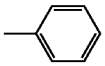 | 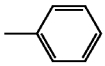 | H | 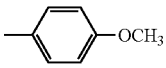 | 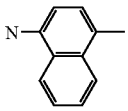 | 2 | CH═CH—CH═CH | H | —$CH_3$ | 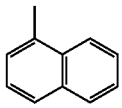 |
| 111 | 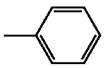 | 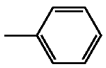 | H | 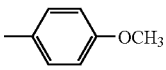 | 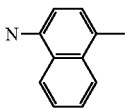 | 2 | CH═CH—CH═CH | H | —$CH_3$ | 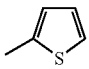 |

TABLE 16-continued
| Compound No. | $Ar^1$ | $Ar^2$ | $R^1$ | $Ar^3$ | 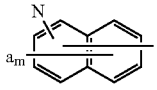 | n | $-(CR^2=CR^3)_n-$ | $R^4$ | $Ar^4$ | $Ar^5$ |
|---|---|---|---|---|---|---|---|---|---|---|
| 112 | 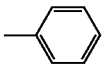 | 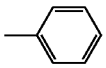 | H | 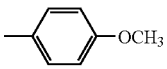 | 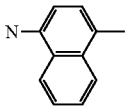 | 2 | CH=CH—CH=CH | H | H | 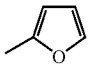 |
TABLE 17
| Compound No. | $Ar^1$ | $Ar^2$ | $R^1$ | $Ar^3$ | 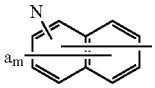 | n | $-(CR^2=CR^3)_n-$ | $R^4$ | $Ar^4$ | $Ar^5$ |
|---|---|---|---|---|---|---|---|---|---|---|
| 113 | 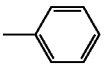 | 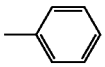 | H | 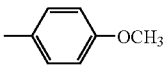 | 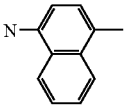 | 2 | 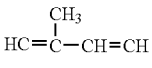 | H | H | 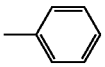 |
| 114 | 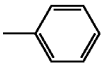 | 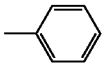 | H | 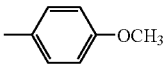 | 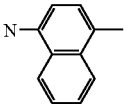 | 2 | 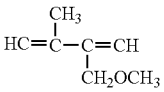 | H | H | 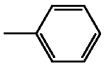 |
| 115 | 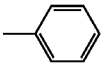 | 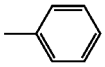 | H | 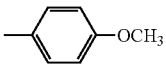 | 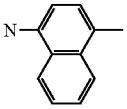 | 3 | $-(HC=CH)_3-$ | H | H | 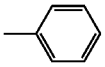 |
| 116 | 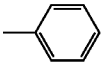 | 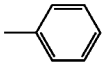 | H | 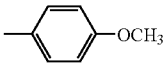 | 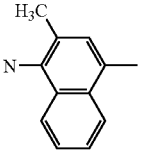 | 1 | CH=CH | H | H | 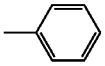 |
| 117 | 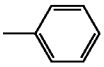 | 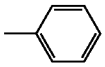 | H | 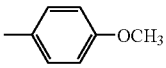 | 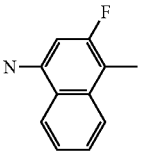 | 1 | CH=CH | H | H | 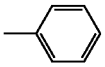 |
| 118 | 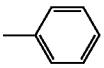 | 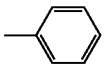 | H | 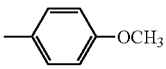 | 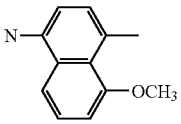 | 1 | CH=CH | H | H | 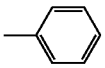 |
| 119 | 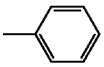 | 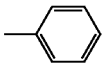 | H | 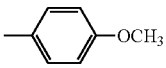 | 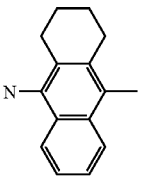 | 1 | CH=CH | H | H | 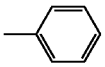 |

TABLE 18
| Compound No. | $Ar^1$ | $Ar^2$ | $R^1$ | $Ar^3$ | 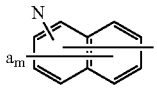 | n | $-(CR^2=CR^3)_n-$ | $R^4$ | $Ar^4$ | $Ar^5$ |
|---|---|---|---|---|---|---|---|---|---|---|
| 120 | 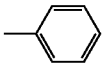 | 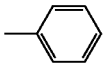 | H | 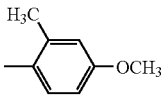 | | 1 | CH=CH | H | H | 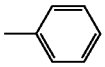 |
| 121 | 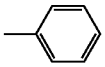 | 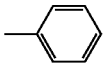 | H | 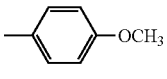 | | 1 | CH=CH | H | H | 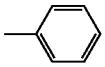 |
| 122 | 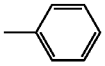 | 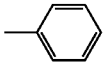 | H | 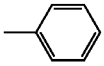 | 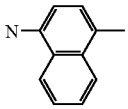 | 1 | CH=CH | H | H | 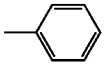 |
| 123 | 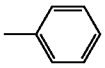 | 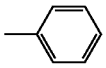 | H | 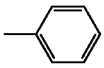 | 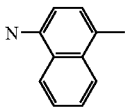 | 1 | CH=CH | H | $-CH_3$ | 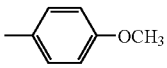 |
| 124 | 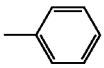 | 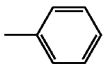 | H | 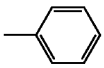 | 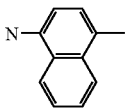 | 1 | CH=CH | H | 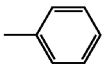 | 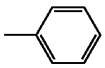 |
| 125 | 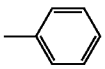 | 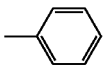 | H | 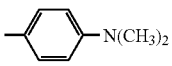 | 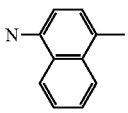 | 1 | CH=CH | H | H | 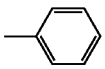 |
| 126 | 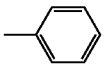 | 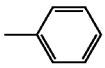 | H | 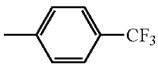 | 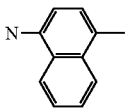 | 1 | CH=CH | H | H | 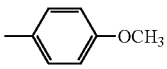 |

TABLE 19
| Compound No. | $Ar^1$ | $Ar^2$ | $R^1$ | $Ar^3$ | 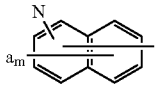 | n | $-(CR^2=CR^3)_n-$ | $R^4$ | $Ar^4$ | $Ar^5$ |
|---|---|---|---|---|---|---|---|---|---|---|
| 127 | 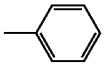 | 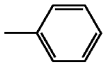 | H | 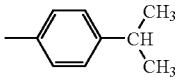 | 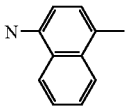 | 1 | CH=CH | H | 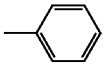 | 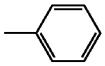 |
| 128 | 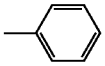 | 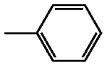 | H | 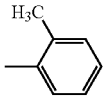 | 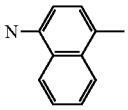 | 1 | CH=CH | H | H | 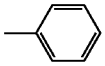 |
| 129 | 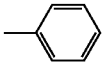 | 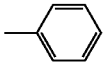 | H | 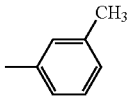 | 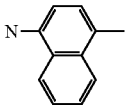 | 1 | CH=CH | H | H | 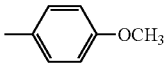 |
| 130 | 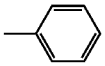 | 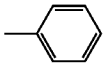 | H | 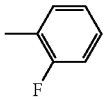 | 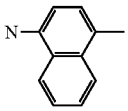 | 1 | CH=CH | H | 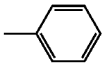 | 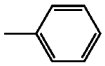 |
| 131 | 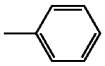 | 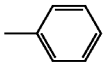 | H | 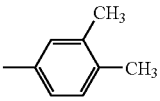 | 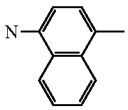 | 1 | CH=CH | H | H | 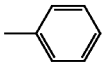 |
| 132 | 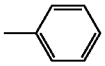 | 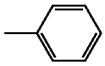 | H | 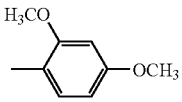 | 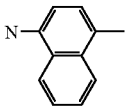 | 1 | CH=CH | H | $-CH_3$ | 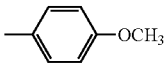 |
| 133 | 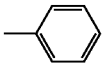 | 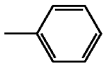 | H | 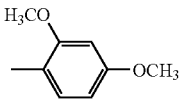 | 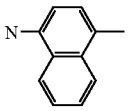 | 1 | CH=CH | H | 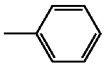 | 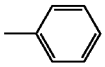 |

TABLE 20
| Compound No. | $Ar^1$ | $Ar^2$ | $R^1$ | $Ar^3$ | 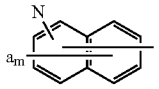 | n | $-(CR^2{=}CR^3)_n-$ | $R^4$ | $Ar^4$ | $Ar^5$ |
|---|---|---|---|---|---|---|---|---|---|---|
| 134 | 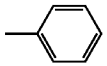 | 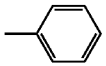 | H | 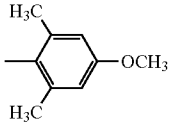 | 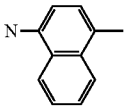 | 1 | CH═CH | H | H | 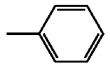 |
| 135 | 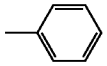 | 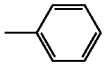 | H | 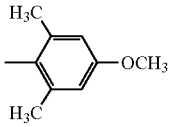 | 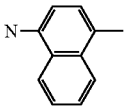 | 1 | CH═CH | H | H | 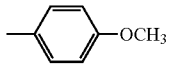 |
| 136 | 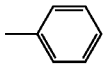 | 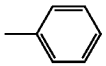 | H | 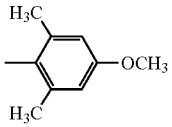 | 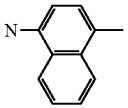 | 1 | CH═CH | H | 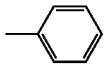 | 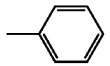 |
| 137 | 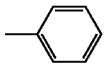 | 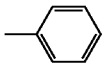 | H | 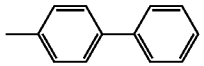 | 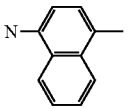 | 1 | CH═CH | H | H | 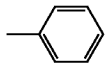 |
| 138 | 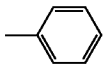 | 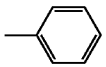 | H | 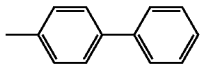 | 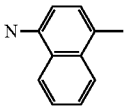 | 1 | CH═CH | H | $-CH_3$ | 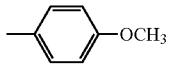 |
| 139 | 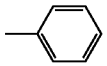 | 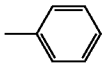 | H | 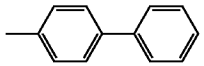 | 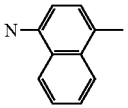 | 1 | CH═CH | H | 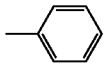 | 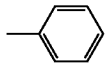 |
| 140 | 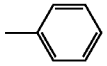 | 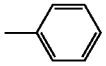 | H | 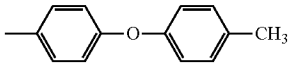 | 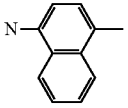 | 1 | CH═CH | H | H | 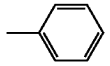 |

TABLE 21
| Compound No. | $Ar^1$ | $Ar^2$ | $R^1$ | $Ar^3$ | 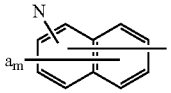 | n | $-(CR^2{=}CR^3)-_n$ | $R^4$ | $Ar^4$ | $Ar^5$ |
|---|---|---|---|---|---|---|---|---|---|---|
| 141 | 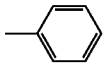 | 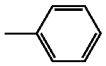 | H | 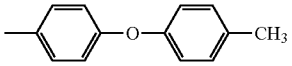 | 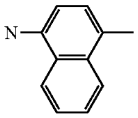 | 1 | CH═CH | H | H | 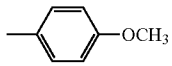 |
| 142 | 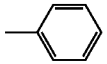 | 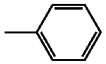 | H | 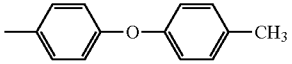 | 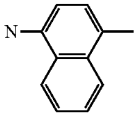 | 1 | CH═CH | H | —$CH_3$ | 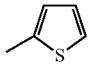 |
| 143 | 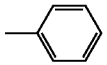 | 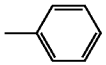 | H | 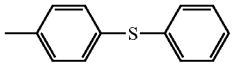 | 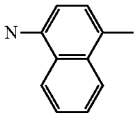 | 1 | CH═CH | H | H | 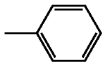 |
| 144 | 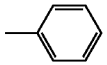 | 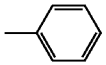 | H | 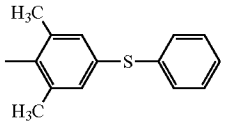 | 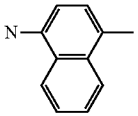 | 1 | CH═CH | H | —$CH_3$ | 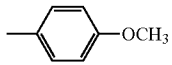 |
| 145 | 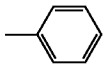 | 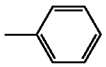 | H | 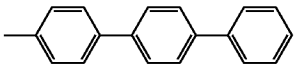 | 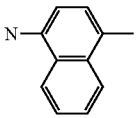 | 1 | CH═CH | H | —$CH_3$ | 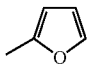 |
| 146 | 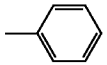 | 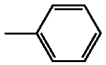 | H | 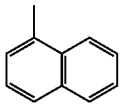 | 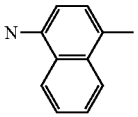 | 1 | CH═CH | H | H | 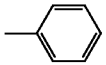 |
| 147 | 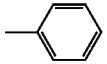 | 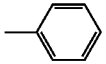 | H | 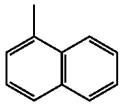 | 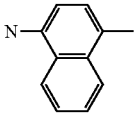 | 1 | CH═CH | H | —$CH_3$ | 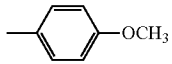 |

TABLE 22
| Compound No. | $Ar^1$ | $Ar^2$ | $R^1$ | $Ar^3$ | 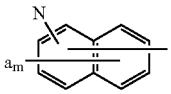 | n | $-(CR^2{=}CR^3)_n-$ | $R^4$ | $Ar^4$ | $Ar^5$ |
|---|---|---|---|---|---|---|---|---|---|---|
| 148 | 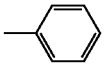 | 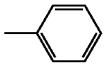 | H | 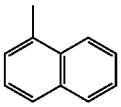 | 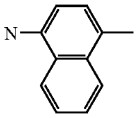 | 1 | CH═CH | H | H | 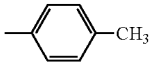 |
| 149 | 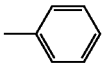 | 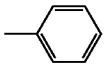 | H | 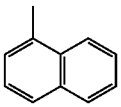 | 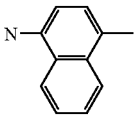 | 1 | CH═CH | H | $-CH_3$ | 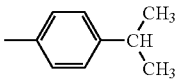 |
| 150 | 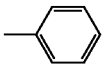 | 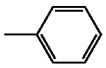 | H | 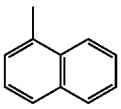 | 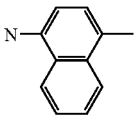 | 1 | CH═CH | H | H | 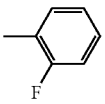 |
| 151 | 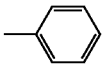 | 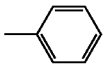 | H | 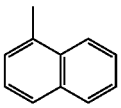 | 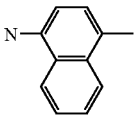 | 1 | CH═CH | H | $-CH_3$ | 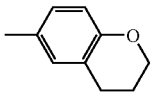 |
| 152 | 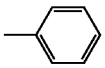 | 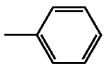 | H | 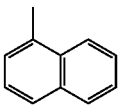 | 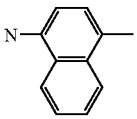 | 1 | CH═CH | H | $-CH_3$ | 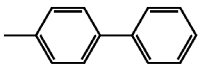 |
| 153 | 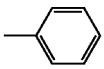 | 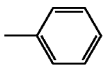 | H | 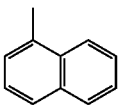 | 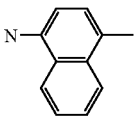 | 1 | CH═CH | H | $-CH_3$ | 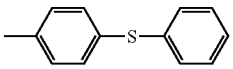 |
| 154 | 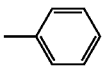 | 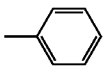 | H | 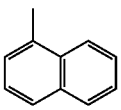 | 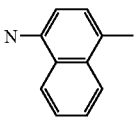 | 1 | CH═CH | H | H | 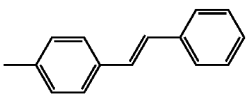 |
TABLE 23
| Compound No. | $Ar^1$ | $Ar^2$ | $R^1$ | $Ar^3$ | 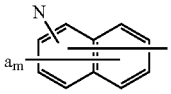 | n | $-(CR^2{=}CR^3)_n-$ | $R^4$ | $Ar^4$ | $Ar^5$ |
|---|---|---|---|---|---|---|---|---|---|---|
| 155 | 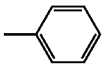 | 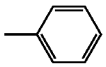 | H | 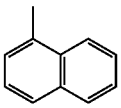 | 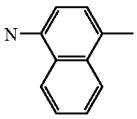 | 1 | CH═CH | H | $-CH_3$ | 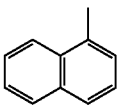 |
| 156 | 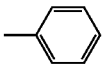 | 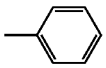 | H | 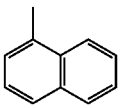 | 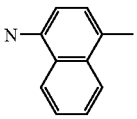 | 1 | CH═CH | H | $-CH_3$ | 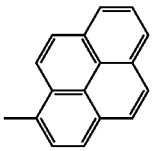 |
| 157 | 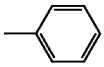 | 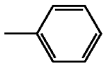 | H | 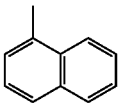 | 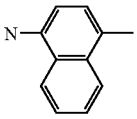 | 1 | CH═CH | H | $-CH_3$ | 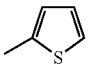 |

TABLE 23-continued

| Compound No. | $Ar^1$ | $Ar^2$ | $R^1$ | $Ar^3$ | $a_m$ | n | $-(CR^2=CR^3)_n-$ | $R^4$ | $Ar^4$ | $Ar^5$ |
|---|---|---|---|---|---|---|---|---|---|---|
| 158 | | | H | | | 1 | CH=CH | H | H | |
| 159 | | | H | | | 1 | CH=CH | H | | |
| 160 | | | H | | | 1 | CH=CH | H | $CH_3$ | $CH_3$ |
| 161 | | | H | | | 1 | CH=CH | H | | |

TABLE 24

| Compound No. | $Ar^1$ | $Ar^2$ | $R^1$ | $Ar^3$ | $a_m$ | n | $-(CR^2=CR^3)_n-$ | $R^4$ | $Ar^4$ | $Ar^5$ |
|---|---|---|---|---|---|---|---|---|---|---|
| 162 | | | H | | | 1 | CH=CH | H | | |
| 163 | | | H | | | 1 | CH=CH | H | | |
| 164 | | | H | | | 1 | CH=CH | H | | |
| 165 | | | H | | | 2 | CH=CH—CH=CH | H | H | |
| 166 | | | H | | | 2 | CH=CH—CH=CH | H | $-CH_3$ | $OCH_3$ |
| 167 | | | H | | | 2 | CH=CH—CH=CH | H | $-CH_3$ | |

TABLE 24-continued
| Compound No. | $Ar^1$ | $Ar^2$ | $R^1$ | $Ar^3$ | 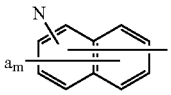 | n | $-(CR^2{=}CR^3)_n-$ | $R^4$ | $Ar^4$ | $Ar^5$ |
|---|---|---|---|---|---|---|---|---|---|---|
| 168 | 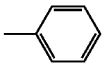 | 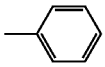 | H | 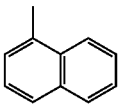 | 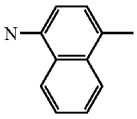 | 3 | $-(HC{=}CH)_3-$ | H | H | 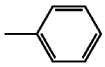 |
TABLE 25
| Compound No. | $Ar^1$ | $Ar^2$ | $R^1$ | $Ar^3$ | 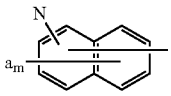 | n | $-(CR^2{=}CR^3)_n-$ | $R^4$ | $Ar^4$ | $Ar^5$ |
|---|---|---|---|---|---|---|---|---|---|---|
| 169 | 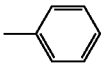 | 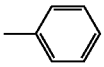 | H | 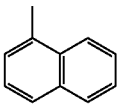 | 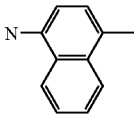 | 1 | CH═CH | H | H | 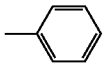 |
| 170 | 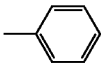 | 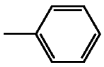 | H | 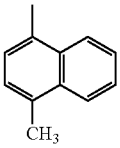 | 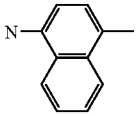 | 1 | CH═CH | H | H | 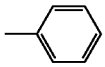 |
| 171 | 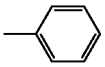 | 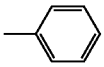 | H | 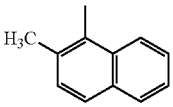 | 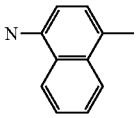 | 1 | CH═CH | H | H | 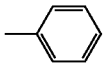 |
| 172 | 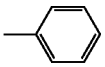 | 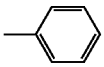 | H | 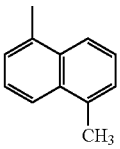 | 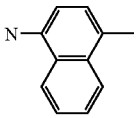 | 1 | CH═CH | H | H | 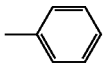 |
| 173 | 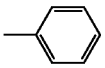 | 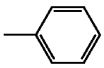 | H | 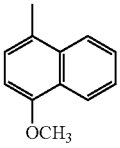 | 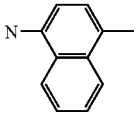 | 1 | CH═CH | H | H | 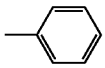 |
| 174 | 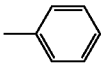 | 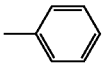 | H | 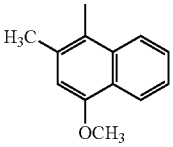 | 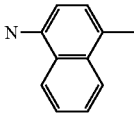 | 1 | CH═CH | H | H | 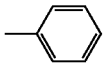 |
| 175 | 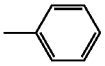 | 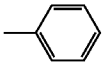 | H | 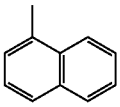 | 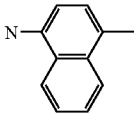 | 1 | CH═CH | H | H | 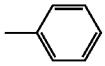 |

TABLE 26
| Compound No. | $Ar^1$ | $Ar^2$ | $R^1$ | $Ar^3$ | 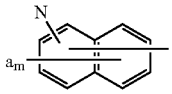 | n | $-(CR^2{=}CR^3)_n-$ | $R^4$ | $Ar^4$ | $Ar^5$ |
|---|---|---|---|---|---|---|---|---|---|---|
| 176 | 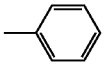 | 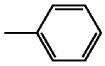 | H | 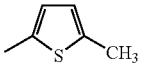 | 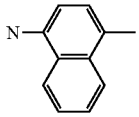 | 1 | CH=CH | H | H | 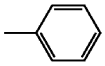 |
| 177 | 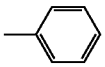 | 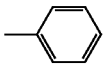 | H | 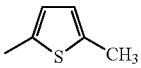 | 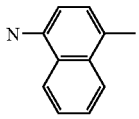 | 1 | CH=CH | H | H | 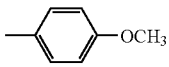 |
| 178 | 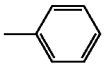 | 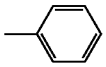 | H | 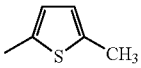 | 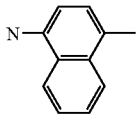 | 1 | CH=CH | H | 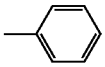 | 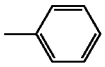 |
| 179 | 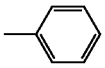 | 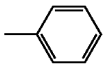 | H | 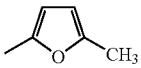 | 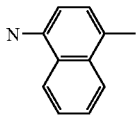 | 1 | CH=CH | H | H | 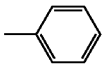 |
| 180 | 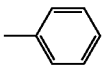 | 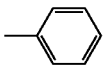 | H | 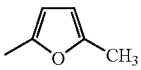 | 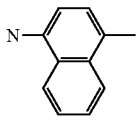 | 1 | CH=CH | H | $-CH_3$ | 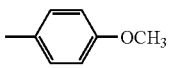 |
| 181 | 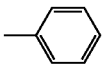 | 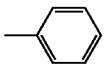 | H | 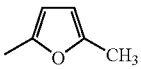 | 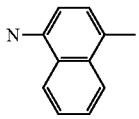 | 1 | CH=CH | H | 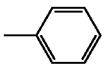 | 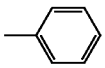 |
| 182 | 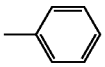 | 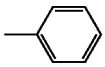 | H | 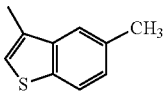 | 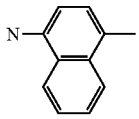 | 1 | CH=CH | H | H | 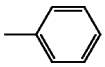 |

TABLE 27
| Compound No. | $Ar^1$ | $Ar^2$ | $R^1$ | $Ar^3$ | 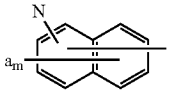 | n | $-(CR^2{=}CR^3)-_n$ | $R^4$ | $Ar^4$ | $Ar^5$ |
|---|---|---|---|---|---|---|---|---|---|---|
| 183 | 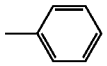 | 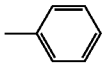 | H | 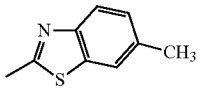 | 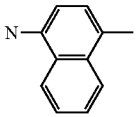 | 1 | CH═CH | H | —$CH_3$ | 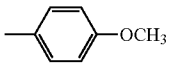 |
| 184 | 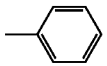 | 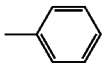 | H | 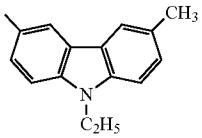 | 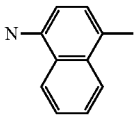 | 1 | CH═CH | H | 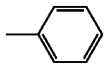 | 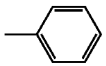 |
| 185 | 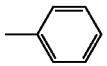 | 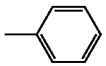 | H | 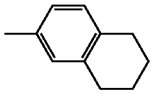 | 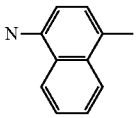 | 1 | CH═CH | H | H | 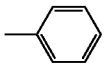 |
| 186 | 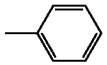 | 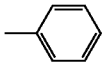 | H | 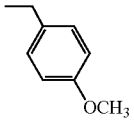 | 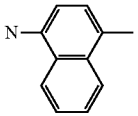 | 1 | CH═CH | H | H | 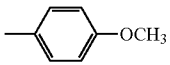 |
| 187 | 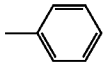 | 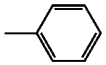 | H | 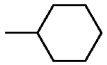 | 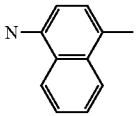 | 1 | CH═CH | H | 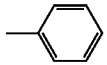 | 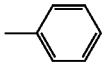 |
| 188 | 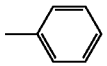 | 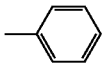 | H | 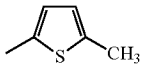 | 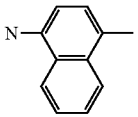 | 0 | — | H | H | 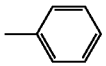 |
| 189 | 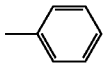 | 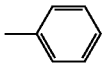 | H | 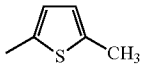 | 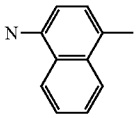 | 0 | — | H | H | 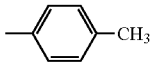 |

TABLE 28
| Compound No. | $Ar^1$ | $Ar^2$ | $R^1$ | $Ar^3$ | 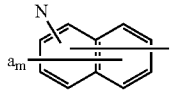 | n | $-(CR^2=CR^3)_n-$ | $R^4$ | $Ar^4$ | $Ar^5$ |
|---|---|---|---|---|---|---|---|---|---|---|
| 190 | 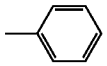 | 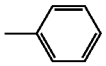 | H | 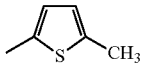 | 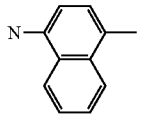 | 0 | — | H | H | 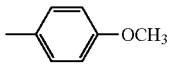 |
| 191 | 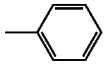 | 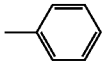 | H | 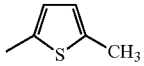 | 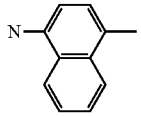 | 0 | — | H | H | 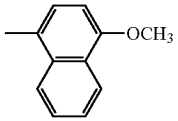 |
| 192 | 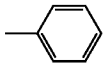 | 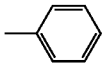 | H | 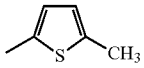 | 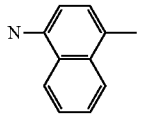 | 0 | — | H | H | 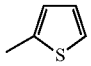 |
| 193 | 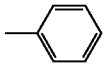 | 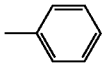 | H | 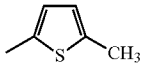 | 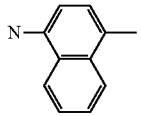 | 0 | — | H | H | 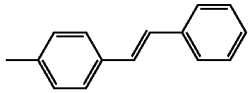 |
| 194 | 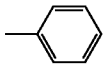 | 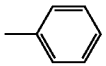 | H | 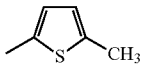 | 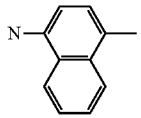 | 0 | — | H | 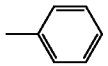 | 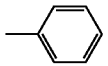 |
| 195 | 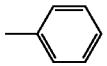 | 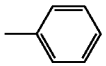 | H | 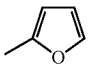 | 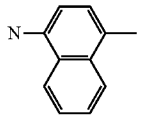 | 0 | — | H | H | 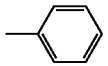 |
| 196 | 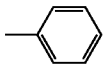 | 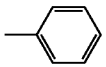 | H | 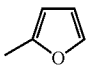 | 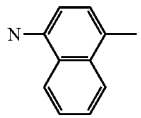 | 0 | — | H | H | 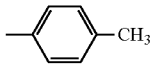 |

TABLE 29
| Compound No. | $Ar^1$ | $Ar^2$ | $R^1$ | $Ar^3$ | $a_m$ | n | $-(CR^2=CR^3)_n-$ | $R^4$ | $Ar^4$ | $Ar^5$ |
|---|---|---|---|---|---|---|---|---|---|---|
| 197 | 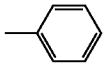 | 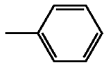 | H | 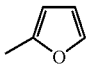 | 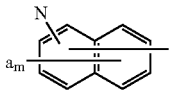 | 0 | — | H | H | 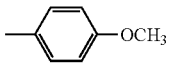 |
| 198 | 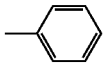 | 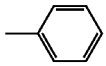 | H | 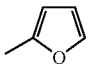 | 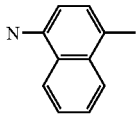 | 0 | — | H | H | 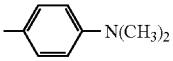 |
| 199 | 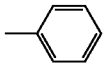 | 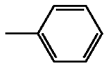 | H | 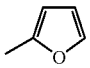 | 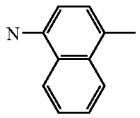 | 0 | — | H | H | 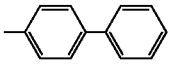 |
| 200 | 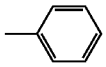 | 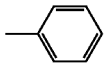 | H | 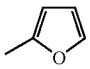 | 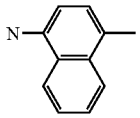 | 0 | — | H | H | 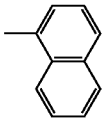 |
| 201 | 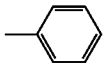 | 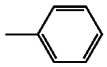 | H | 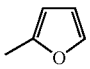 | 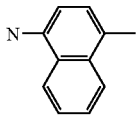 | 0 | — | H | 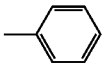 | 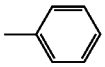 |
| 202 | 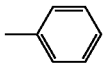 | 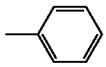 | H | 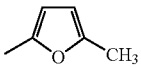 | 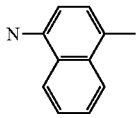 | 0 | — | H | H | 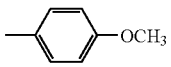 |
| 203 | 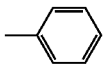 | 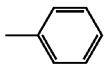 | H | 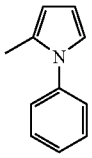 | 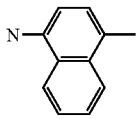 | 0 | — | H | H | 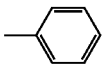 |

TABLE 30
| Compound No. | $Ar^1$ | $Ar^2$ | $R^1$ | $Ar^3$ | 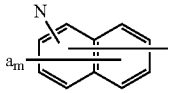 | n | $-(CR^2{=}CR^3)-_n$ | $R^4$ | $Ar^4$ | $Ar^5$ |
|---|---|---|---|---|---|---|---|---|---|---|
| 204 | 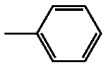 | 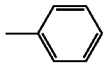 | H | 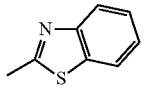 | 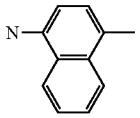 | 0 | — | H | H | 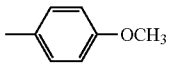 |
| 205 | 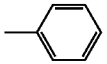 | 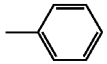 | H | 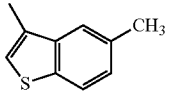 | 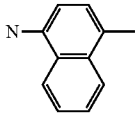 | 0 | — | H | 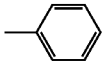 | 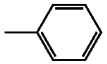 |
| 206 | 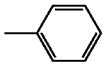 | 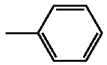 | H | 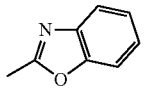 | 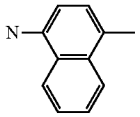 | 0 | — | H | H | 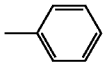 |
| 207 | 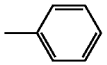 | 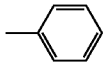 | H | 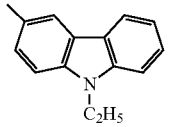 | 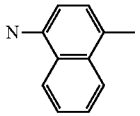 | 0 | — | H | H | 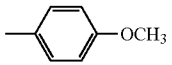 |
| 208 | 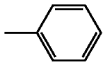 | 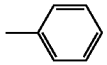 | H | 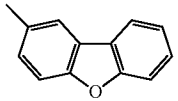 | 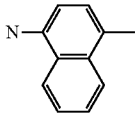 | 0 | — | H | 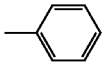 | 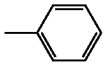 |
| 209 | 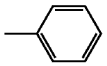 | 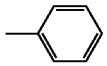 | $CH_3$ | 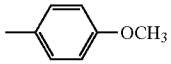 | 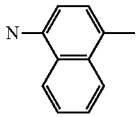 | 1 | CH═CH | H | H | 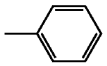 |
| 210 | 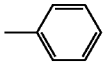 | 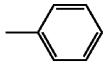 | $CH_2CF_3$ | 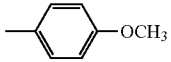 | 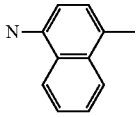 | 1 | CH═CH | H | H | 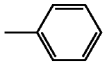 |

TABLE 31
| Compound No. | $Ar^1$ | $Ar^2$ | $R^1$ | $Ar^3$ | 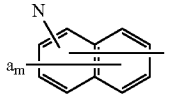 | n | $-(CR^2{=}CR^3)_n-$ | $R^4$ | $Ar^4$ | $Ar^5$ |
|---|---|---|---|---|---|---|---|---|---|---|
| 211 | 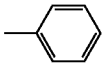 | 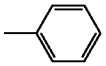 | $CH(CH_3)_2$ | 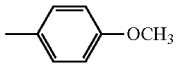 | 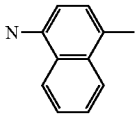 | 1 | CH═CH | H | H | 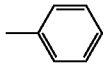 |
| 212 | 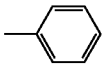 | 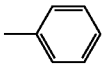 | F | 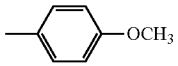 | 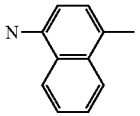 | 1 | CH═CH | H | H | 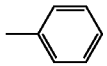 |
| 213 | 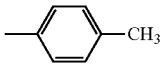 | 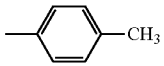 | H | 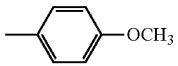 | 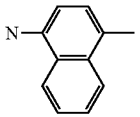 | 1 | CH═CH | H | H | 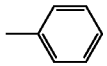 |
| 214 | 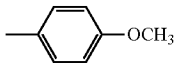 | 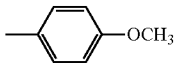 | H | 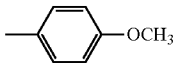 | 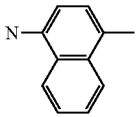 | 1 | CH═CH | H | H | 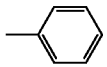 |
| 215 | 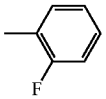 | 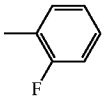 | H | 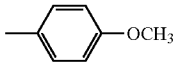 | 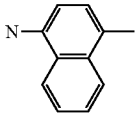 | 1 | CH═CH | H | H | 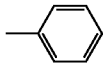 |
| 216 | 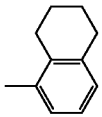 | 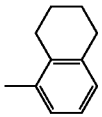 | H | 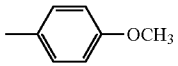 | 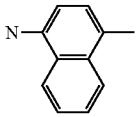 | 1 | CH═CH | H | H | 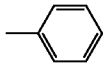 |
| 217 | 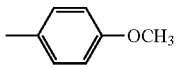 | 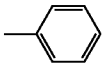 | H | 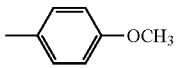 | 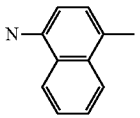 | 1 | CH═CH | H | H | 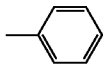 |

TABLE 32

| Compound No. | $Ar^1$ | $Ar^2$ | $R^1$ | $Ar^3$ | | n | $-(CR^2=CR^3)_n-$ | $R^4$ | $Ar^4$ | $Ar^5$ |
|---|---|---|---|---|---|---|---|---|---|---|
| 218 | 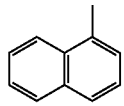 | 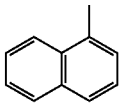 | H | 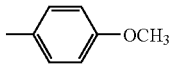 | 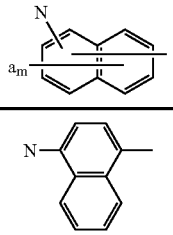 | 1 | CH=CH | H | H | 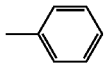 |
| 219 | 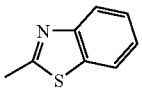 | 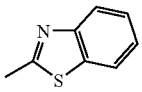 | H | 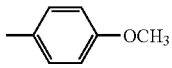 | 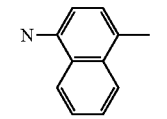 | 1 | CH=CH | H | H | 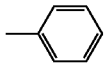 |
| 220 | 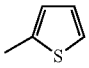 | 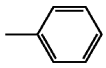 | H | 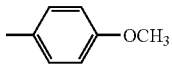 | 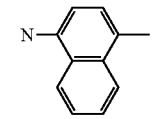 | 1 | CH=CH | H | H | 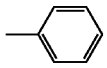 |

The enamine compound represented by the general formula (1) can be produced, for example, as described below. At first, an aldehyde compound or a ketone compound represented by the general formula (3) and a secondary amine compound represented by the following general formula (4) are put to dehydration condensing reaction thereby producing an enamine intermediate product represented by the following general formula (5).

(3)

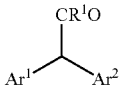

wherein $Ar^1$, $Ar^2$ and $R^1$ are the same as defined in formula (1).

(4)

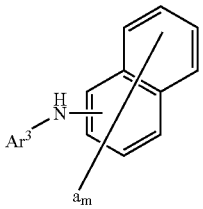

wherein $Ar^3$, a and m are the same as defined in formula (1).

(5)

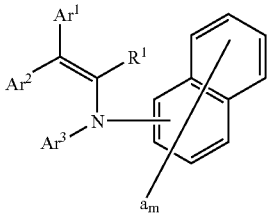

wherein $Ar^1$, $Ar^2$, $Ar^3$, $R^1$, a and m are the same as defined in formula (1).

The dehydration condensing reaction is conducted, for example, as described below. An aldehyde compound or a ketone compound represented by the general formula (3) and a secondary amine compound represented by the general formula (4) are added each substantially in an equimolar amount to an appropriate solvent and dissolved to prepare a solution. The solvent used can include, for example, aromatic hydrocarbons such as toluene, xylene and chlorobenzene, alcohols such as butanol and ethers such as diethylene glycol dimethyl ether. A catalyst, for example, an acid catalyst such as p-toluene sulfonic acid, camphor sulfonic acid or pyridinium-p-toluene sulfonic acid is added to the prepared solution and reaction is conducted under heating. The amount of the catalyst to be added is preferably in a ratio by molar equivalent of from 1/10 to 1/1000 to the amount of the aldehyde or ketone compound of formula represented by formula (3), more preferably from 1/25 to 1/500, further more preferably from 1/50 to 1/200. During the reaction, water is formed and it interferes with the reaction. Therefore, the water formed is removed out of the system through azeotropic evaporation with the solvent used. As described above, the enamine intermediate product represented by the general formula (5) can be produced at a high yield.

The enamine intermediate of formula represented by formula (5) is formylated through Vilsmeier reaction or is acylated through Friedel-Crafts reaction to give an enamine-carbonyl intermediate of the following general formula (6). The formylation through Vilsmeier reaction gives an enamine-aldehyde intermediate, a type of enamine-carbonyl intermediate of formula represented by formula (6) where $R^5$ is a hydrogen atom; and the acylation through Friedel-Crafts reaction gives an enamine-keto intermediate, a type of enamine-carbonyl intermediate of formula represented by formula (6) where $R^5$ is a group except hydrogen atom.

(6)

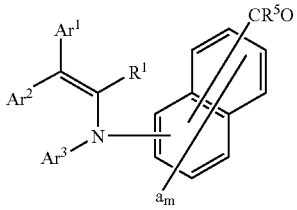

wherein $R^5$ is $R^4$ when n in formula (1) is 0, but is $R^2$ when n is 1, 2 or 3; and $Ar^1$, $Ar^2$, $Ar^3$, $R^1$, $R^2$, $R^4$ a, m and n are the same as defined in formula (1).

The Vilsmeier reaction is effected, for example, as follows: Phosphorus oxychloride and N,N-dimethylformamide (DMF), or phosphorus oxychloride and N-methyl-N-phenylformamide, or phosphorus oxychloride and N,N-diphenylformamide are added to an appropriate to prepare a Vilsmeier reagent. The solvent to be used can include an aprotic polar solvent such as N,N-dimethylformamide and a halogenated hydrocarbon such as 1,2-dichloroethane. 1.0 equivalent of an enamine intermediate represented by formula (5) is added to from 1.0 to 1.3 equivalents of the thus-prepared Vilsmeier reagent, and stirred for 2 to 8 hours under heat at 60 to 110° C. After finishing the reaction, this is hydrolyzed with 1 to 8 N aqueous alkaline solution. The aqueous alkaline solution to be used can include an aqueous sodium hydroxide and a potassium hydroxide solution. This gives an enamine-aldehyde intermediate, a type of enamine-carbonyl intermediate represented by formula (6) where $R^5$ is a hydrogen atom, at high yield.

Further, the Friedel-Crafts reaction is conducted, for example, as described below, from 1.0 to 1.2 equimolar amount of Lewis acid and 1.0 equimolar amount of an acyl halide represented by the following general formula (B) are added in an appropriate solvent and stirred for about 0.5 to 1 hour to prepare a Friedel-Crafts acylating reagent. The solvent to be used includes, for example, a halogenated hydrocarbons such as 1,2-dichloroethane and dichloromethane and aromatic hydrocarbons such as nitrobenzene. The Lewis acid includes, for example, aluminum chloride, tin chloride and zinc chloride.

(B)

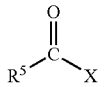

wherein x represents a halogen atom; and $R^5$ has the same meanings as those defined in formula (6).

1.0 equimolar amount of the enamine intermediate product represented by the general formula (5) is added in a solution in which 1.0 to 1.3 equimolar amount of the Friedel-Crafts acylating reagent is prepared and stirred at −40 to 80° C. for 2 to 8 hours. After the completion of the reaction, hydrolysis is conducted in 1 to 8 N aqueous alkaline solution. The aqueous alkaline solution used for the hydrolysis includes, for example, an aqueous solution of sodium hydroxide and an aqueous solution of potassium hydroxide. As described above, among the enamine-carbonyl intermediate products represented by the general formula (6), an enamine-keto intermediate product in which $R^5$ represents a group other than the hydrogen atom can be produced at a high yield.

Then, an enamine compound represented by the general formula (1) is produced by conducting a Wittig-Horner reaction of reacting the enamine-carbonyl intermediate product represented by the general formula (6) and a Wittig reagent represented by the following general formula (7-1) or a Wittig reagent represented by the general formula (7-2) under a basic condition. In this case, when the Wittig reagent used by the general formula (7-1) is used, the enamine compound represented by the general formula (1) in which n=0 can be obtained. When the Wittig reagent represented by the general formula (7-2) is used, the enamine compound represented by general formula (1) in which n is 1, 2, or 3 can be obtained.

(7-1)

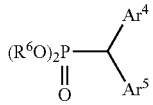

wherein $R^6$ represents an optionally-substituted alkyl group or an optionally-substituted aryl group; and $Ar^4$ and $Ar^5$ have the same meanings as those defined in formula (1).

(7-2)

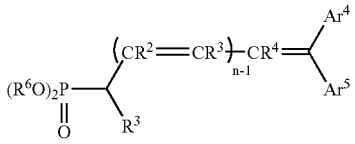

wherein $R^6$ represents an optionally-substituted alkyl group or an optionally-substituted aryl group; and $Ar^4$, $Ar^5$, $R^2$, $R^3$ and $R^4$ have the same meanings as those defined in formula (1).

The Wittig-Horner reaction is conducted, for example, as described below. 1.0 equimolar amount of the enamine-carbonyl intermediate product represented by the general formula (6), 1.0 to 1.20 equimolar amount of the Wittig reagent represented by the general formula (7-1) or the Wittig reagent represented by the general formula (7-2) and 1.0 to 1.5 equimolar amount of a metal alkoxide base are added in an appropriate solvent and stirred for 2 to 8 hours under a room temperature or under heating at 30 to 60° C. The solvent used includes, for example, aromatic hydrocarbons such as toluene and xylene, ethers such as diethyl ether, tetrahydrofuran (THF), and ethylene glycol dimethyl ether, and aprotic polar solvents such as N,N-dimethylformamide and dimethylsulfoxide. The metal alkoxide base includes, for example, potassium t-butoxide, sodium ethoxide and sodium methoxide. As described above, the enamine compound represented by the general formula (1) can be produced at a high yield. The enamine compound represented by the general formula (1) can be easily isolated and purified from the reaction mixture by usual separation means, for example, solvent extraction, recrystallization or by column chromatography and obtained as high purity products.

As the enamine compound represented by the general formula (1), for example, one or more of materials selected from the group consisting of the exemplified compounds shown in Table 1 to Table 32 is used with the charge transportation substance alone or as a mixture.

Other than the enamine compound represented by the general formula (1), the charge transportation substance may include other charge transportation substance within the range which the preferable effect of the invention is not deteriorated. Other charge transportation substance to be used in admixture with the enamine compound represented by the general formula (1) can include, for example, carbazole derivatives, oxazole derivatives, oxadiazole derivatives, thiazole derivatives, thiadiazole derivatives, triazole derivatives, imidazole derivatives, imidazolone compound, imidazolidine derivatives, bisimidazolidine derivatives, styryl derivatives, hydrazone compound, polycyclic aromatic compound, indole derivatives, pyrazoline derivatives, oxazolone derivatives, benzimidazole derivatives, quinazoline derivatives, benzofuran derivatives, acrydine derivatives, phenadine derivatives, aminostylbene derivatives, triarylamine derivatives, triarylmethane derivatives, phenylene diamine derivatives, stylbene derivatives and benzidine derivatives. In addition, a polymer having a group generated from those compounds in a main chain or a side chain, for example, poly(N-vinyl carbazole), poly(1-vinylpyrene) and poly(9-vinylanthracene) and the like are included.

For the binder resin constituting charge transportation layer 5, those having excellent compatibility with the charge transportation substance are selected. Specific examples of them can include, for example, a vinyl polymer resin such as polymethyl methacrylate resin, polystyrene resin or polyvinyl chloride resin, and a copolymer resin containing two or more repetitive units constituting them, and polycarbonate resin, polyester resin, polyester carbonate resin, polysulfone resin, phenoxy resin, epoxy resin, silicone resin, polyacrylate resin, polyamide resin, polyether resin, polyurethane resin and polyacrylamide resin and phenol resin. In addition, they can include thermosetting resins formed by partially crosslinking the resins. The resins may be used alone or two or more of them may be used as a mixture. Among the resins described above, polystyrene resins, polycarbonate resins, polyacrylate resins or polyphenyl oxides are used suitably, since they have a volumic resistivity of $10^{13}$ Ω·cm or more, and they are excellent in electric insulation property, and also excellent in the film-forming property and potential characteristics.

In the charge transportation layer 5, a ratio A/B between the weight A of the enamine compound represented by the general formula (1) contained as a charge transportation substance and the weight B of the binder resin is preferably 10/30 or more and 10/12 or less. By determining the ratio A/B to 10/30 or more and 10/12 or less and incorporating the binder resin at a high ratio in the charge transportation layer 5, the abrasion resistance of the charge transportation layer 5 can be improved to improve the durability of the photoconductor 2.

When the ratio A/B is defined as 10/12 or less to increase the ratio of the binder resin as described above, the ratio of the enamine compound represented by the general formula (1) contained as the charge transportation substance is decreased as a result. In a case of using the charge transportation substance known so far, when the ratio between the weight for the charge transportation substance and the weight for the binder resin in the charge transportation layer 5 (charge transportation substance/binder resin) is defined to 10/12 or less in the same manner, the sensitivity and the light responsivity become insufficient to sometimes result in image defects. However, since the enamine compound represented by the general formula (1) has a high charge mobility, even in a case where the ratio A/B is defined to 10/12 or less to increase the ratio of the binder resin in the charge transportation layer 5, the photoconductor 2 shows sufficiently high sensitivity and light responsivity. That is, since the ratio A/B can be 10/30 or more and 10/12 or less without lowering the sensitivity and the light responsivity, it is possible to attain a photoconductor 2 having high sensitivity and light responsivity and excellent in the mechanical durability. Accordingly, the durability of the image forming apparatus 1 can be improved without degrading the quality and the resolution of the images.

In a case where the ratio A/B exceeds 10/12, that is, the ratio of the binder resin is low, the printing resistance of the charge transportation layer 5 is degraded to increase the amount of film reduction of the photosensitive layer 6 to lower the chargeability of the photoconductor 2. In a case where the ratio A/B is less than 10/30, that is, the ratio of the binder resin is high, the sensitivity of the photoconductor 2 is lowered. Further, in a case of forming the charge transportation layer 5 by a dip coating method, since the viscosity of the coating solution is increased to lower the coating speed, the productivity is worsened remarkably. Further, when the amount of the solvent in the coating solution is increased in order to suppress the increase of the viscosity of the coating solution, a brushing phenomenon occurs to cause clouding in the formed charge transportation layer 5. Accordingly, a preferred range for the ratio A/B is defined as 10/30 or more and 10/12 or less.

Various additives may also be added optionally to the charge transportation layer 5. For example, a plasticizer or leveling agent may also be added to the charge transportation layer 5 in order to improve the film forming property, flexibility or surface smoothness. The plasticizer can include, for example, a dibasic acid ester such as phthalic acid ester, fatty acid ester, phosphoric acid ester, chlorinated paraffin and epoxy type plasticizer. The leveling agent can include, for example, a silicone type leveling agent.

Further, fine particles of inorganic compounds or organic compounds may also be added to the charge transportation layer 5 in order to enhance the mechanical strength and improve the electric characteristics.

The charge transportation layer 5 is formed in the same manner as in the case of forming the charge generation layer 4 by coating, for example, dissolving or dispersing the charge transportation substance containing the enamine compound represented by the general formula (1) and a binder resin and, optionally, the additives described above in an appropriate solvent to prepare a coating solution for the charge transportation layer and coating the resultant coating solution on the charge generation layer 4.

The solvent for the coating solution for the charge transportation layer can include, for example, aromatic hydrocarbons such as benzene, toluene, xylene and monochlorobenzene, halogenated hydrocarbon such as dichloromethane and dichloroethane, ethers such as tetrahydfofuran, dioxane and dimethoxymethyl ether, as well as aprotic polar solvents such as N,N-dimethylformamide. The solvents may be used each alone or two or more of them may be used in admixture. Further, the solvents described above may also be used with a further addition of alcohols or acetonitrile or methyl ethyl ketone optionally.

The coating method of the coating solution for the charge transportation layer can include, for example, a spray method, a bar coat method, a roll coat method, a blade method, a wring method and a dip coating method. Among the coating methods, since the dip coating method is particularly excellent in various points as described above, it is used suitably also in a case of forming the charge transportation layer 5.

The film thickness of the charge transportation layer 5 is, preferably, from 5 μm or more and 50 μm or less and, more preferably, from 10 μm or more and 40 μm or less. In a case where the film thickness of the charge transportation layer 5 is less than 5 μm, the charge retainability on the surface of the photoconductor 2 is lowered. In a case where the film thickness of the charge transportation layer 5 exceeds 50 μm, the resolution of the photoconductor 2 is lowered. Accordingly, a preferred range for the film thickness of the charge transportation layer 5 is defined as 5 μm or more and 50 μm or less.

The charge generation layer 4 and the charge transportation layer 5 formed as described above are laminated to constitute a photosensitive layer 6. By sharing the charge generation function and the charge transportation function on separate layers respectively, since a material optimal to each of the charge generation function and the charge transportation function can be selected as the material for constituting the respective layers, a photoconductor 2 of particularly high sensitivity and light responsivity and of high electric durability also with increased stability in repetitive use can be attained. Accordingly, the image forming apparatus 1 can form images of particularly high quality and resolution and also has high durability.

In this embodiment, while the photosensitive layer 6 is constituted by laminating the charge generation layer 4 and the charge transportation layer 5 in this order on the conductive support 3, this is not limitative but the charge transportation layer 5 and the charge generation layer 4 may be laminated in this order on the conductive support 3 for constituting the photosensitive layer.

For each layer of the photosensitive layer 6, namely, the charge generation layer 4 and the charge transportation layer 5, one or more electron accepting substances and sensitizers such as dyes may be added in order to improve the sensitivity suppress the increase of the residual potential and fatigues due to repetitive use.

As the electron accepting substance, for example, acid anhydrides such as succinic acid anhydride, maleic acid anhydride, phthalic acid anhydride and 4-chloronaphthalic acid anhydride, etc., cyano compounds such as tetracyano ethylene, terephthal malone dinitrile, aldehydes such as 4-nitrobenzaldehyde, etc., anthraquinones such as anthraquinone and 1-nitroanthraquinone, polycyclic or heterocyclic nitro compounds such as 2,4,7-trinitrofluolenone, 2,4,5,7-tetranitrofluolenone, etc. or electron attracting materials such as diphenoquinone compounds can also be used. In addition, those electron attracting materials, which are polymerized, can also be used.

As the dye, organic photoconductive compounds such as xanthene dyes, thiazine dyes, triphenylmethane dyes, quinoline dyes or copper phthalocyanine can be used. The organic photoconductive compounds function as optical sensitizers.

In addition, an antioxidant or an ultraviolet absorber may be added to each layer of 4 and 5 of the photosensitive layer 6. Particularly, it is preferred to add an antioxidant or an ultraviolet absorber to the charge transportation layer 5. This can improve the potential characteristics. Further, stability of the coating liquid upon forming each of the layers by coating can be enhanced. In addition, fatigue of the photoconductor 2 due to repetitive use can be moderated to improve the durability.

As the antioxidant, phenol compounds, hydroquinone compounds, tocopherol compounds or amine compounds are used. Among them, hindered phenol derivatives or hindered amine derivatives or mixtures thereof are preferably used. The antioxidant is preferably used within the range of from 0.1 parts by weight or more to 50 parts by weight or less based on 100 parts by weight of the charge transportation substance. In a case where the amount of the charge transportation substance is less than 0.1 parts by weight based on 100 parts by weight of the charge transportation substance, no sufficient effects can be obtained for improving the stability of the coating liquid and improving the durability of the photoconductor. In a case where it is more than 50 parts by weight, this gives undesired effects on the characteristics of the photoconductor. Accordingly, the preferred range for the amount of the antioxidant to be used is determined as 0.1 parts by weight or more and 50 parts by weight or less based on 100 parts by weight of the charge transportation substance.

Then, referring again to FIG. 1 and FIG. 2, the constitution of the image forming apparatus 1 equipped with the photoconductor 2 is to be described. The image forming apparatus 1 exemplified as this embodiment is a digital copying machine 1.

The digital copying machine 1 has a constitution including a scanner section 11, an image processing section not illustrated, a laser recording section 12, a scanner section 11, and a control section not illustrated for controlling the operation of each of the sections in the apparatus such as the image processing section and the laser recording section 12. The scanner section 11 includes a document mounting table 13 comprising a light permeable material, for example, transparent glass, a both face automatic document feeder for automatically feeding and transporting originals onto the document mounting table 13 (Reversing Automatic Document Feeder abbreviated as RADF) 14 and a scanner unit 15 for reading image information from original images by scanning a light over original images placed on the document mounting table 13. Image information of original images read by the scanner section 11 is sent to the image processing section and applied with a predetermined image processing. RADF 14 is a device for setting plural documents collectively in a not illustrated document tray equipped in RADF 14 and feeding the set documents one by one automatically onto the document mounting table 13. Further, RADF 14 is constituted including a transportation path for one side documents, a transportation path for both side documents, transportation path switching means and a group of sensors for recognizing and controlling the state of documents that pass through each of the sections to have the scanner unit 15 read one side or both sides of documents in accordance with selection by an operator.

The scanner unit 15 comprises a lamp reflector assembly 16 for exposing the surface of originals, a first scanning unit 18 that mounts a first reflection mirror 17 for reflecting a reflection light from originals to introduce reflection light images from the originals to a photoelectronic conversion device (Charge Coupled Device; abbreviated as CCD) 23, a second scanning unit 21 that mounts a second reflection mirror 19 and a third reflection mirror 20 for introducing reflection light images from the first reflection mirror 17 to CCD 23, an optical lens 22 for focusing the reflection light images from the originals by way of each of the reflection mirrors 17, 19, 20 to CCD 23 and CCD 23 for converting reflection light images from the originals focused by the optical lens 22 into electric image signals.

The scanner section 11 is adapted to responsivity feed and mount originals to be read to the document mounting table 13 by the operation associated with RADF 14 and the scanner unit 15, and move the scanner unit 15 along the lower surface of the document mounting table 13 for reading original images. The first scanning unit 18 is scanned at a constant speed V in the reading direction of original images (from left to right relative to the drawing in FIG. 1) along the document mounting table 13. Further, the second scanning unit 21 is scanned relative to the first scanning unit 18 in parallel in the direction identical therewith at one-half of the scanning speed V (V/2). By the operation of the first scanning unit 18 and the second scanning unit 21, reflection light images from the original images placed on the document mounting table 13 are focused on every one line to the CCD 23 successively and images can be read.

The image information obtained by reading the original images by the scanner unit 15 is sent to the image processing section, applied with various kinds of image processings and then once stored in the memory of the image processing section. The image processing section reads out the image information in the memory and transfers the same to the laser recording section 12 in accordance with the output instruction from the control section.

The laser recording section 12 comprises a transportation system 24 for recording paper 51 as a recording medium, a laser writing unit 26, and an electrophotographic processing section 27 for forming images. The laser writing unit 26 is exposure means for forming electrostatic latent images by applying exposure corresponding to the image formation to the charged surface 52 of the photoconductor 2 and comprises a semiconductor laser light source that emits a laser beam light 31 in accordance with the image information read by the scanner unit 15, stored in the memory and then read out of the memory, a polygonal mirror that deflects the laser beam light 31 at an equi-angular velocity, and an f-θ lens that compensates the laser beam light 31 deflected at the equi-angular speed such that it is deflected at equi-angular speed on the photoconductor 2 equipped in the electrophotographic processing section 27.

Then, the constitution of the electrophotographic processing section 27 having the photoconductor 2 is to be described. The electrophotographic processing section 27 comprises the photoconductor 2 described above supported rotationally to the apparatus main body and not illustrated driving means that rotationally drives the photoconductor 2 around a rotational axis 38 in the direction of arrow 37. The driving means comprises, for example, a motor as a power source and rotationally drives the photoconductor 2 at a circumferential rotational speed Vp by transmitting the power from the motor by way of not illustrated gears to the support constituting the core of the photoconductor 2.

At the periphery of the photoconductor 2, are arranged a charger 32 as charging means, a developing device 33 as developing means, a transfer device 34 as transfer means, and a cleaner 36 as cleaning means in this order from the upstream to the downstream in the rotational direction of the photoconductor 2 shown by an arrow 37. The cleaner 36 is disposed together with a not illustrated charge elimination lamp.

The charger 32 is disposed to the upstream in the rotational direction of the photoconductor 2 relative to the focusing point of the laser beam light 31 emitted from the laser writing unit 26 and charges the surface 52 of the photoconductor 2 to a predetermined negative or positive potential uniformly. In this embodiment, the charger 32 is a contact type charging means such as a charging roller.

The developing device 33 is disposed to the downstream in the rotational direction of the photoconductor 2 relative to the focusing point of the laser beam light 31 emitted from the laser writing unit 26 and supplies toners contained in the developer 50 to the surface 52 of the photoconductor 2 thereby developing the electrostatic latent images formed to the surface 52 to form toner images as visible images. The developing device 33 comprises a developing roller 33*a* that is opposed to the photoconductor 2 and supplies toners contained in the developer 50 to the surface 52 of the photoconductor 2, and a casing 33*b* that rotationally supports the developing roller 33*a* around the rotational axis which is in parallel with the rotational axis 38 of the photoconductor 2, and contains the developer 50 containing the toner in the inner space thereof.

For the developer 50, a magnetic or non-magnetic one-component developer or a two-component developer is used. The toner contained in the developer 50 may be supplied to the photoconductor 2 either by a contact or contactless method. In this method, the developer 50 is of the one-component type and comprises toners. The toner as the developer 50 is to be described.

The volume average particle size of the toner is set to a size of from 4 μm to 7 μm with an aim of providing higher quality and higher picture quality of images formed by the image forming apparatus 1. In a case where the volume average particle size of the toner is less than 4 μm, since the toner is less charged, it tends to scatter and cause fogging of images by the scattered toner. Further it also tends to cause cleaning failure. In a case where the volume average particle size of the toner exceeds 7 μm, the quality and the resolution of the images are deteriorated due to the coarseness of the toner particles. Accordingly, the volume average particle size of the toner is defined from 4 μm to 7 μm. More preferably, the volume average particle size of the toner is from 4 μm to 6 μm.

The toner contains a binder resin and a colorant. The binder resin used for the toner includes, for example, polystyrene, styrene-acrylic copolymer, styrene-acrylonitrile copolymer, styrene-maleic acid anhydride copolymer, styrene-acrylic-maleic acid anhydride copolymer, polyvinyl chloride, polyolefin resin, epoxy resin, silicone resin, polyamide resin, polyurethane resin, urethane modified polyester resin, and acrylic resin. The resins may be those having one peak distribution or two peaks distribution for the molecular weight distribution as in a resin composition containing a low molecular ingredient and a high molecular ingredient. A binder resin is not limited to the resins described above but any of thermoplastic resins generally used for the toner may also be used. For the binder resin, the resins described above may be used each alone or two or more of them may be mixed and used as a mixture. Further, the resins described above may also be used as a block polymer or graft polymer.

Further, as the thermal characteristics of the binder resin, the glass transition point Tg is preferably 40° C. or higher and 70° C. or less. A binder resin having a glass transition point Tg of lower than 40° C. is highly liable to be melted to cause cohesion between each of the toners when the temperature in the image forming apparatus 1 rises. Further, a binder resin having a glass transition point Tg of 70° C. or higher is poor in view of the fixing property to the recording medium and not durable to practical use.

As the colorant, carbon black, iron black, alloy azo dye or other various kinds of oil soluble dyes or pigments can be used. The colorant described above is preferably used within a range from 1 to 10 parts by weight based on 100 parts by weight of the binder resin.

The toner may also optionally contains additives such as wax, charge controller or fine inorganic particles in addition to the binder resin and the colorant. As the wax, it is desirable to incorporate at least one member selected from the group consisting of polyolefin type waxes such as polyethylene, polypropylene and ethylene-propylene copolymer by from 1 to 10 parts by weights based on 100 parts by weight of the binder resin.

The charge controllers include two types for positive charge control and negative charge control and, for example, azo dyes, carboxylic acid metal complexes, quaternary ammonium compounds and nigrosine dyes can be used. The charge controller is preferably used within a range from 0.1 to 5 parts by weight based on 100 parts by weight of the binder resin.

The fine inorganic particles may be dispersed in the binder resin or may be added so as to deposit on the surface of toner particles containing the binder resin and the colorant or so as to be buried partially in the toner particles. The fine inorganic particles includes those fine powders such as fine particles of metal oxides, for example, of silica, titanium oxide, alumina, magnetite and ferrite and fine particles of nitrides, for example, of silicon nitride and boron nitride. Further, the fine powders described above treated at the surface thereof with a silane coupling agent such as dimethyl dichlorosilane and aminosilane or a silicone oil, or provided with a fluorine-containing ingredient may also be used. Among the fine inorganic particles, conductive fine inorganic particles such as magnetite and ferrite, particularly, magnetite is used suitably. The fine inorganic particles may be used alone or plural kinds of them may be used in combination.

The toner is produced, for example, as described below. At first, the binder resin and the colorant are mixed sufficiently by a mixer such as a HENSCHEL mixer or a super-mixer. In a case of adding additives such as a charge controller, the additives are also mixed together with the binder resin and the colorant. The obtained mixture is melted and kneaded in a kneader such as a twin-shaft kneader to prepare a kneading product. After pulverizing the obtained kneading product by a crusher such as jet type crusher, it is classified optionally and toner particles controlled to a volume average particle size of from 4 μm to 7 μm can be obtained. In a case of adding the fine inorganic particles to the toner particles, fine inorganic particles are added to the toner particles after pulverization or classification and mixed uniformly by a mixer such as a HENSCHEL mixer or a super-mixer.

In a case where the developer 50 is a two component system, the developer 50 contains a carrier and the toner described above. As the carrier, magnetic particles such as of iron powder, ferrite and magnetite, or non-magnetic fine inorganic particles, etc. are used. In this case, the developer 50 is prepared by adding the carrier to the toner prepared as described above and uniformly mixing them in a mixer such as a HENSCHEL mixer or super-mixer.

The transfer device 34 is transfer means that transfers toner images formed on the surface 52 of the photoconductor 2 to the recording paper 51 as the recording medium from the surface 52 of the photoconductor 2. In this embodiment, the transfer device 34 is, for example, contactless transfer means having charging means such as a corona discharger and providing charges at a polarity opposite to that of the toner to the recording paper 51 thereby transferring toner images to the recording paper 51.

The cleaner 36 is cleaning means for cleaning the surface of the photoconductor 2 after the transfer of the toner images to the recording paper 51 and comprises a cleaning blade 36*a* that is pressed to the surface 52 of the photoconductor and peels the toner remaining on the surface 52 of the photoconductor 2 from the surface 52 after the transfer operation by the transfer device 34, and a recovery casing 36*b* that contains the toner peeled by the cooling blade 36*a*.

The transportation system 24 for the recording paper 51 includes a transportation section 25 that transports the recording paper 51 to the electrophotographic processing section 27 for conducting image formation, particularly, to a transfer position at which the transfer device 34 is disposed, first to third cassette paper feeders 46, 47, 48 for sending the recording paper 51 to the transportation section 25, a manual paper feeder 49 for properly feeding the recording paper 51 of a desired size, a fixing device 35 for fixing the toner images transferred from the photoconductor 2 to the recording paper 51, and a re-feed path 40 for feeding the recording paper 51 again in order to further form images on the rear face of the recording paper 51 after fixing the toner images, that is, on the surface opposite to the surface where the toner images have been formed. A group of transportation rollers 41 is arranged on the transportation path of the transportation system 24, and the recording paper 51 is transported by the transportation rollers 41 to a predetermined position in the transportation system 24. The fixing device 35 comprises a heat roller 35*a* having not illustrated heating means and a press roller 35*b* opposed to the heat roller 35*a* and pressed to the heat roller 35*a* to form an abutting portion.

The image forming operation by the image forming apparatus 1 is to be described. At first, in accordance with the instruction from the control section, the photoconductor 2 is rotataionally driven by the driving means in the direction of the arrow 37 in the electrophotographic processing section 27 of the laser recording section 12, and the surface 52 is charged to a positive or negative predetermined potential by the charger 32. On the other hand, in the scanner section 11, image information of the original images is read by the operation of the first scanning unit 18 and the second scanning unit 21. The image information of the read original images is converted by CCD 23 into electric image signals and outputted to the image processing section. The image information inputted to the image processing section, after applied with various image processings, is once stored in the memory of the image processing section.

Then, in accordance with the output instruction from the control section, the image information stored in the memory of the image processing section is read out and outputted to the laser recording section 12. When the image information is inputted to the laser recording section 12, a laser beam light 31 is irradiated based on the inputted image information from the laser writing unit 26 to the charged surface 52 of the photoconductor 2. The laser writing unit 26 scans the laser beam light 31 based on the image information of the original images in the longitudinal direction of the photoconductor 2 that is the main scanning direction repetitively. By rotationally driving the photoconductor 2 and scanning the laser beam light 31 repetitively based on the image information, exposure corresponding to the image information can be applied to the surface 52 of the photoconductor 2. By the exposure, the surface charges at a portion irradiated with the laser beam light 31 are decreased to produce a difference between the surface potential for the portion irradiated with the laser beam light 31 and the surface potential for the portion not irradiated with the laser beam light 31, to form electrostatic latent images on the surface 52 of the photoconductor 2. Further, in synchronization with exposure to the photoconductor 2, the recording paper 51 is supplied by the transportation system 24 to the transfer position where the transfer device 34 is disposed.

Then, a toner is supplied from the developing roller 33*a* of the developing device 33 to the surface 52 of the photoconductor 2 where electrostatic latent images are formed. This develops the electrostatic latent images and forms toner images as visible images to the surface 52 of the photoconductor 2. Then, charges at a polarity opposite to that of the toner is given by the transfer device 34 to the recording paper 51 supplied to the transfer position, by which the toner images formed to the surface 52 of the photoconductor 2 are transferred to the recording paper 51.

The recording paper 51 transferred with the toner images is transported by the transportation system 24 to the fixing device 35 and heated and pressed upon passing the abutting portion between the heat roller 35*a* and the press roller 35*b* of the fixing device 35. This fixes the toner images on the recording paper 51 to the recording paper 51 to form firm images. The recording paper 51 fixed with the toner images by the fixing device 35 is fed to the re-feed path 40 for forming images at the rear face, or fed to a post processing device 43 by a paper discharge roller 42. For the recording paper 51 fed to the re-feeding path 40, the operation described above is conducted repetitively to form images on the rear face. The recording paper 51 fed to the post processing device 43 is applied with a post treatment and then discharged either to the first paper discharge cassette 44 or the second paper discharge cassette 45 as a destination of paper discharge which is determined depending on the post processing step.

On the other hand, the photoconductor 2 which is further rotated in the direction of the arrow 37 after transfer of the toner images to the recording paper 51 is frictionally rubbed at the surface 52 by the cleaning blade 36*a* equipped to the cleaner 36. This peels the toner remaining on the surface 52 of the photoconductor 2 from the surface 52 after the transfer operation by the transfer device 34 which is collected in the recovery casing 36*b*. The charges on the surface 52 of the photoconductor 2 removed with the toner are eliminated by a charge eliminator, by which the electrostatic latent images on the surface 52 of the photoconductor 2 are eliminated. As described above, a series of image forming operations in the digital copying machine 1 have thus been completed. In a case where images are formed continuously, the photoconductor 2 is further driven rotationally and a series of operations starting from the charging to the photoconductor 2 are repeated.

In this embodiment, the volume average particle size of the toner is set as small as from 4 to 7 μm with a view point of obtaining higher quality and higher resolution of the images as described above. Correspondingly, the beam diameter of the laser beam light 31 emitted from the laser writing unit 26 is set, for example, as small as from 40 to 80 μm. Thus, images at high resolution can be formed. For example, the resolution of 1200 dpi can be attained by setting the beam diameter of the laser beam light 31 from 60 to 80 μm, and a resolution at 2400 dpi can be attained by setting the beam diameter of the laser beam light 31 from 40 to 60 μm.

Further, in view of increasing the image forming speed, the rotational circumferential speed Vp of the photoconductor 2 is set higher. For example, in a case where the diameter of the photoconductor 2 is 30 mm and the length thereof is 340 mm, the electrophotographic process can be conducted at a high speed by setting the rotational circumferential speed Vp of the photoconductor 2 from 100 to 140 mm per seconds, and images can be formed at a rate of 25 sheets of A-4 series paper/min according to JIS P0138.

Since the exposure area per unit hour is decreased when the beam diameter of the laser beam light 31 is set as small as from 40 to 80 μm as described above, the scanning speed of the laser beam light 31 is set high such that it can cope with the rotational circumferential speed Vp of the photoconductor 2. Since the irradiation time per unit area of the laser beam light 31 is shortened when the scanning speed of the laser beam light 31 is set high as described above, the amount of laser light irradiated per one dot on the surface 52 of the photoconductor 2 is decreased. However, since the photoconductor 2 is excellent in the sensitivity and the light responsivity and the decaying speed for the surface potential of the photosensitive layer 6 by exposure is high as described above, electrostatic latent images can be formed rapidly even when the amount of the laser light to be irradiated per one dot is small. Further, since the photoconductor 2 is excellent in the chargeability, uniform and rapid charging is possible. Accordingly, even in a case where the rotational circumferential speed Vp of the photoconductor 2 is set high and the scanning speed of the laser beam light 31 is set high, images at high quality and high resolution can be formed. That is, the image forming apparatus 1 can form images of high quality and high resolution at high speed.

Further, since the decaying speed of the surface potential on the light sensitive layer 6 by exposure is high in the photoconductor 2, development is conducted in a state where the surface potential of the photosensitive layer 6 is decayed sufficiently even when the time from exposure to the development is short. That is, even in a case where the diameter of the photoconductor 2 is made smaller, for example, by setting the diameter of the photoconductor 2 as from 20 to 40 mm, it is not necessary to lower the rotational circumferential speed Vp of the photoconductor 2. Accordingly, by reducing the diameter of the photoconductor 2, an image forming apparatus 1 of reduced size and operating at high speed can be attained as described above.

Further, since the good electric characteristics of the photoconductor 2 are not deteriorated even when the environment circumstance such as temperature and humidity are changed or even when the photoconductor is used repetitively, the image forming apparatus 1 can stably form images at high quality and high resolution for a long period of time under various conditions such as low temperature/low humidity circumstance. Further, since the good electric characteristics of the photoconductor 2 are not deteriorated even when exposed to an external light, degradation of the picture quality attributable to the exposure of the photoconductor 2 to the external light for example during maintenance can be suppressed.

As has been-described above, while the charger 32 in this embodiment is the contact type charging means such as the charge roller, it is not restricted thereto but may be contactless charging means such as a corona charger. Further, while the transfer device 34 is contactless transfer means for conducting transfer without utilizing pressing force, it is not restricted thereto but contact type transfer means for conducting transfer by utilizing the pressing force may also be used. As the contact type transfer means, it is possible to use those, for example, having a transfer roller in which the transfer roller is pressed the recording paper 51 that abuts against the surface 52 of the photoconductor 2 on the side opposite to the abutting surface, and a voltage is applied to the transfer roller in a state where the photoconductor 2 and the recording paper 51 are in press contact with each other to transfer the toner images on the recording paper 51.

Figure 4:
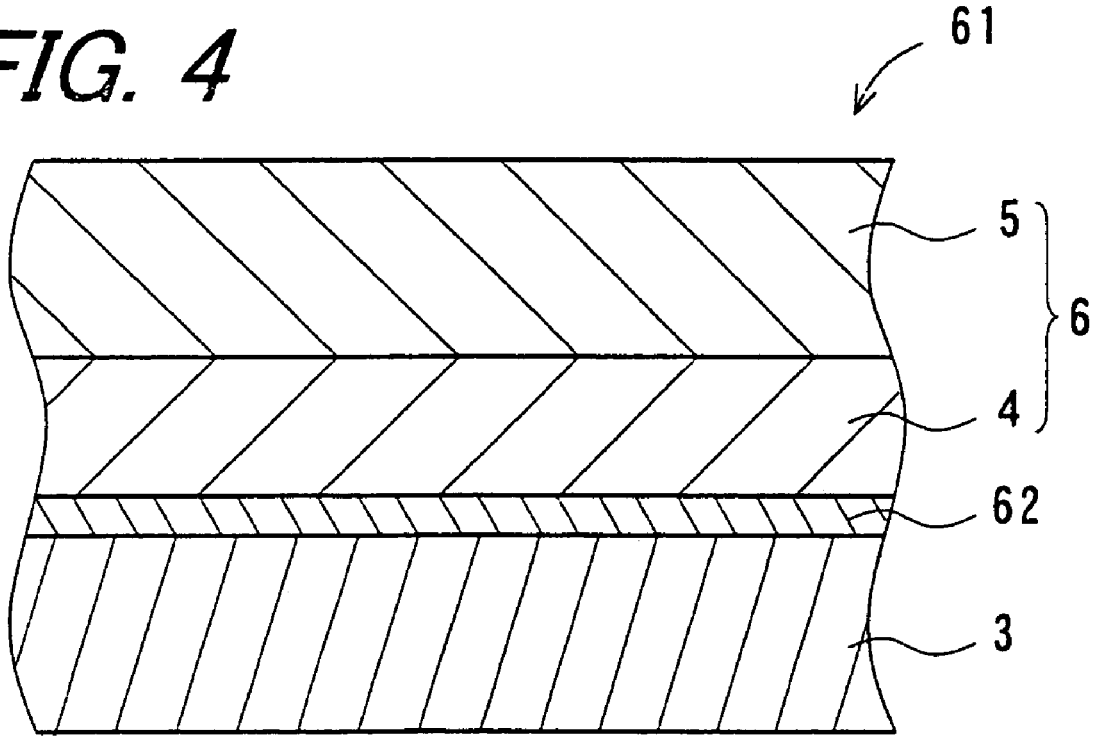
FIG. 4 is a schematic partial cross sectional view showing the constitution of an electrophotographic photoconductor equipped with an image forming apparatus according to a second embodiment of the invention.

FIG. 4 is a schematic partial cross sectional view showing the constitution of an electrophotographic photoconductor 61 equipped with an image forming apparatus according to a second embodiment of the invention. The photoconductor 61 equipped to the image forming apparatus in this embodiment is similar to the photoconductor 2 equipped to the image forming apparatus 1 of the first embodiment, in which corresponding portions carry identical reference numerals for which description is to be omitted. What is to be noted in the photoconductor 61 is that an intermediate layer 62 is provided between a conductive support 3 and a photosensitive layer 6.

In a case where the intermediate layer 62 is not present between the conductive support 3 and the photosensitive layer 6, charges are injected from the conductive support 3 to the photosensitive layer 6 to lower the chargeability of the photosensitive layer 6 and the surface charges in the portions other than the exposed portion are decreased to sometimes result in defects such as fogging to the images. Particularly, in a case of forming images by using a reversal development process, since toner images are formed by deposition of the toner to the portion where the surface charges are decreased by exposure, when the surface charges are decreased by the factors other than the exposure image fogging referred to as block spot where the toner is deposited on the white background to form minute black spots to sometimes cause remarkable degradation in the picture quality. That is, in a case where the intermediate layer 62 is not present between the conductive support 3 and the photosensitive layer 6, the chargeability is lowered in a minute region caused by the defects of the conductive support 3 or the photosensitive layer 6 to sometimes cause fogging of images such as black spots to result in remarkable image defects.

On the contrary, in the photoconductor 61 of this embodiment, the intermediate layer 62 is provided between the conductive support 3 and the photosensitive layer 6 as described above. Since injection of charges from the conductive support 3 to the photosensitive layer 6 can be prevented by the provision of the intermediate layer 62, lowering of the chargeability of the photosensitive layer 6 can be prevented, and the decrease of the surface charges in the portions other than the exposed portion can be suppressed to prevent occurrence of defects such as fogging in the images. Further, since the defects on the surface of the conductive support 3 are covered and uniform surface can be obtained, the film-forming property of the photosensitive layer 6 can be improved. Further, since the intermediate layer 62 functions as an adhesive between the conductive support 3 and the photosensitive layer 6, peeling of the photosensitive layer 6 from the conductive support 3 can be suppressed. Accordingly, a highly reliable image forming apparatus capable of stably providing images at high quality and high resolution can be attained.

For the intermediate layer 62, a resin layer comprising various kinds of resin materials or an alumite layer, etc. are used. The resin material for constituting the resin layer can include, for example, polyethylene resin, polypropylene resin, polystyrene resin, acrylic resin, vinyl chloride resin, vinyl acetate resin, polyurethane resin, epoxy resin, polyester resin, melamine resin, silicone resin, polyvinyl butyral resin and polyamide resin, and copolymer resins containing two or more repeating units constituting those resins. Further, they can also include casein, gelatin, polyvinyl alcohol and ethyl cellulose. Among those resins, the polyamide resin is preferably used and, in particular, a alcohol-soluble nylon resin can be preferably used. The preferred alcohol-soluble nylon resin can include, so called copolymerized nylon prepared by copolymerizing, for example, 6-nylon, 6,6-nylon, 6,10-nylon, 11-nylon, and 2-nylon and resins prepared by chemically modifying nylon, such as N-alkoxy methyl-modified nylon and N-alkoxyethyl modified nylon.

The intermediate layer 62 may preferably contain particles such as metal oxide particles. By incorporation of the particles in the intermediate layer 62, the volumic resistance value of the intermediate layer 62 can be controlled, the effect of preventing the injection of charges from the conductive support 3 to the photosensitive layer 6 can be enhanced, and the electric characteristics of the photoconductor 61 can be maintained under various circumstances. The metal oxide particles can include, for example, particles of titanium oxide, aluminum oxide, aluminum hydroxide, and tin oxide.

The intermediate layer 62 is formed, for example, by dissolving or dispersing the resin described above in an appropriate solvent to prepare a coating solution for the intermediate layer, and coating the coating solution on the surface of the conductive support 3. In a case of incorporating particles such as metal oxide particles described above in the intermediate layer 62, the intermediate layer 62 can be formed by dispersing the particles in a resin solution obtained by dissolving the resin described above in an appropriate solvent to prepare a coating solution for the intermediate layer, and coating the coating solution on the surface of the conductive support 3.

As the solvent of the coating solution for the intermediate layer, water or various kinds of organic solvents or mixed solvents of them may be used. Particularly, a single solvent of water, methanol, ethanol or butanol or a mixed solvent such as of water and alcohols, two or more kinds of alcohols, acetone or dioxolane and alcohols, and chlorine type solvent such as dichloroethane, chloroform or trichloroethane and alcohols are used suitably.

In the coating solution for the intermediate layer, a ratio C/D between the weight C for the sum of the resin and the metal oxide and the weight D for the solvent to be used in the coating solution of the intermediate layer is preferably, from 1/99 to 40/60, more preferably, from 2/98 to 30/70. Further a ratio E/F between the weight E for the resin and the weight F for the metal oxide is preferably from 90/10 to 1/99 and, more preferably, from 70/30 to 5/95.

As the method of dispersing the particles in a resin solution, ordinary methods including the use of a ball mill, sand mill, attritor, vibration mill, ultrasonic wave dispersing machine or paint shaker can be used. The method for coating the coating solution for the intermediate layer can include, for example, a spray method, bar coat method, roll coat method, blade method, wringing method and a dip coating method. Among them, the dip coating method is suitably used also in a case of forming the intermediate layer 62, since it is relatively simple and excellent in view of the productivity and the cost.

The film thickness of the intermediate layer 62 is, preferably, 0.01 μm or more and 20 μm or less and, more preferably, 0.05 μm or more and 10 μm or less. In a case where the intermediate layer 62 has a film thickness of less than 0.01 μm, it does not substantially function as the intermediate layer 62, so that a uniform surface can not be obtained by covering the defects of the conductive support 3, injection of charges from the conductive support 3 to the photosensitive layer 6 can not be prevented to result in the lowering of the chargeability of the photosensitive layer 6. Increase of the film thickness of the intermediate layer 62 to more than 20 μm is undesirable since the formation of the intermediate layer 62 becomes difficult in a case of forming the intermediate layer 62 by the dip coat method, making it impossible to form the photosensitive layer 6 uniformly on the intermediate layer 62, and the sensitivity of the photoconductor 61 is lowered, which is not preferred. Accordingly, a preferred range for the thickness of the intermediate layer 62 is determined to 0.01 μm or more and 20 μm or less.

Also in this embodiment, various kinds of additives such as plasticizers, leveling agents or fine particles of organic or inorganic compounds may be added in the same manner as in the first embodiment. Further, electron accepting substances or additives, for example, sensitizers such as dyes, antioxidants or UV-ray absorbers can be added to each of layers 4, 5 of the photosensitive layer 6.

Figure 5:
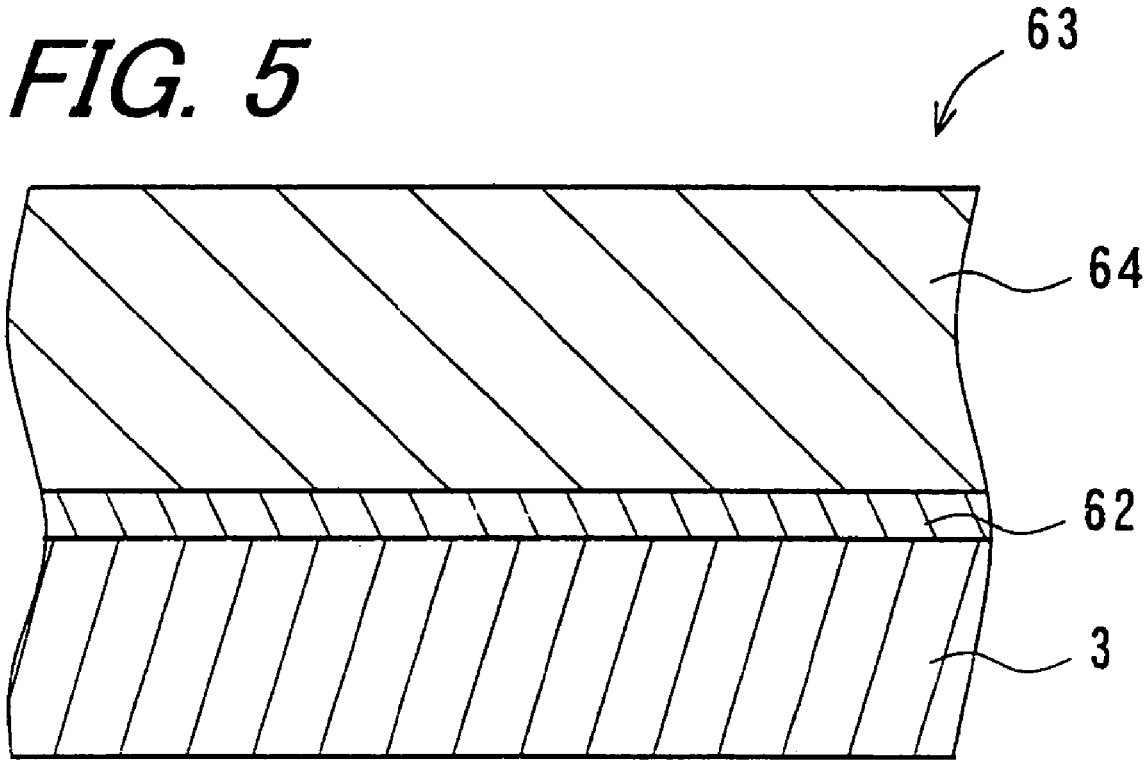
FIG. 5 is a schematic partial cross sectional view showing the constitution of an electrophotographic photoconductor equipped with an image forming apparatus according to a third embodiment of the invention.

FIG. 5 is a schematic partial cross sectional view showing the constitution of an electrophotographic photoconductor 63 equipped with an image forming apparatus according to a third embodiment of the invention. The electrophotographic photoconductor 63 of this embodiment is similar to the electrophotographic photoconductor 61 equipped to the image forming apparatus of the second embodiment in which corresponding portions carry identical reference numerals, for which explanations are to be omitted. In the electrophotographic photoconductor 63, it is to be noted that the photosensitive layer 64 is constituted with a single layer containing a charge generation substance and a charge transportation substance. That is, the electrophotographic photoconductor 63 is a single layer type photoconductor.

The single layer type photoconductor 63 of this embodiment is suitable as a photoconductor for use in a positively charged type image forming apparatus with less generation of ozone, and since the photosensitive layer 64 to be coated has only one layer, it is excellent compared with the laminated photoconductor 2, 61 of the first embodiment or the second embodiment in view of the manufacturing cost and the yield.

The photosensitive layer 64 is formed by using the charge generation substance, charge transportation substance and the binder resin identical with those used for the photoconductor 2 in the first embodiment. Various kinds of additives such as plasticizers, leveling agents, fine particles of inorganic compounds or organic compounds, sensitizers such as electron accepting substances or dyes, antioxidants or UV-ray absorbers may be added to the photosensitive layer 64.

The photosensitive layer 64 is formed by the method identical with that for the charge transportation layer 5 provided to the electrophotographic photoconductor 2 of the first embodiment. For example, a coating solution for use in the photosensitive layer is prepared by dissolving or dispersing the charge generation substance, the charge transportation substance containing the enamine compound represented by the general formula (1), preferably, the enamine compound represented by the general formula (2), the binder resin and, optionally, the additives described above into an appropriate solvent similar with that for the coating solution for use in the charge transportation layer, and by coating the coating solution for use in the photosensitive layer to the surface of the intermediate layer 62, for example, by a dip coating method, thereby forming the photosensitive layer 64.

The ratio A'/B' between the weight A' for the enamine compound represented by the general formula (1) and the weight B' for the binder resin in the photosensitive layer 64 is, preferably, from 10/30 or more and 10/12 or less with the same reason as that for the ratio A/B between the weight A for the enamine compound represented by the general formula (1) and the weight B for the binder resin in the charge transportation layer 5 of the first embodiment.

The film thickness of the photosensitive layer 64 is, preferably, from 5 μm or more and 100 μm or less, more preferably, from 10 μm or more and 50 μm or less. In a case where the film thickness of the photosensitive layer 64 is less than 5 μm, the charge retainability to the surface of the photoconductor is lowered. In a case where the thickness of the photosensitive layer 64 exceeds 100 μm, the productivity is lowered. Accordingly, a suitable range for the thickness of the photosensitive layer 64 is defined as 5 μm or more and 100 μm or less.

The electrophotographic photoconductor according to the invention is not restricted to the constitutions for the electrophotographic photoconductor 2, 61, or 63 of the first embodiment to the third embodiment shown in FIG. 3 to FIG. 5 but it may be of any other different constitutions so long as the enamine compound represented by the general formula (1) is contained in the photosensitive layer.

For example, it may be a constitution of providing a surface protective layer to the surface of the photosensitive layer 6 or 64. Provision of the surface protective layer on the surface of the photosensitive layer 6 or 64 further improves the mechanical durability of the photoconductor 2, 61, or 63. Further, this can prevent undesired chemical effects of an active gas such as ozone and nitrogen oxide (NOx) generated by corona discharge upon charging the surface of the photoconductor on the photosensitive layer 6, 64, thereby enabling to improve the electrical durability of the photoconductor 2, 61, or 63. As the surface protective layer, a layer comprising, for example, a resin, an inorganic filler-containing resin or an inorganic oxide is used.

EXAMPLE

The invention is to be described more specifically by using examples but the invention is not restricted to the contents of the following descriptions.

Preparation Example

Production Example 1

Production of Compound No. 1

Production Example 1-1

Production of Enamine Intermediate 23.3 g (1.0 mol-equivalent) of N-(p-tolyl)-α-naphthylamine of the following structural formula (8), 20.6 g (1.05 mol-equivalents) of diphenylacetaldehyde of the following structural formula (9), and 0.23 g (0.01 mol-equivalents) of DL-10-camphorsulfonic acid were added to 100 ml of toluene and heated, and these were reacted for 6 hours while the side-product, water was removed out of the system through azeotropic distillation with toluene. After thus reacted, the reaction solution was concentrated to about 1/10, and gradually and dropwise added to 100 ml of hexane that was vigorously stirred, and this gave a crystal. The crystal was taken out through filtration, and washed with cold ethanol to obtain 36.2 g of a pale yellow powdery compound.

(8)

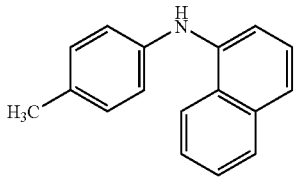

(9)

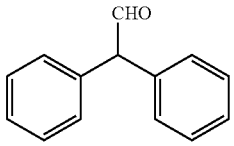

Thus obtained, the compound was analyzed through liquid chromatography-mass spectrometry (LC-MS), which gave a peak at 412.5 corresponding to the molecular ion $[M+H]^+$ of an enamine intermediate (calculated molecular weight: 411.20) of the following structural formula (10) with a proton added thereto. This confirms that the compound obtained herein is the enamine intermediate represented by the structural formula (10) (yield: 88%). In addition, the data of LC-MS further confirm that the purity of the enamine intermediate obtained herein is 99.5%.

(10)

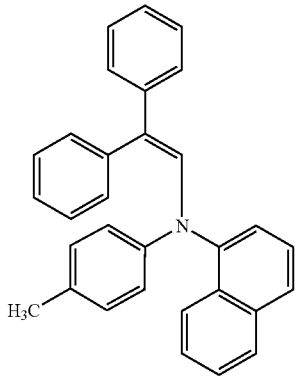

As in the above, the dehydrating condensation of N-(p-tolyl)-α-naphthylamine, a secondary amine represented by the structural formula (8), and diphenylacetaldehyde, an aldehyde compound represented by the structural formula (9) gives the enamine intermediate the structural represented by formula (10).

Production Example 1-2

Production of Enamine-Aldehyde Intermediate 9.2 g (1.2 mol-equivalents) of phosphorus oxychloride was gradually added to 100 ml of anhydrous N,N-dimethylformamide (DMF) and stirred for about 30 minutes to prepare a Vilsmeier reagent. 20.6 g (1.0 mol-equivalent) of the enamine intermediate represented by the structural formula (10) obtained in Production Example 1-1 was gradually added to the solution with cooling with ice. Next, this was gradually heated up to 80° C., and stirred for 3 hours while kept heated at 80° C. After thus reacted, the reaction solution was left cooled, and then this was gradually added to 800 ml of cold 4 N aqueous sodium hydroxide solution to form a precipitate. Thus formed, the precipitate was collected through filtration, well washed with water, and then recrystallized from a mixed solvent of ethanol and ethyl acetate to obtain 20.4 g of an yellow powdery compound.

Thus obtained, the compound was analyzed through LC-MS, which gave a peak at 440.5 corresponding to the molecular ion $[M+H]^+$ of an enamine-aldehyde intermediate (calculated molecular weight: 439.19) of the following structural formula (11) with a proton added thereto. This confirms that the compound obtained herein is the enamine-aldehyde intermediate represented by the structural formula (11) (yield: 93%). In addition, the data of LC-MS further confirm that the purity of the enamine-aldehyde intermediate obtained herein is 99.7%.

(11)

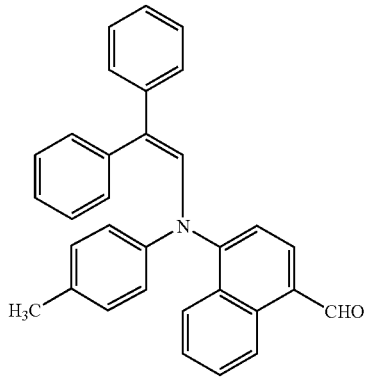

As in the above, the formylation of the enamine intermediate represented by the structural formula (10) through Vilsmeier reaction gives the enamine-aldehyde intermediate represented by the structural formula (11).

Production Example 1-3

Production of Compound No. 1

8.8 g (1.0 mol-equivalent) of the enamine-aldehyde intermediate represented by the structural formula (11) obtained in Production Example 1-2, and 6.1 g of diethyl cinnamylphosphonate of the following structural formula (12) were dissolved in 80 ml of anhydrous DMF, and 2.8 g (1.25 mol-equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 10.1 g of an yellow crystal.

(12)

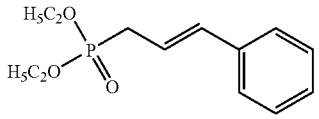

Thus obtained, the crystal was analyzed through LC-MS, which gave a peak at 540.5 corresponding to the molecular ion $[M+H]^+$ of the intended enamine compound, Compound No. 1 in Table 1 (calculated molecular weight: 539.26) with a proton added thereto.

Figure 6:
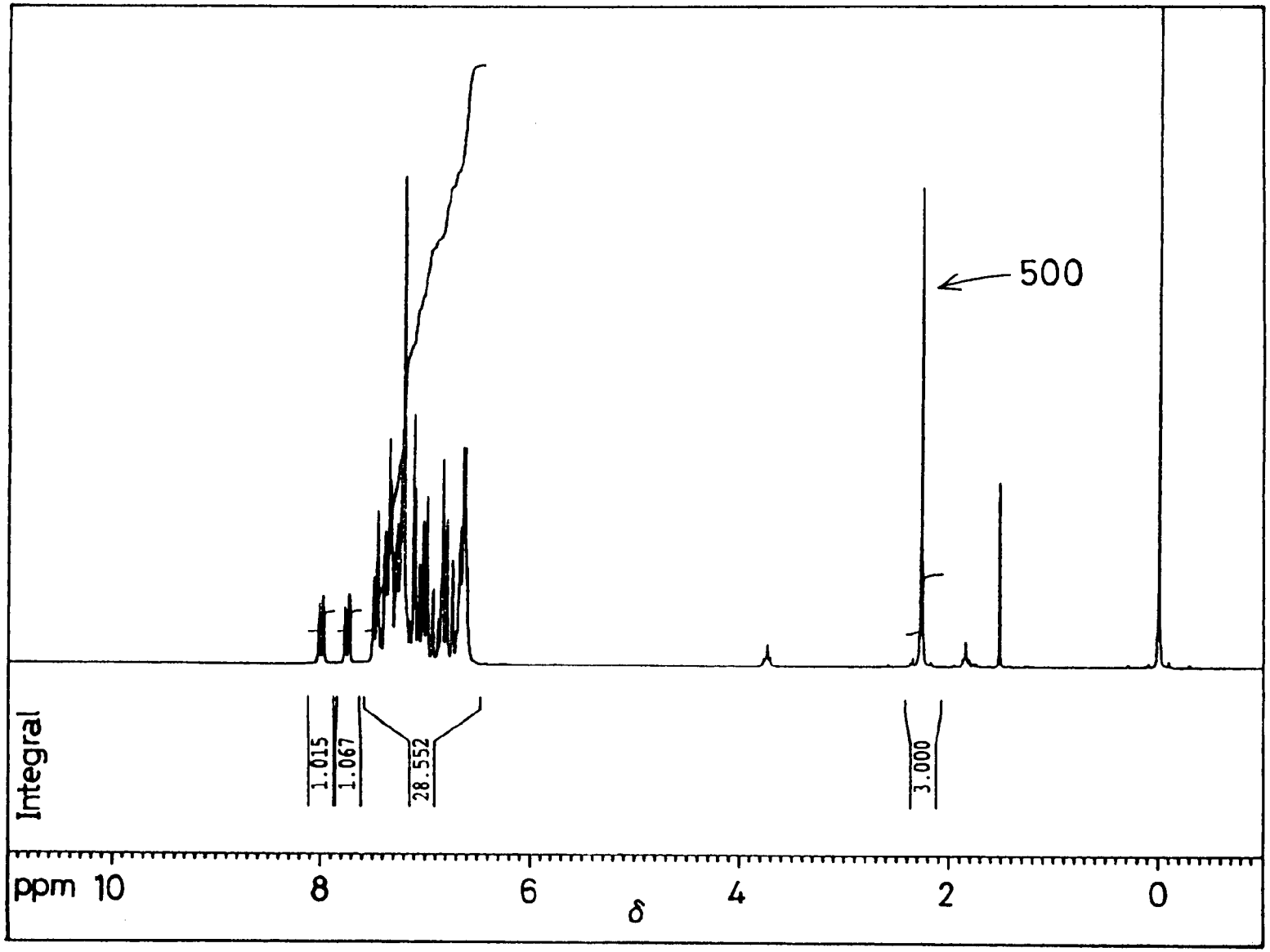
FIG. 6 is the $^{1}$H-NMR spectrum of the product in this Production Example 1-3.
Figure 7:
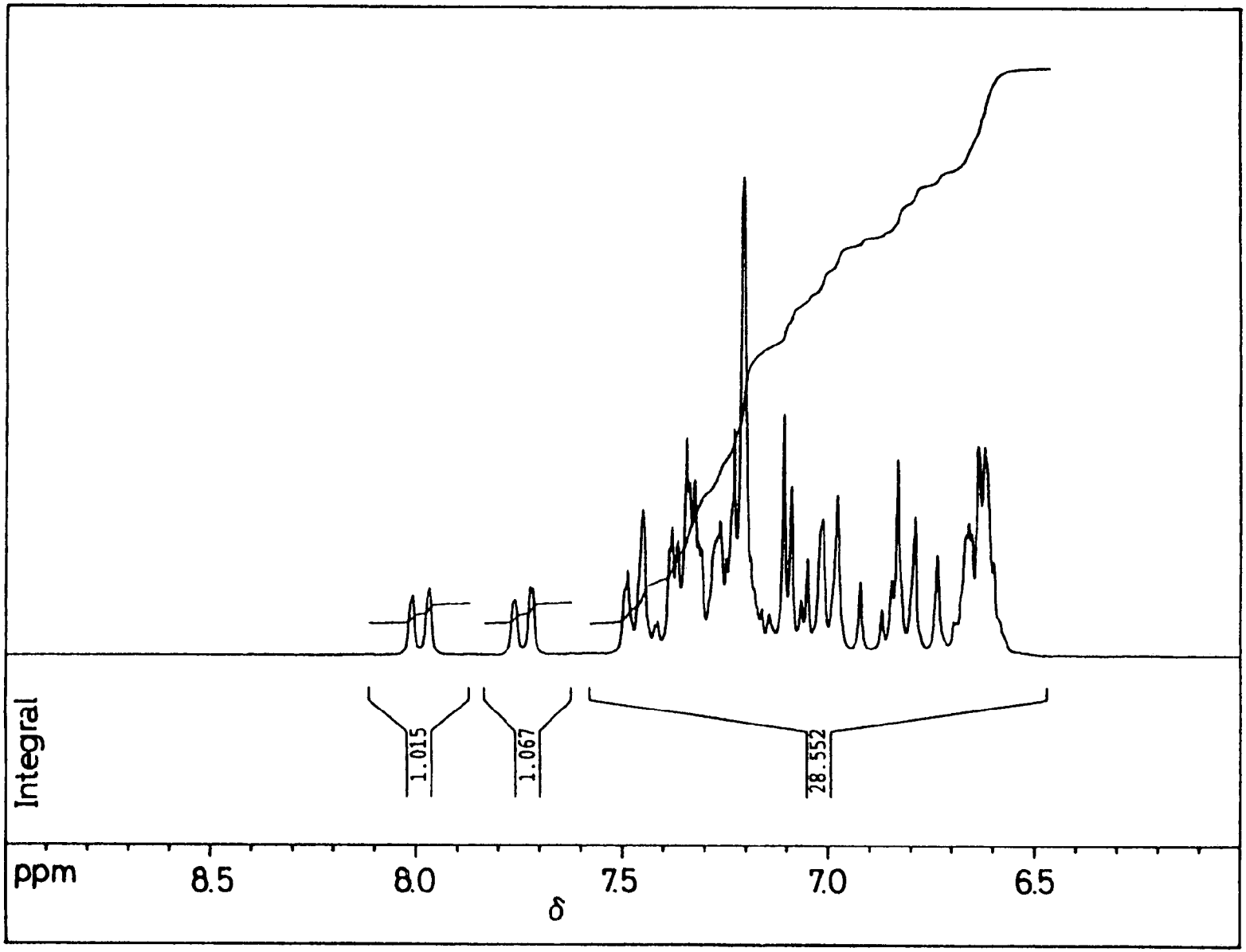
FIG. 7 is an enlarged view of the spectrum of FIG. 6 in the range of from 6 ppm to 9 ppm.
Figure 8:
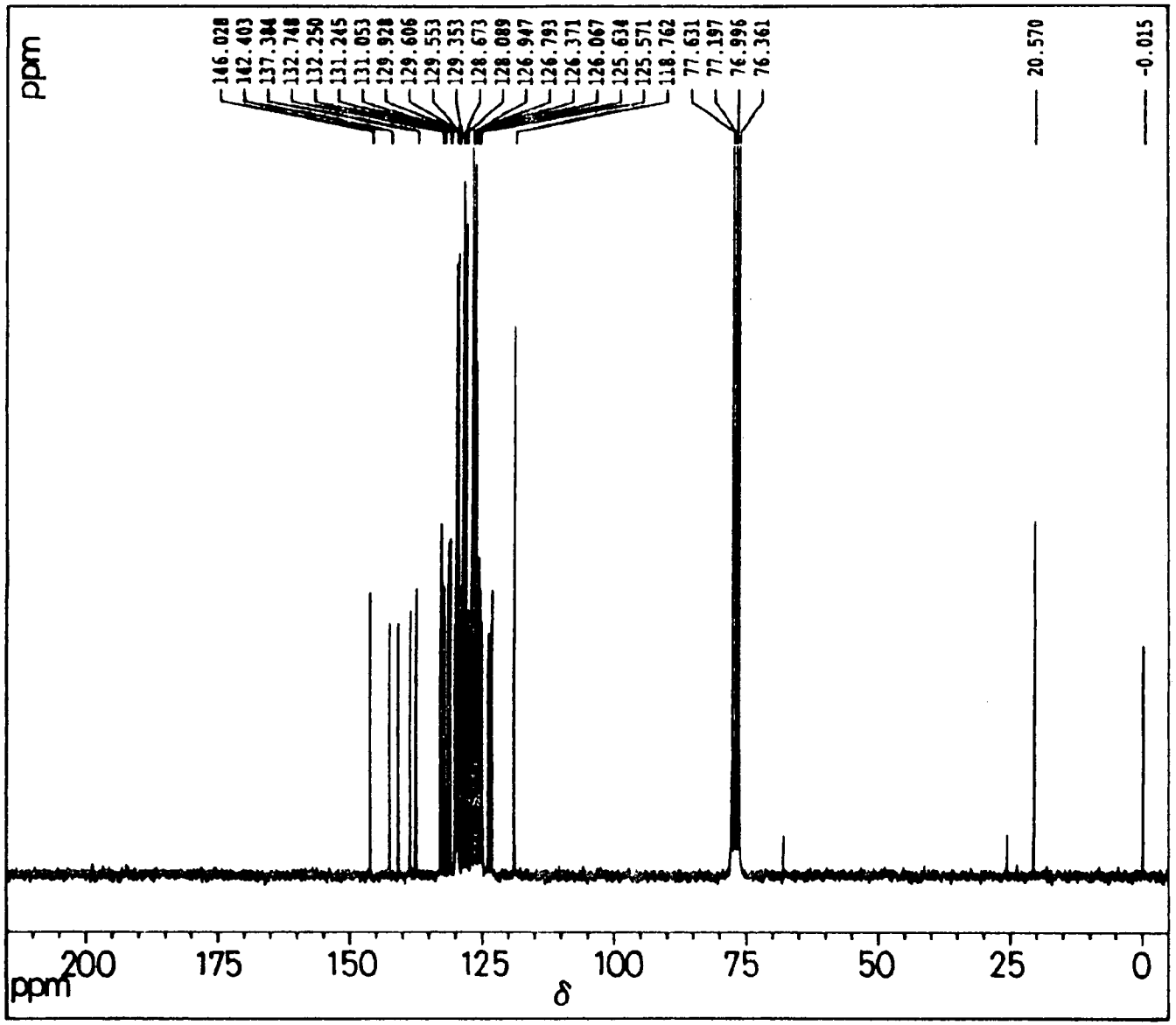
FIG. 8 is the $^{13}$C-NMR spectrum in ordinary measurement of the product in Production Example 1-3.
Figure 9:
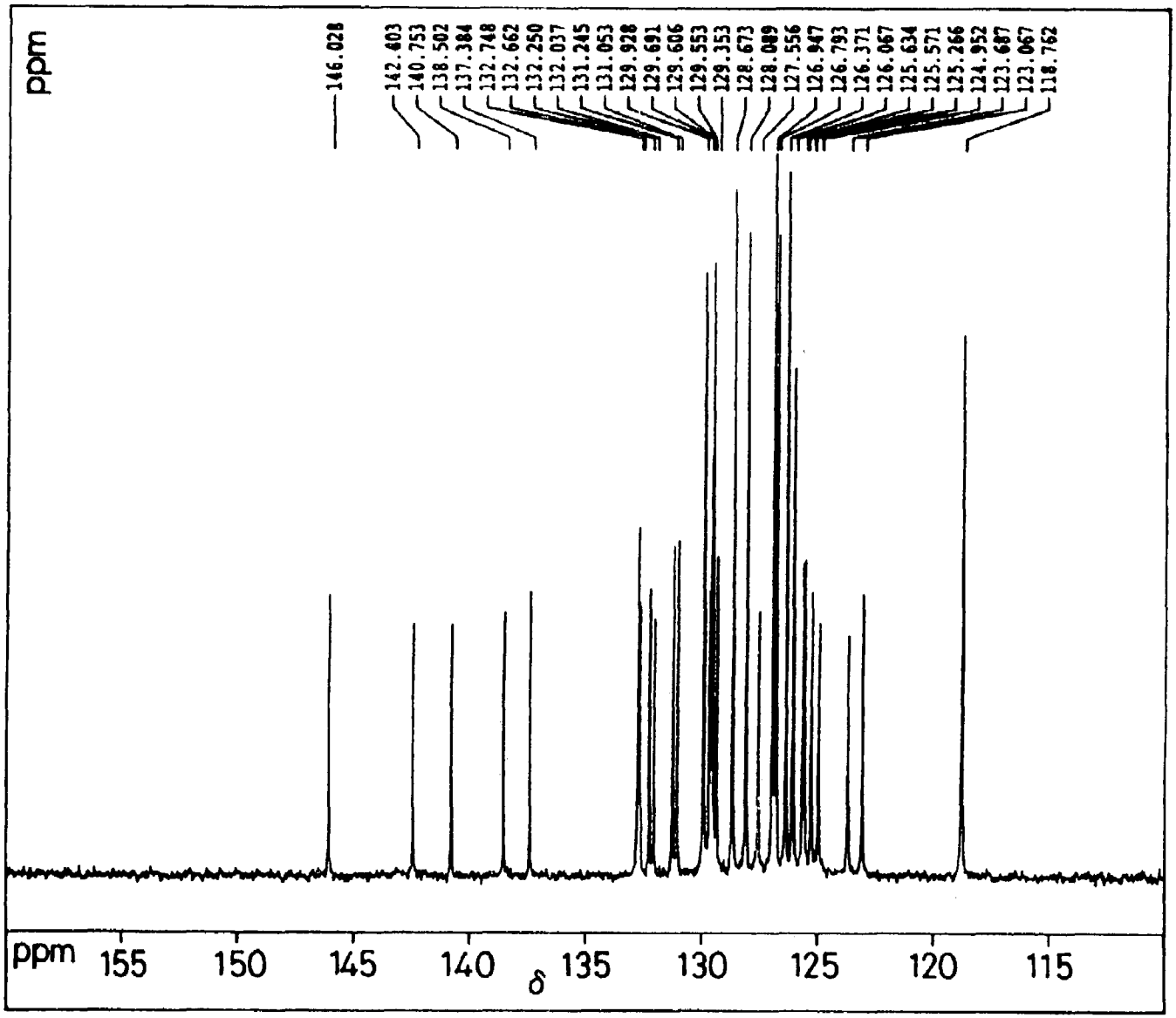
FIG. 9 is an enlarged view of the spectrum of FIG. 8 in the range of from 110 ppm to 160 ppm.
Figure 10:
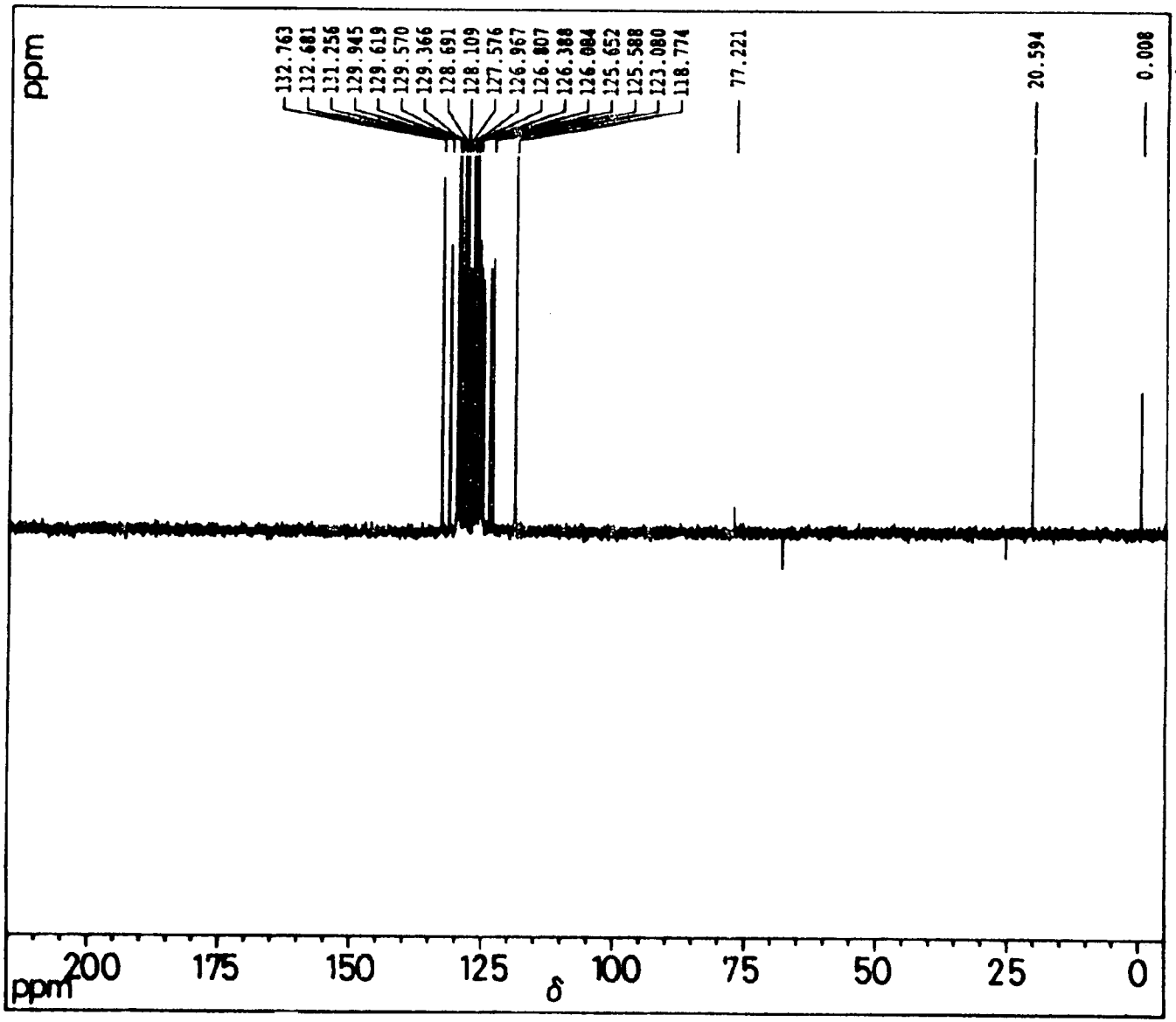
FIG. 10 is the $^{13}$C-NMR spectrum in DEPT135 measurement of the product in Production Example 1-3.
Figure 11:
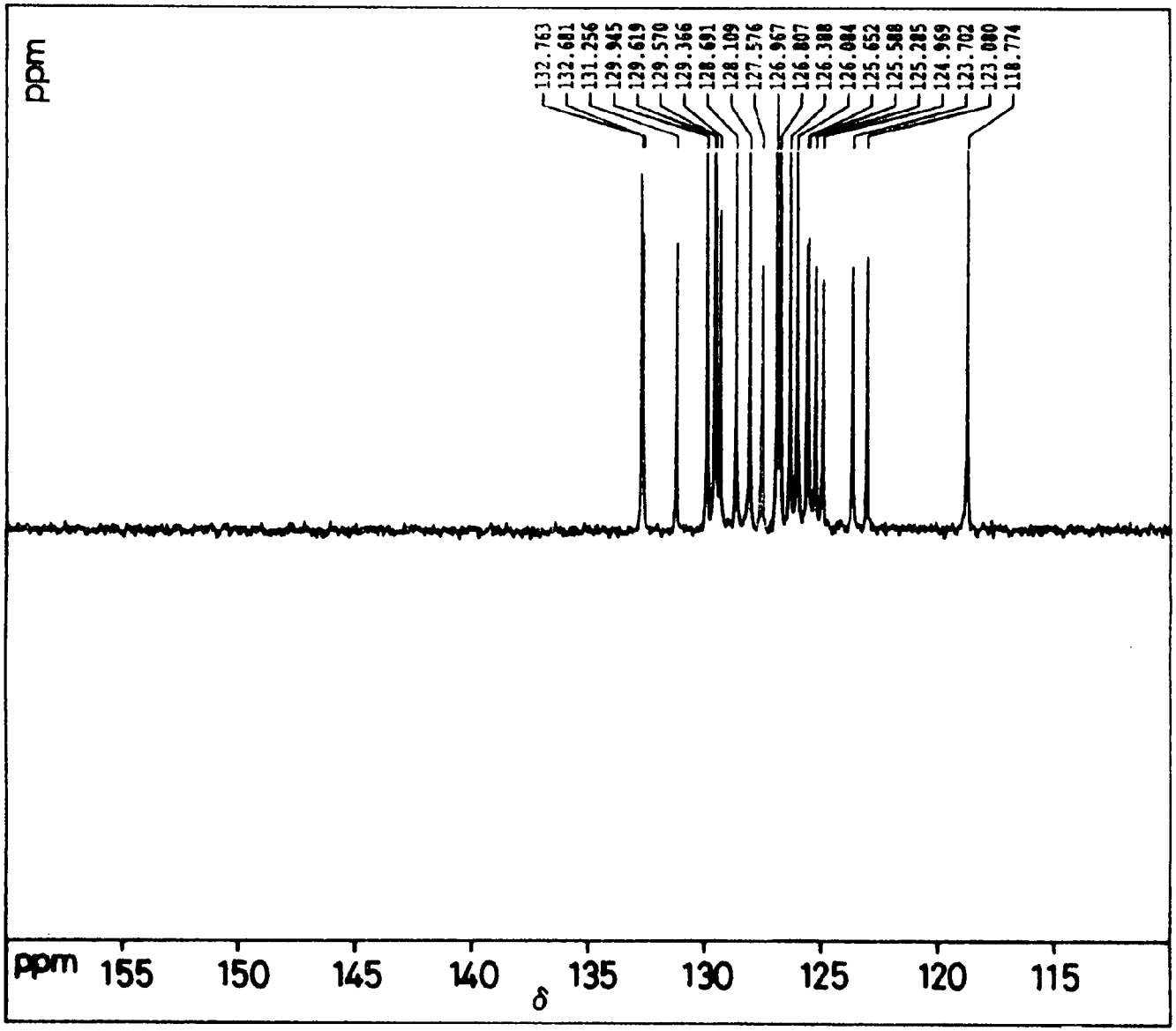
FIG. 11 is an enlarged view of the spectrum of FIG. 10 in the range of from 110 ppm to 160 ppm.

The nuclear magnetic resonance (NMR) spectrum of the crystal in heavy chloroform (chemical formula: $CDCl_3$) was measured, and this spectrum supports the structure of the enamine compound, Compound No. 1. FIG. 6 is the $^1$H-NMR spectrum of the product in this Production Example 1-3, and FIG. 7 is an enlarged view of the spectrum of FIG. 6 in the range of from 6 ppm to 9 ppm. FIG. 8 is the $^{13}$C-NMR spectrum in ordinary measurement of the product in Production Example 1-3, and FIG. 9 is an enlarged view of the spectrum of FIG. 8 in the range of from 110 ppm to 160 ppm. FIG. 10 is the $^{13}$C-NMR spectrum in DEPT135 measurement of the product in Production Example 1-3, and FIG. 11 is an enlarged view of the spectrum of FIG. 10 in the range of from 110 ppm to 160 ppm. In FIG. 6 to FIG. 11, the horizontal axis indicates the chemical shift δ (ppm) of the compound analyzed. In FIG. 6 and FIG. 7, the data written between the signals and the horizontal axis are relative integral values of the signals based on the integral value, 3, of the signal indicated by the reference numeral 500 in FIG. 6.

The data of LC-MS and the NMR spectrometry confirm that the crystal obtained herein is the enamine compound, Compound No. 1 (yield: 94%). In addition, the data of LC-MS further confirm that the purity of the enamine compound, Compound No. 1 obtained herein is 99.8%.

As in the above, the Wittig-Horner reaction of the enamine-aldehyde intermediate represented by the structural formula (11) and the Wittig reagent, diethyl cinnamylphosphonate represented by the structural formula (12) gives the enamine compound, Compound No. 1 shown in Table 1.

Production Example 2

Production of Compound No. 61

In the same manner as in Production Example 1 except that 4.9 g (1.0 mol-equivalent) of N-(p-methoxyphenyl)-α-naphthylamine was used in place of 23.3 g (1.0 mol-equivalent) of N-(p-tolyl)-α-naphthylamine represented by the structural formula (8), an enamine intermediate was produced (yield: 94%) through dehydrating condensation and an enamine-aldehyde intermediate was produced (yield: 85%) through Vilsmeier reaction, and this was further subjected to Wittig-Horner reaction to obtain 7.9 g of an yellow powdery compound. The equivalent relationship between the reagent and the substrate used in each reaction was the same as that in Production Example 1.

Thus obtained, the compound was analyzed through LC-MS, which gave a peak at 556.7 corresponding to the molecular ion $[M+H]^+$ of the intended enamine compound, Compound No. 61 in Table 9 (calculated molecular weight: 555.26) with a proton added thereto.

Figure 12:
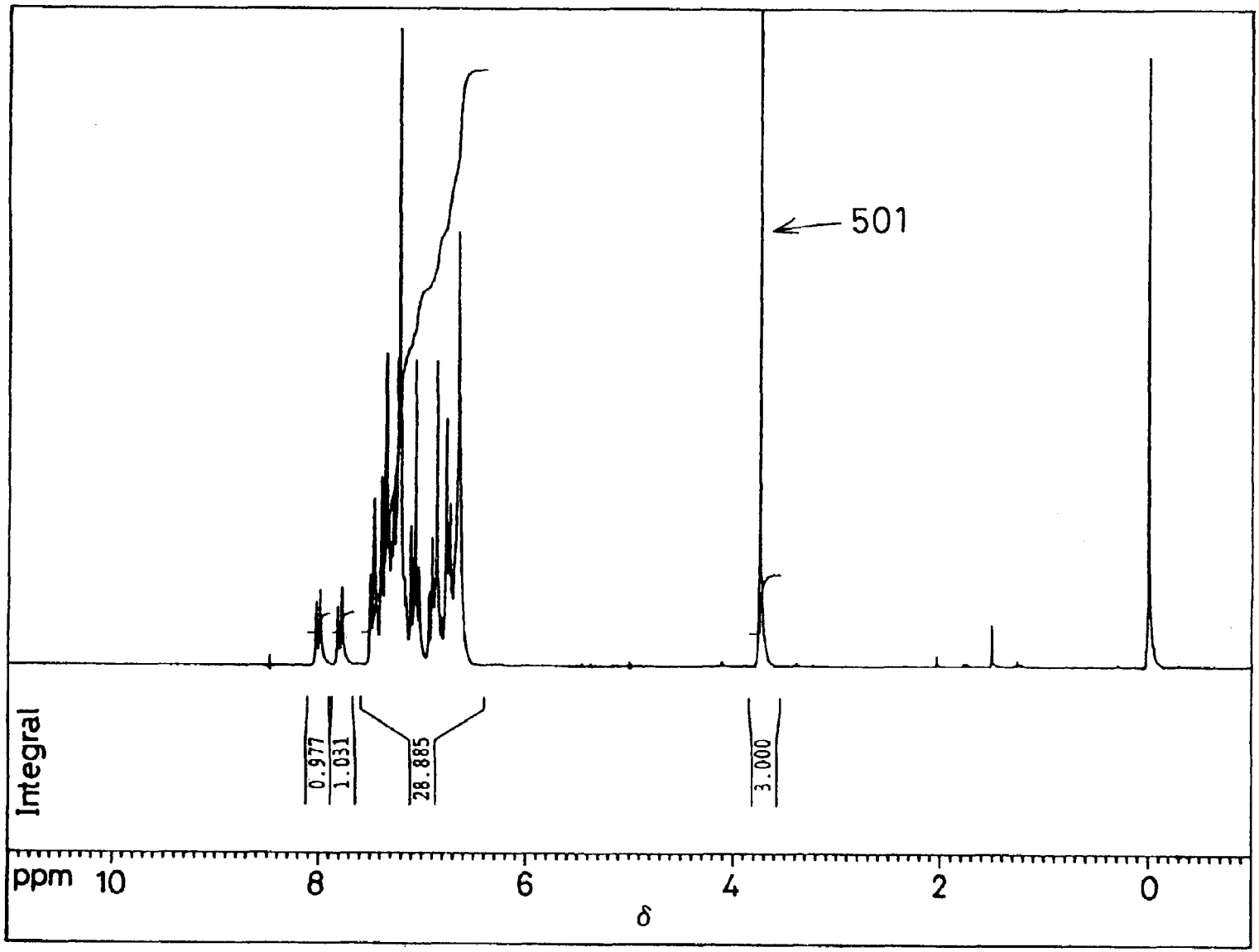
FIG. 12 is the $^{1}$H-NMR spectrum of the product in this Production Example 2.
Figure 13:
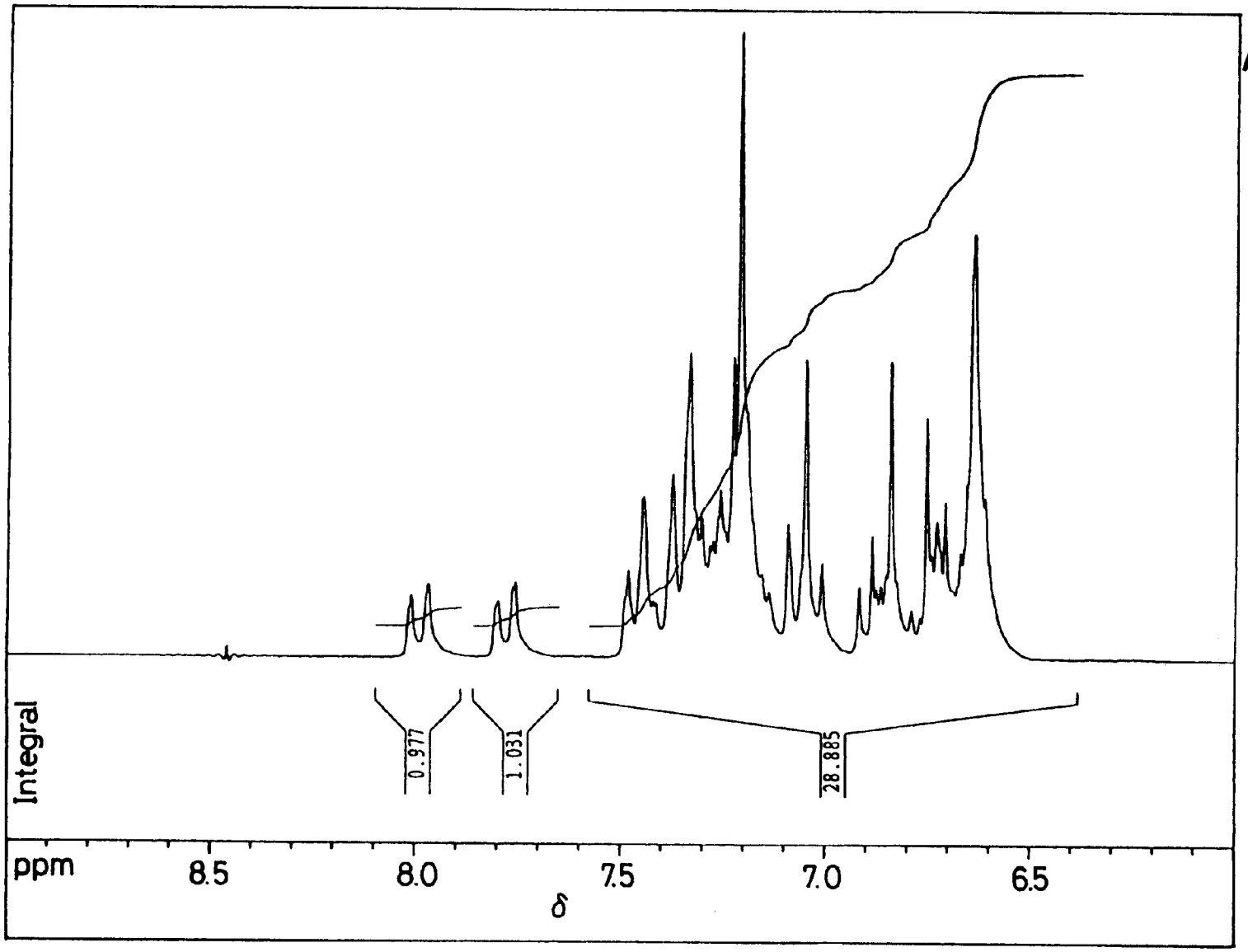
FIG. 13 is an enlarged view of the spectrum of FIG. 12 in the range of from 6 ppm to 9 ppm.
Figure 14:
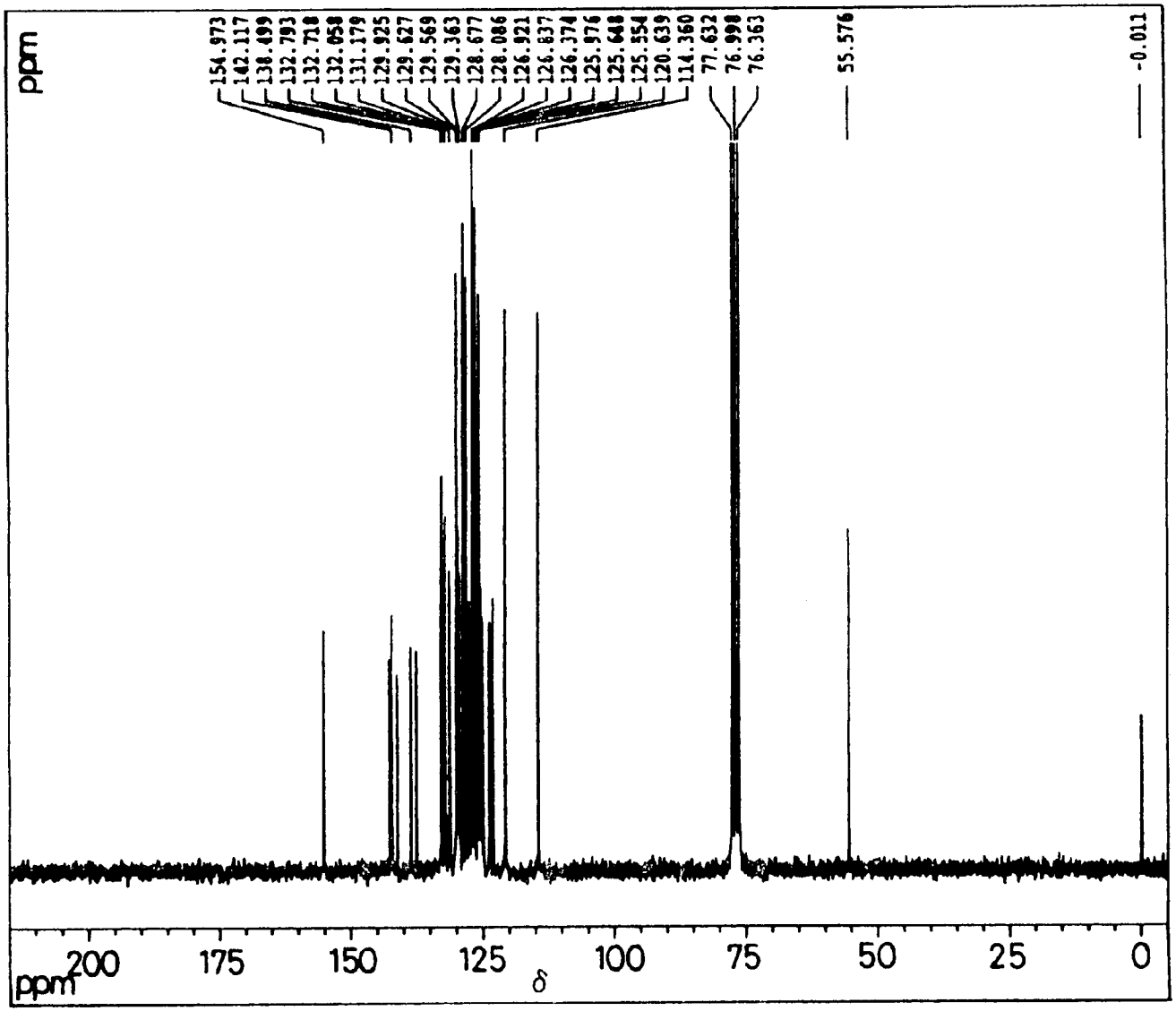
FIG. 14 is the $^{13}$C-NMR spectrum in ordinary measurement of the product in Production Example 2.
Figure 15:
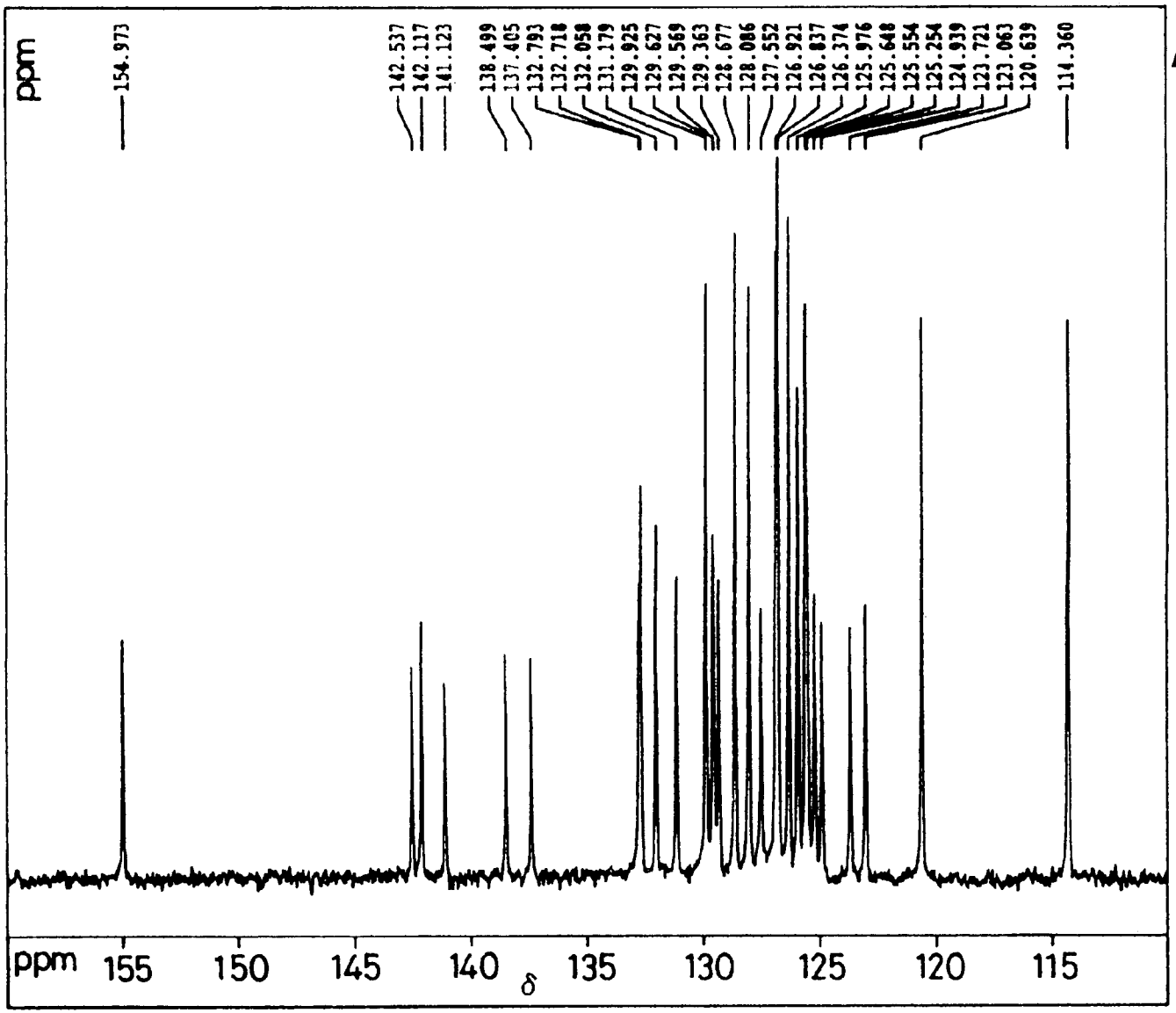
FIG. 15 is an enlarged view of the spectrum of FIG. 14 in the range of from 110 ppm to 160 ppm.
Figure 16:
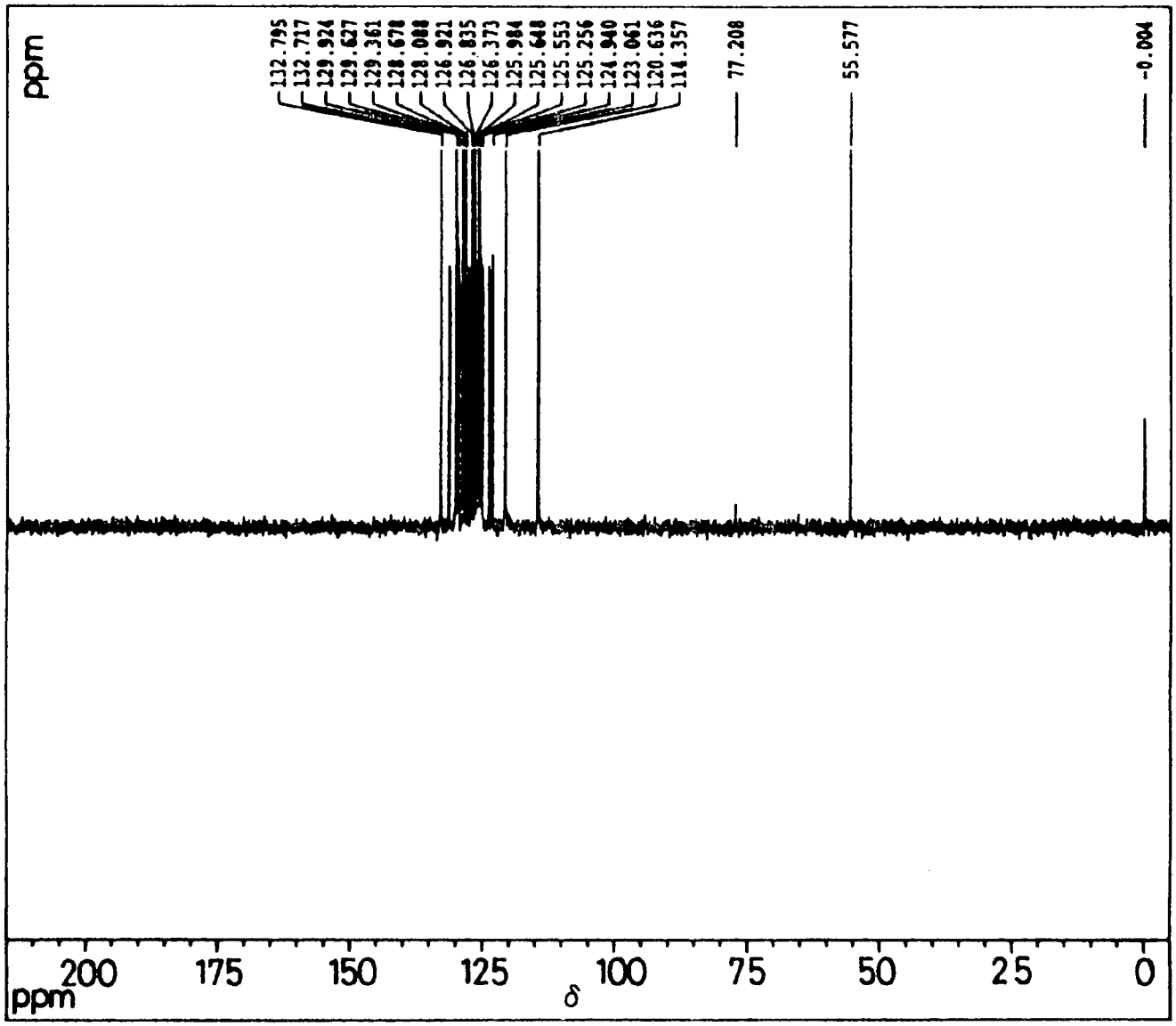
FIG. 16 is the $^{13}$C-NMR spectrum in DEPT135 measurement of the product in Production Example 2.
Figure 17:
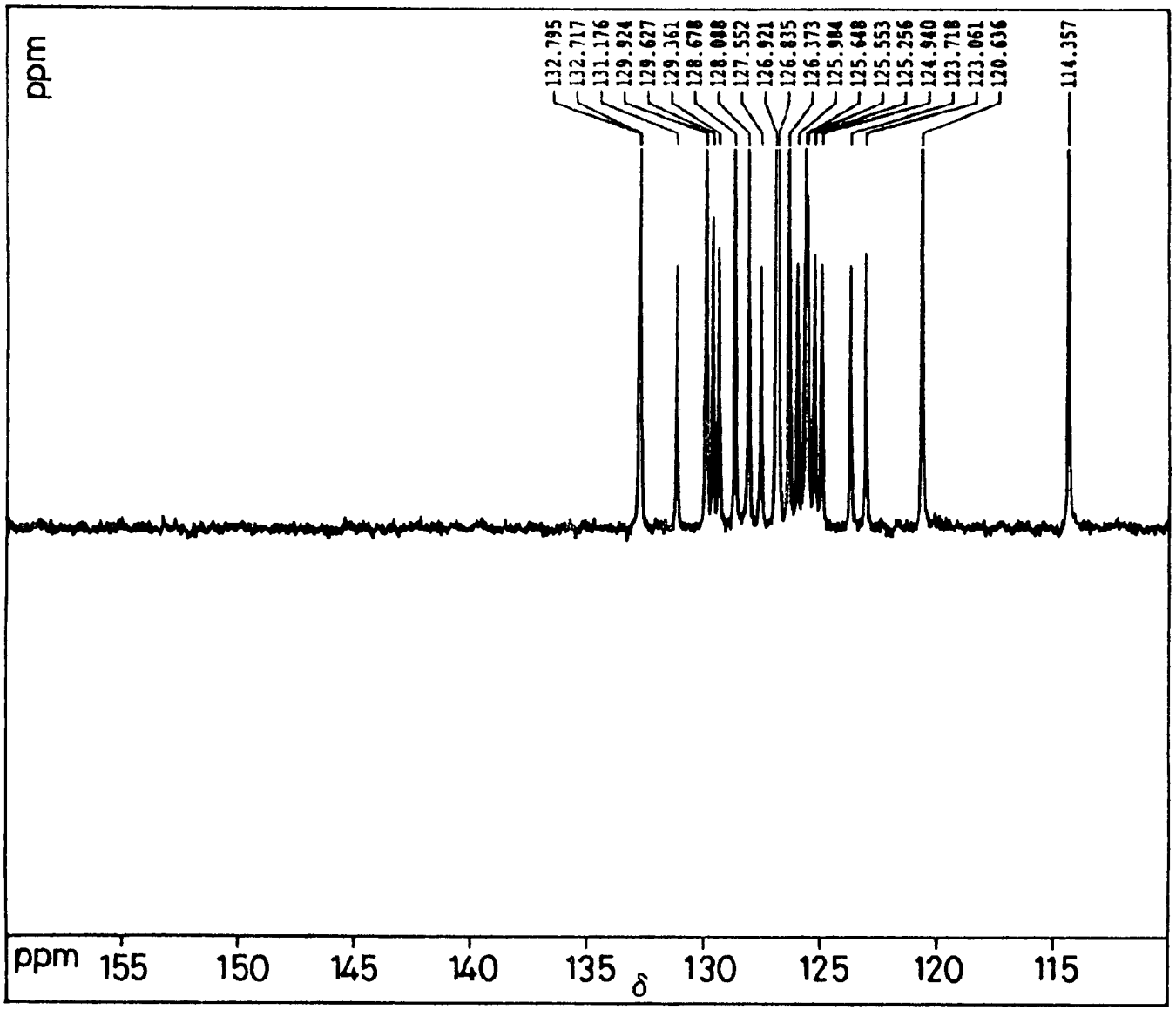
FIG. 17 is an enlarged view of the spectrum of FIG. 16 in the range of from 110 ppm to 160 ppm.

The NMR spectrum of the compound in heavy chloroform ($CDCl_3$) was measured, and this spectrum supports the structure of the enamine compound, Compound No. 61. FIG. 12 is the $^1$H-NMR spectrum of the product in this Production Example 2, and FIG. 13 is an enlarged view of the spectrum of FIG. 12 in the range of from 6 ppm to 9 ppm. FIG. 14 is the $^{13}$C-NMR spectrum in ordinary measurement of the product in Production Example 2, and FIG. 15 is an enlarged view of the spectrum of FIG. 14 in the range of from 110 ppm to 160 ppm. FIG. 16 is the $^{13}$C-NMR spectrum in DEPT135 measurement of the product in Production Example 2, and FIG. 17 is an enlarged view of the spectrum of FIG. 16 in the range of from 110 ppm to 160 ppm. In FIG. 12 to FIG. 17, the horizontal axis indicates the chemical shift δ (ppm) of the compound analyzed. In FIG. 12 and FIG. 13, the data written between the signals and the horizontal axis are relative integral values of the signals based on the integral value, 3, of the signal indicated by the reference numeral 501 in FIG. 12.

The data of LC-MS and the NMR spectrometry confirm that the compound obtained herein is the enamine compound, Compound No. 61 (yield: 92%). In addition, the data of LC-MS further confirm that the purity of the enamine compound, Compound No. 61 obtained herein is 99.0%.

As in the above, the three-stage reaction process that comprises dehydrating condensation, Vilsmeier reaction and Wittig-Horner reaction gives the enamine compound, Compound No. 61 shown in Table 9, and the overall three-stage yield of the product was 73.5%.

Production Example 3

Production of Compound No. 46

2.0 g (1.0 mol-equivalent) of the enamine-aldehyde intermediate represented by the structural formula (11) obtained in Production Example 1-2, and 1.53 g (1.2 mol-equivalents) of a Wittig reagent of the following structural formula (13) were dissolved in 15 ml of anhydrous DMF, and 0.71 g (1.25 mol-equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 2.37 g of an yellow crystal.

(13)

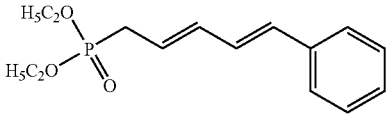

Thus obtained, the crystal was analyzed through LC-MS, which gave a peak at 566.4 corresponding to the molecular ion $[M+H]^+$ of the intended enamine compound, Compound No. 46 in Table 7 (calculated molecular weight: 565.28) with a proton added thereto. This confirms that the crystal obtained herein is the enamine compound, Compound No. 46 (yield: 92%). In addition, the data of LC-MS further confirm that the purity of the enamine compound, Compound No. 46 is 99.8%.

As in the above, the Wittig-Horner reaction of the enamine-aldehyde intermediate represented by the structural formula (11) and the Wittig reagent represented by the structural formula (13) gives the enamine compound, Compound No. 46 shown in Table 7.

Comparative Production Example 1

Production of Compound of Structural Formula (14)

2.0 g (1.0 mol-equivalent) of the enamine-aldehyde intermediate represented by the structural formula (11) obtained in Production Example 1-2 was dissolved in 15 ml of anhydrous THF, and 5.23 ml (1.15 mol-equivalents) of a THF solution of a Grignard reagent, allylmagnesium bromide prepared from allyl bromide and metal magnesium (molar concentration: 1.0 mol/liter) was gradually added to the solution at 0° C. This was stirred at 0° C. for 0.5 hours, and then checked for the reaction progress through thin-layer chromatography, in which no definite reaction product was confirmed but some different products were found. This was post-processed, extracted and concentrated in an ordinary manner. Then, the reaction mixture was isolated and purified through silica gel column chromatography.

However, the aimed compound represented by the following structural formula (14) could not be obtained.

(14)

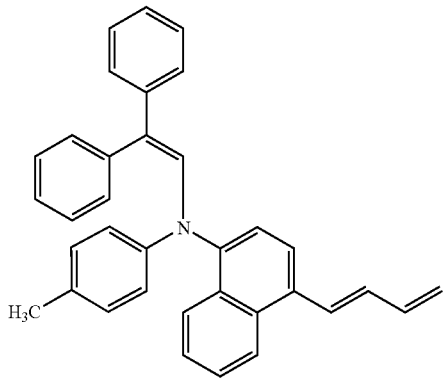

EXAMPLE

[Photoconductor]

Photoconductors were prepared under the different conditions as example specimens and comparative example specimens, and characteristics of the photoconductors were evaluated.

Example Specimen 1

After adding 2 parts by weight of an X-type non-metal phthalocyanine as the charge generation substance to a resin solution obtained by dissolving one part by weight of a polyvinyl butyral resin (BX-1, manufactured by Sekisui Chemical Co. Ltd.) to 97 parts by weight of THF, it was dispersed by a paint shaker for 10 hours, to prepare a coating solution for a charge generation layer. Then, after coating the coating solution for the charge generation layer was coated on aluminum of a conductive support formed by vapor depositing aluminum to the surface of a polyester film of 80 μm thickness by a baker applicator, it was dried to form a charge generation layer of 0.3 μm film thickness.

Then, 8 parts by weight of the enamine compound of Exemplified Compound No. 1 shown in Table 1 as a charge transportation substance, 10 parts by weight of a polycarbonate resin (C-1400, manufactured by Teijin Kasei Co.) as a binder resin were dissolved in 80 parts by weight of THF to prepare a coating solution for a charge transportation layer. After coating the coating solution for the charge transportation layer on the previously formed charge generation layer by a baker applicator, it was dried to form a charge transportation layer of 10 μm film thickness.

As described above, a laminated type photoconductor of the layer constitution shown in FIG. 3 was manufactured.

Example Specimens 2 to 6

Five kinds of photoconductors were manufactured in the same manner as in Example Specimen 1 except for using an enamine compound of Exemplified Compound No. 3 shown in Table 1, Exemplified Compound No. 61 shown in Table 9, Exemplified Compound No. 106 shown in Table 16, Exemplified Compound No. 146 shown in Table 21 or Exemplified Compound No. 177 shown in Table 26 instead of Exemplified Compound No. 1 as the charge transportation substance.

Comparative Example Specimen 1

A photoconductor was manufactured in the same manner as in Example Specimen 1 except for using a Comparative Compound A shown by the following structural formula (15) instead of Exemplified Compound No. 1 as the charge transportation substance.

(15)

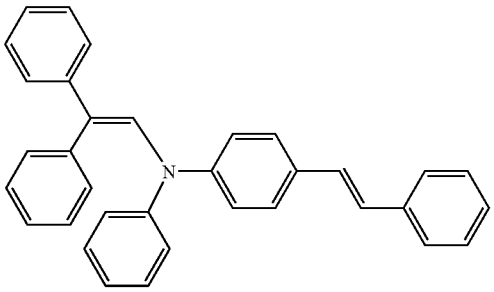

Comparative Example Specimen 2

A photoconductor was manufactured in the same manner as in Example Specimen 1 except for using a Comparative Compound B shown by the following structural formula (16) instead of Exemplified Compound No. 1 as the charge transportation substance.

(16)

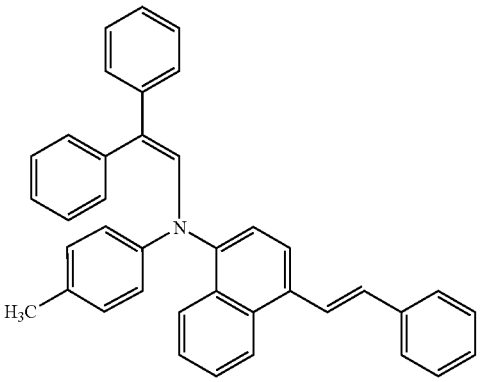

Comparative Example Specimen 3

A photoconductor was manufactured in the same manner as in Example Specimen 1 except for using a Comparative Compound C shown by the following structural formula (17) instead of Exemplified Compound No. 1 as the charge transportation substance.

(17)

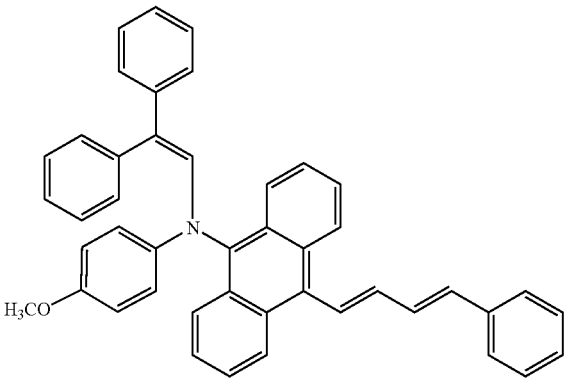

Comparative Example Specimen 4

A photoconductor was manufactured in the same manner as in Example Specimen 1 except for using a Comparative Compound D shown by the following structural formula (18) instead of Exemplified Compound No. 1 as the charge transportation substance.

(18)

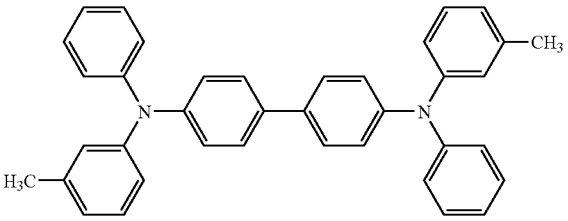

Evaluation 1

For each of photoconductors of Example Specimens 1 to 6 and Comparative Example Specimens 1 to 4 manufactured as described above, an ionization potential (eV) was measured by using a surface analyzer (AC-1, manufactured by Riken Keiki Co. Ltd.). Further, gold was vapor deposited on the surface of the charge transportation layer of each of photoconductors, and the charge mobility of the charge transportation substance ($cm^2/V \cdot sec$) was measured by a Time-of-Flight method at a room temperature under reduced pressure. The results of the measurement are shown in Table 33. The values of the charge mobility shown in Table 33 are values when the intensity of the electric field was at $2.5 \times 10^5$ V/cm.

TABLE 33

| | Charge transportation substance | Ionized potential (eV) | Charge mobility ($cm^2/V \cdot sec$) |
|---|---|---|---|
| Example Specimen 1 | Exemplified Compound 1 | 5.65 | $3.0 \times 10^{-4}$ |
| Example Specimen 2 | Exemplified Compound 3 | 5.58 | $2.8 \times 10^{-4}$ |

TABLE 33-continued

| | Charge transportation substance | Ionized potential (eV) | Charge mobility ($cm^2/V \cdot sec$) |
|---|---|---|---|
| Example Specimen 3 | Exemplified Compound 61 | 5.61 | $2.8 \times 10^{-4}$ |
| Example Specimen 4 | Exemplified Compound 106 | 5.57 | $4.1 \times 10^{-4}$ |
| Example Specimen 5 | Exemplified Compound 146 | 5.59 | $7.2 \times 10^{-4}$ |
| Example Specimen 6 | Exemplified Compound 177 | 5.71 | $1.1 \times 10^{-4}$ |
| Comparative Example Specimen 1 | Comparative Compound A | 5.63 | $2.0 \times 10^{-5}$ |
| Comparative Example Specimen 2 | Comparative Compound B | 5.66 | $1.5 \times 10^{-5}$ |
| Comparative Example Specimen 3 | Comparative Compound C | 5.68 | $2.1 \times 10^{-5}$ |
| Comparative Example Specimen 4 | Comparative Compound D | 5.40 | $1.2 \times 10^{-6}$ |

In view of the comparison between the Example Specimens 1 to 6 and Comparative Example Specimens 4, it was found that the enamine compound represented by the General formula (1) had a charge mobility higher by 2 digits or more compared with triphenylamine dimer (simply referred to as TPD), for example, Comparative Compound D as the charge transportation substance known so far.

In view of the comparison between Example Specimens 1 to 6 and Comparative Example Specimens 1, 3, it was found that the enamine compound represented by the General formula (1) had a charge mobility higher by one digit or more compared with Comparative Compounds A and C corresponding to the compound in which the naphthylene group bonding to the nitrogen atom (N) constituting the enamine skeleton is substituted with other arylene group in the general formula (1).

In view of the comparison between Example Specimens 1 to 6 and Comparative Example Specimen 2, it was found that the enamine compound represented by the General formula (1) had a charge mobility higher by one digits or more compared with Comparative Compound B corresponding to the compound in which n=0 and $Ar^3$ represents a group other than the heterocyclic group in the general formula (1).

In view of the comparison between Example Specimens 1 to 5 and Example Specimen 6, it was found that the compound in which $Ar^3$ represents an aryl group such as an enamine compound represented by the general formula (2) had higher charge mobility than the compound in which $Ar^3$ represents a group other than the aryl group in the general formula (1). Further, in view of the Comparison between Example Specimens 1 to 3 and Example Specimen 5, it was found that the compound in which $Ar^3$ represents a naphthyl group had higher charge mobility than the compound in which $Ar^3$ represents a group other than the naphthyl group in the general formula (1)

Example Specimen 7

9 parts by weight of dendritic titanium oxide (TTO-D-1, manufactured by Ishihara Sangyo Kaisha. Ltd.) surface treated with aluminum oxide (chemical formula: $Al_2O_3$) and zirconium dioxide (chemical formula: $ZrO_2$) and 9 parts by weight of a copolymer nylon resin (CM 8000, manufactured by Toray Industries Inc.) were added to a mixed solvent of 41 parts by weight of 1,3-dioxolane and 41 parts by weight of methanol, which were dispersed by using a paint shaker for 12 hours to prepare a coating solution for an intermediate layer. The prepared coating solution for the intermediate layer was coated by a baker applicator on a planar aluminum conductive support of 0.2 mm thickness and, dried to form an intermediate layer having a film thickness of 1.0 μm.

Then, a coating solution for a charge generation layer was prepared in the same manner as in Example Specimen 1. The prepared coating solution for charge generation layer was coated on the previously formed intermediate layer by a baker applicator, and then dried to form a charge generation layer having a film thickness of 0.3 μm.

Then, 10 parts by weight of the enamine compound of Exemplified Compound No. 1 shown in Table 1 as the charge transportation substance, 14 parts by weight of a polycarbonate resin (Z200, manufactured by Mitsubishi Gas Chemical Co. Inc.) as a binder resin, and 0.2 parts by weight of 2,6-di-t-butyl-4-methylphenol were dissolved in 80 parts by weight of THF to prepare a coating solution for a charge transportation layer. After coating the coating solution for the charge transportation layer on the previously formed charge generation layer by a baker applicator, it was dried to form a charge transportation layer at a film thickness of 18 μm.

As described above, a lamination type photoconductor of the layer constitution shown in FIG. 4 was manufactured.

Example Specimens 8 to 12

Five kinds of photoconductors were manufactured in the same manner as in Example Specimen 7 except for using the enamine compound of Exemplified Compound No. 3 shown in Table 1, Exemplified Compound No. 61 shown in Table 9, Exemplified Compound No. 106 shown in Table 16, Exemplified Compound No. 146 shown in Table 21 or Exemplified Compound No. 177 shown in Table 26 instead of Exemplified Compound No. 1 as the charge transportation substance.

Example Specimen 13

An intermediate layer of 1.0 μm film thickness was formed on a planar conductive support made of aluminum of 0.2 mm thickness in the same manner as in Example Specimen No. 7

Then, 2 parts by weight of X-type non-metal phthalocyanine as the charge generation substance, 10 parts by weight of the enamine compound of Exemplified Compound No. 1 shown in Table 1 as the charge generation substance, 12 parts by weight of a polycarbonate resin (Z-400, manufactured by Mitsubishi Gas Chemical Co. Inc.) as the binder resin, 5 parts by weight of 3,5-dimethyl-3',5'-di-t-butyl diphenoquinone, 0.5 parts by weight of 2,6-di-t-butyl-4-methylphenol and 65 parts by weight of THF were dispersed in a ball mill for 12 hours to prepare a coating solution for the photosensitive layer. Then, after coating the prepared coating solution for the photosensitive layer on the previously formed intermediate layer by a baker applicator, it was dried by hot blow at a temperature of 110° C. for one hour to form a photosensitive layer of 20 μm film thickness.

As described above, the single layer type photoconductor of the layer constitution shown in FIG. 5 was manufactured.

Comparative Example Specimens 5 to 7

Three kinds of photoconductors were manufactured in the same manner as in Example Specimen 7 except for using Comparative Compound A represented by the structural formula (15), Comparative Compound B represented by the structural formula (16) or the Comparative Compound D represented by the structural formula (18) instead of Exemplified Compound No. 1 as the charge transportation substance.

Evaluation 2

For each of the photoconductors of Example Specimens 7 to 13 and Comparative Example Specimens 5 to 7 manufactured as described above, initial characteristics and repetitive characteristics were evaluated by using an electrostatic copying machine testing apparatus (EPA-8200, manufactured by Kabushiki Kaisha Kawaguchi Denki Seisakusho). The evaluation was conducted under a normal temperature/normal humidity (N/N) circumstance at a temperature of 22° C. and a relative humidity of 65%, and under a low temperature/low humidity (L/L) circumstance at a temperature of 5° C. and a relative humidity of 20%, respectively.

The initial characteristics were evaluated as described below. The surface of the photoconductor was charged by applying a voltage at minus (−) 5 kV to the photoconductor and the surface potential of the photoconductor was measured as a charged potential $V_0$ (V) and used as the evaluation index for the chargeability. However, in a case of the single layer type photoconductor of Example specimen 13, the surface of the photoconductor was charged by applying a voltage at plus (+) 5 kV.

Then, exposure was applied to the charged surface of the photoconductor. In this case, an exposure energy required for reducing the surface potential of the photoconductor to one-half from the charged potential $V_0$ was measured as a half-decay exposure amount $E_{1/2}$ (μJ/cm$^2$), and used as the evaluation index for the sensitivity. Further, the surface potential of the photoconductor at the instance lapsed by 10 sec from the start of the exposure was measured as the residual potential $V_r$ (V), and used as the evaluation index for the light responsivity. Further, a monochromatic light at a wavelength of a 780 nm, with a exposure energy of 1 μW/cm$^2$ obtained by spectralization with monochrometer was used for exposure.

The repetitive characteristics were evaluated as described below. After repeating the operation of charging and exposure described above as one cycle for 5000 cycles, the charge potential $V_0$, the half-decay exposure amount $E_{1/2}$ and the residual potential $V_r$ were measured in the same manner as the evaluation for the initial characteristics, to evaluate the chargeability, sensitivity and light responsivity.

Table 34 shows the results of measurement described above.

TABLE 34

| | Charge generation substance | Charge transportation substance | under N/N circumstance (22° C./65% RH) Initial characteristics $E_{1/2}$ (μJ/cm$^2$) | $V_o$(V) | $V_r$(V) | Repetitive characteristics $E_{1/2}$ (μJ/cm$^2$) | $V_o$(V) | $V_r$(V) |
|---|---|---|---|---|---|---|---|---|
| Example Specimen 7 | X-type non-metal phthalocyanine | Exemplified compound 1 | 0.11 | −585 | −10 | 0.12 | −573 | −13 |
| Example Specimen 8 | X-type non-metal phthalocyanine | Exemplified compound 3 | 0.12 | −581 | −12 | 0.12 | −574 | −15 |
| Example Specimen 9 | X-type non-metal phthalocyanine | Exemplified compound 61 | 0.10 | −584 | −9 | 0.11 | −573 | −13 |
| Example Specimen 10 | X-type non-metal phthalocyanine | Exemplified compound 106 | 0.10 | −586 | −9 | 0.12 | −574 | −12 |
| Example Specimen 11 | X-type non-metal phthalocyanine | Exemplified compound 146 | 0.13 | −583 | −11 | 0.15 | −574 | −15 |
| Example Specimen 12 | X-type non-metal phthalocyanine | Exemplified compound 177 | 0.13 | −581 | −13 | 0.14 | −575 | −18 |
| Example Specimen 13 | X-type non-metal phthalocyanine | Exemplified compound 1 | 0.24 | 559 | 19 | 0.26 | 542 | 25 |
| Comp. Example Specimen 5 | X-type non-metal phthalocyanine | Comparative compound A | 0.15 | −586 | −25 | 0.17 | −576 | −27 |
| Comp. Example Specimen 6 | X-type non-metal phthalocyanine | Comparative compound B | 0.15 | −585 | −28 | 0.19 | −575 | −35 |
| Comp. Example Specimen 7 | X-type non-metal phthalocyanine | Comparative compound D | 0.15 | −581 | −30 | 0.19 | −575 | −40 |

| | under L/L circumstance (5° C./20% RH) Initial characteristics $E_{1/2}$ (μJ/cm$^2$) | $V_o$(V) | $V_r$(V) | Repetitive characteristics $E_{1/2}$ (μJ/cm$^2$) | $V_o$(V) | $V_r$(V) |
|---|---|---|---|---|---|---|
| Example Specimen 7 | 0.13 | −583 | −12 | 0.15 | −573 | −15 |
| Example Specimen 8 | 0.15 | −584 | −15 | 0.18 | −576 | −18 |
| Example Specimen 9 | 0.12 | −587 | −12 | 0.14 | −575 | −15 |
| Example Specimen 10 | 0.11 | −586 | −10 | 0.13 | −572 | −13 |
| Example Specimen 11 | 0.16 | −586 | −13 | 0.18 | −574 | −16 |
| Example Specimen 12 | 0.17 | −584 | −14 | 0.19 | −573 | −18 |

TABLE 34-continued

| | | | | | | |
|---|---|---|---|---|---|---|
| Example Specimen 13 | 0.26 | 551 | 25 | 0.29 | 540 | 30 |
| Comp. Example Specimen 5 | 0.36 | −580 | −45 | 0.38 | −578 | −46 |
| Comp. Example Specimen 6 | 0.38 | −582 | −48 | 0.42 | −575 | −55 |
| Comp. Example Specimen 7 | 0.38 | −579 | −50 | 0.45 | −570 | −59 |

From the evaluation results for the initial characteristics, it was found that the photoconductors of Example Specimens 7 to 12 using the enamine compound represented by the general formula (1) as the charge transportation substance were highly sensitive with small half-decay exposure amount $E_{1/2}$ and excellent in the light responsivity with small absolute value for the residual potential $V_r$ both under the N/N circumstance and the L/L circumstance compared with the photoconductors of Comparative Example Specimens 5 to 7 using Comparative Compounds A, B, or D as the charge transportation substance.

Further, it was found that the photoconductors of Example Specimen 13 using the enamine compound represented by the general formula (1) as the charge transportation substance was excellent in the light responsivity with small absolute value for the residual potential $V_\tau$ though it was single layer type compared with the lamination type photoconductors of Comparative Example Specimens 5 to 7.

Further, it was found that the photoconductors of Example Specimens 7 to 13 were excellent in the circumstantial stability with less difference between the result for measurement under the N/N circumstance and the result of measurement under the L/L circumstance and had sufficient sensitivity and light responsivity even under the L/L circumstance. On the contrary, the photoconductors of Comparative Example Specimens 5 to 7 showed a large difference between the result for measurement under the N/N circumstance and the result for measurement under the L/L circumstance and could not provide sufficient sensitivity and light responsivity under the L/L circumstance.

Further, in view of Comparison between Example Specimens 7 to 12 and Example Specimen 13, it was found that the lamination type photoconductors of Example Specimens 7 to 12 were highly sensitive with small half-decay exposure amount $E_{1/2}$ and excellent in the light responsivity with small absolute value of the residual potential of $V_r$ compared with the single layer type photoconductor of Example Specimen 13.

In view of comparison between the initial characteristics and the repetitive characteristics, it was found that the photoconductors of Example Specimens 7 to 13 showed less difference between the initial characteristics and the repetitive characteristics both under the N/N circumstance and under the L/L circumstance and were excellent in the electric durability. On the other hand, it was found that the photoconductors of the Comparative Example Specimens 6 and 7 showed large difference between the initial characteristics and the repetitive characteristics both under the N/N circumstance and under the L/L circumstance and had low electric durability.

Example Specimen 14

A coating solution for intermediate layer was prepared in the same manner as in Example Specimen 7. The prepared coating solution for the intermediate layer was filled in a coating vessel. A cylindrical conductive support made of aluminum of 30 mm diameter and 340 mm length was dipped in the coating vessel and then pulled up and dried to form an intermediate layer of 1.0 μm film thickness on the conductive support.

Then, 2 parts by weight of an oxotitanium phthalocyanine (those in which $X^1$, $X^2$, $X^3$ and $X^4$ each represents a hydrogen atom in the general formula (A)) having a crystal structure showing a distinct diffraction peak at least at a Bragg angle 2θ (error: 2θ±0.2°) of 27.2° in an X-ray diffraction spectrum relative to Cu-Kα characteristic X-rays (wavelength: 1.54 Å) as a charge generation substance, one part by weight of a polyvinyl butyral resin (Esrec BM-S, manufactured by Sekisui Chemical Co. Ltd.) and 97 parts by weight of methyl ethyl ketone were mixed, dispersed by a paint shaker to prepare a coating solution for a charge generation layer. The coating solution for the charge generation layer was coated on the intermediate layer by a dip coating method similar to that for the previously formed intermediate layer and dried to form a charge generation layer of 0.4 μm of film thickness.

Then, 10 parts by weight of the enamine compound of Exemplified Compound No. 1 shown in Table 1 as a charge transportation substance, 20 parts by weight of a polycarbonate resin (Yupiron Z200, manufactured by Mitsubishi Engineering Plastics Co. Ltd.) as a binder resin, one part by weight of 2,6-di-t-butyl-4-methylphenol, and 0.004 parts by weight of dimethyl polysiloxane (KF-96, manufactured by Shin-Etsu Chemical Co. Ltd.) were dissolved in 110 parts by weight of THT to prepare a coating solution for a charge transportation layer. After coating the solution for the charge transportation layer was coated on the previously formed charge generation layer by a dip-coating method similar to that for the previously formed intermediate layer, it was dried at 110° C. for one hour to form a charge transportation layer of 23 μm film thickness.

As described above, a lamination type photoconductor of the layer constitution shown in FIG. 4 was manufactured.

Example Specimens 15 and 16

Two kinds of photoconductors were manufactured in the same manner as in Example Specimen 14 except for using the enamine compound of Exemplified Compound No. 61 shown in Table 9 or Exemplified Compound No. 146 shown in Table 21 instead of Exemplified Compound No. 1 as a charge transportation substance.

Comparative Example Specimens 8 and 9

Two kinds of photoconductors were manufactured in the same manner as in Example Specimen 14 except for using Comparative Compound A shown by the structural formula (15) or Comparative Compound B shown by the structural formula (16) instead of Exemplified Compound No. 1 as a charge transportation substance.

Example Specimen 17

A photoconductor was manufactured in the same manner as in Example specimen 14 except for changing the amount of the polycarbonate resin as the binder resin to 25 parts by weight in the formation of the charge transportation layer.

Example Specimens 18, 19

Two kinds of photoconductors were manufactured in the same manner as in Example Specimen 14 except for changing the amount of the polycarbonate resin as the binder resin to 25 parts by weight and using the enamine compound of Exemplified Compound No. 61 shown in Table 9 or Exemplified Compound No. 146 shown in Table 21 instead of Exemplified Compound No. 1 as a charge transportation substance in the formation of the charge transportation layer.

Example Specimen 20

A photoconductor was manufactured in the same manner as in Example specimen 14 except for changing the amount of the polycarbonate resin as the binder resin to 10 parts by weight in the formation of the charge transportation layer.

(Reference Specimen)

A photoconductor was manufactured in the same manner as in Example Specimen 14 except for changing the amount of the polycarbonate resin as the binder resin to 31 parts by weight in the formation of the charge transportation layer. However, since a polycarbonate resin could not be dissolved completely with the identical amount of THF with that for Example Specimen 14, and the viscosity of the coating solution for charge transportation layer was increased, THF was further added to prepare a coating solution for the charge transportation layer in which the polycarbonate resin was completely dissolved, and the charge transportation layer was formed by using the same.

However, clouding due to the brushing phenomenon was resulted at the longitudinal end of the cylindrical photoconductor and characteristic evaluation could not be conducted. It is considered that the brushing phenomenon is attributable to the excess amount of the solvent in the coating solution for the charge transportation layer.

Evaluation 3

Each of the photoconductors manufactured in Examples 14 to 20 and Comparative Examples 8 to 11 described above was mounted on a testing copying machine modified from a commercially available digital copying machine (AR-C150, manufactured by Sharp Corp.) such that the printing speed was 117 mm/sec, and the printing resistance and the electric characteristic for each of the photoconductors were evaluated as described below. The digital copying machine AR-C150 is a negative charging type image forming apparatus of conducting charging to the surface of the photoconductor by a negatively charging process.

(a) Printing Resistance

After forming test images of a predetermined pattern to 40,000 sheets of recording paper by using the testing copying machine, the mounted photoconductor was taken out, thickness d1 of the light sensitive layer was measured to determine the difference between the value (d1) and the thickness d0 for the photosensitive layer upon preparation as a film reduction amount Δd (=d0−d1), which was used as the evaluation index for the printing resistance. Measurement for the film thickness was conducted by an instantaneous multi-light measuring system MCPD-1100 (manufactured by Otsuka Denshi Co.) by a light interference method.

(b) Electric Characteristics

The developing device was detached from the testing copying machine and, instead, a surface potential meter (CATE751, manufactured by Gentec Co.) was provided to the developing portion. Using the copying machine, the surface potential of the photoconductor in a case not exposing the laser light was measured as the charge potential V0 (V) under a normal temperature/normal humidity (N/N) circumstance at a temperature of 22° C. and a relative humidity of 65%. Further, the surface potential of the photoconductor after applying the laser light exposure was measured as an exposure potential VL (V), which was determined as an exposure potential $VL_N$ under the N/N circumstance. It was evaluated that the chargeability was more excellent as the absolute value for the charging potential V0 was larger and the light responsivity was evaluated to be more excellent as the absolute value for the exposure potential $VL_N$ was smaller.

Further, the exposure potential VL (V) was measured under the low temperature/low humidity (L/L) circumstance at a temperature of 5° C. and at a relative humidity of 20% in the same manner as under the N/N circumstance, which was determined as the exposure potential $VL_L$ under the L/L circumstance. The absolute value for the difference between the exposure potential $VL_N$ under the N/N circumstance and the exposure potential $VL_N$ under the L/L circumstance was determined as potential fluctuation ΔVL (=$|VL_L-VL_N|$). It was judged that as the potential fluctuation ΔVL was smaller, the circumstantial stability was more excellent.

Table 35 shows the results for the evaluation.

TABLE 35

| | Charge transportation substance | Charge transportation substance/ binder resin | Film reduction amount Δd(μm) | N/N-potential characteristics VO(V) | N/N-potential characteristics $VL_N$(V) | L/L-potential fluctuation Δ VL(V) |
|---|---|---|---|---|---|---|
| Example specimen 14 | Exemplified compound 1 | 10/20 | 4.4 | −528 | −42 | 20 |
| Example specimen 15 | Exemplified compound 61 | 10/20 | 4.3 | −524 | −30 | 15 |
| Example specimen 16 | Exemplified compound 146 | 10/20 | 4.4 | −529 | −39 | 20 |
| Comp. Example specimen 8 | Comparative Compound A | 10/20 | 4.4 | −518 | −102 | 70 |
| Comp. Example specimen 9 | Comparative Compound B | 10/20 | 4.4 | −524 | −111 | 72 |
| Example specimen 17 | Exemplified compound 1 | 10/25 | 3.2 | −524 | −49 | 25 |
| Example specimen 18 | Exemplified compound 61 | 10/25 | 3.2 | −526 | −41 | 20 |
| Example specimen 19 | Exemplified compound 146 | 10/25 | 3.1 | −529 | −45 | 28 |
| Example specimen 20 | Exemplified compound 1 | 10/10 | 11.8 | −518 | −15 | 8 |
| Reference specimen | Exemplified compound 1 | 10/31 | — | — | — | — |

In view of the comparison between Examples Specimens 14 to 19 and Comparative Example Specimens 8, 9, it was found that the photoconductors of Example specimens 14 to 19 using the enamine compound shown by the general formula (1) as the charge transportation substance showed smaller absolute value for the exposed potential $VL_N$ under the N/N circumstance and were excellent in the light responsivity even in a case of defining the ratio between the weight for the charge transportation substance and the weight for the binder resin (charge transportation substance/binder resin) as 10/12 or less and the binder resin was added at a high ratio, compared with the photoconductors of Comparative Example Specimens 8 and 9 using the Comparative Compounds A or B as the charge transportation substance. Further, it was found that the photoconductors of Example Specimens 14 to 19 were more excellent in the circumstantial stability with less smaller value for potential fluctuation ΔVL and showed a sufficient light responsivity even under the L/L circumstance compared with the photoconductors of Comparative Example Specimens 8 and 9.

Further, in view of comparison between Example Specimens 14 to 19 and Example Specimen 20, it was found that the photoconductors of Example Specimens 14 to 19 in which the ratio between the weight A for the enamine compound shown by the general formula (1) and the weight B for the binder resin (A/B) was within the range from 10/30 to 10/12 showed smaller film reduction amount Δd and had higher printing resistance than the photoconductor of Example Specimen 20 in which the ratio A/B exceeded 10/12 and the ratio of the binder resin was low.

As described above, it was found that the enamine compound shown by the general formula (1) had high charge mobility. Further, by the incorporation of the enamine compound shown by the general formula (1) as the charge transportation layer to the photosensitive layer, a electrophotographic photoconductor excellent in the chargeability, sensitivity and light responsivity, as well as excellent in the circumstantial stability and the electrical durability could be obtained. Further, by the use of the enamine compound shown by the general formula (1) as the charge transportation substance, the ratio between the weight for the charge transportation substance and the weight for the binder resin in the charge transportation layer (charge transportation substance/binder resin) can be set to 10/30 or more and 10/12 or less to increase the ratio for the binder resin to thereby improve the printing resistance of the charge transportation layer without lowering the light responsivity.

[Image Forming Apparatus]

An evaluation test for the resolution was conducted by mounting photoconductors manufactured under the different conditions and the toner to a testing copying machine modified from a commercialized digital copier AR-450 (manufactured by Sharp Corp.) such that the rotational circumferential speed of the photoconductor was 140 min/sec. At first, description is to be made to the photoconductors provided for the example specimens and the comparative example specimens.

(P1 to P7 Photoconductors of Example Specimens)

(P1 to P4 Photoconductors)

P1 to P4 photoconductors were manufactured respectively in the same manner as in Example Specimens 14 to 17.

(P5 Photoconductor)

A P5 photoconductor was manufactured in the same manner as in Example Specimen 14 except for using X-type non-metal phthalocyanine instead of oxotitanium phthalocyanine as a charge generation substance.

(P6 Photoconductor)

A P6 photoconductor was manufactured in the same manner as in Example Specimen 14 except for using X-type non-metal phthalocyanine instead of oxotitanium phthalocyanine as the charge generation substance and changing the amount of the polycarbonate resin as the binder resin to 25 parts by weight in the formation of the charge transportation layer.

(P7 Photoconductor)

In the same manner as in Example Specimen 14, an intermediate layer of 1.0 μm film thickness was formed on a cylindrical conductive support made of aluminum of 30 mm diameter and 340 mm length.

Then, a coating solution for a photosensitive layer was prepared by dispersing 2 parts by weight of X-type non-metal phthalocyanine as the charge generation substance, 10 parts by weight of the enamine compound of Exemplified Compound No. 1 shown in Table 1 as the charge transportation substance, 20 parts by weight of a polycarbonate resin (Yupiron Z200, manufactured by Mitsubishi Engineering Plastics Co. Ltd.) as binder resin, one part by weight of 2,6-di-t-butyl-4-methylphenol, 0.004 parts by weight of dimethyl polysiloxane (KF-96, manufactured by Shin-Etsu Chemical Co. Ltd.), and 110 parts by weight of THF in a ball mill for 12 hours. After coating the prepared coating solution for the photosensitive layer on the previously formed intermediate layer by the same dip-coating method as that for the intermediate layer, it was dried by a hot blow at a temperature of 110° C. for one hour to form a photosensitive layer of 23 μm film thickness.

The single layer type photoconductor of the layer constitution shown in FIG. 5 was manufactured as described above.

(Q1 to Q3 Photoconductors of Comparative Example Specimen)

(Q1 Photoconductor)

A Q1 photoconductor was manufactured in the same manner as in Comparative Example Specimen 8.

(Q2 Photoconductor)

A Q2 photoconductor was manufactured in the same manner as in Comparative Example Specimen 9.

(Q3 Photoconductor)

A Q3 photoconductor was manufactured in the same manner as in Example Specimen 14 except for using X-type non-metal phthalocyanine instead of oxotitanium phthalocyanine as a charge generation substance and using the comparative compound D shown by the structural formula (18) described above instead of Exemplified Compound No. 1 as a charge transportation substance.

Then, description is to be made to the toner provided as example specimens and comparative example specimens.

(T1, T2 toners for example specimens)

(T1 Toner)

To 100 parts by weight of a styrene-acrylic resin, were added 1.0 parts by weight of polyethylene (PE130, manufactured by Clarient Japan Co.) and 1.5 parts by weight of polypropylene (NP-505, manufactured by Mitsui Chemical Co.) as a wax, 1.0 parts by weight of a charge controller (S-34, manufactured by Hodogaya Chemical Industry Co.), 1.5 parts by weight of magnetite (KBC-100, manufactured by Kanto Denka Co.), and 5.0 parts by weight of carbon black (330R, manufactured by Cabot Co.) as a colorant and mixed sufficiently by a super-mixer (V-20, manufactured by Kawada Co.) and the obtained mixture was melted and kneaded in a twin-screw kneader (PCM-30, manufactured by Ikegai Tekko Co.) The obtained kneading product was pulverized by a jet type pulverizer (IDS-2, manufactured by Nippon Pneumatic Industry Co.) and then classified to obtain a toner powder of a volume average particle size of 7.0 μm. Then, 0.3 parts by weight of fine silica particles (R972, manufactured by Nippon Aerosil Co.) and 0.3 parts by weight of magnetite (particle size 0.13 μm; manufactured by Titanium Industry Co.) were added to the obtained toner powder, to manufacture a T1 toner.

(T2 Toner)

A T2 toner was manufactured in the same manner as the T1 toner except for controlling the pulverization level by the jet type pulverizing machine for the kneading product and setting the volume average particle size after classification to 4.0 μm.

(V1, V2 Toner for Comparative Example Specimen)

(V1 Toner)

A V1 toner was manufactured in the same manner as the T1 toner except for controlling the pulverization level by the jet type pulverizing machine for the kneading product and setting the volume average particle size after classification to 8.0 μm.

(V2 Toner)

A V2 toner was manufactured in the same manner as the T1 toner except for controlling the pulverization level by the jet type pulverizing machine for the kneading product and setting the volume average particle size after classification to 3.4 μm.

The P1 to P7 photoconductors and the Q1 to Q3 photoconductors, as well as T1, T2 toners and V1, V2 toners manufactured as described above were combined as shown in Table 36, mounted on a testing copying machine and the resolution was evaluated as described below. For the following evaluation, T1, T2 toners and V1, V2 toners were respectively mixed with carriers and used as two-component developers.

Resolution

Images obtained by drawing straight lines by the number of 8, 10, 12 and 14 each at an equal pitch of 1 mm distance on a sheet of recording paper (SF-4AM3, manufactured by Sharp Corp.), that is, line images at four levels in which the inter-line distance formed in 1 mm distance was different were formed. The formed images were observed with naked eyes and it was judged for linear images at four levels of different number of lines formed per 1 mm whether each of the formed lines could be distinguished or not to evaluate the resolution. The evaluation criteria for regulation power are as described below.

OO: excellent, 14 lines/mm distinguishable

O: good, 12 lines/mm distinguishable

Δ: no practical problem, 10 line/mm distinguishable x: poor, less than 8 lines/mm distinguishable (10 lines/mm not distinguishable)

Table 36 shows the results for the evaluation of resolution.

TABLE 36

| | Photoconductor | | | | | Toner | | | |
|---|---|---|---|---|---|---|---|---|---|
| | | Charge generation substance | Charge transportation substance | Charge transportation substance/ binder resin | Remark | | Volume average particle size (μm) | Evaluation for resolution power | Remarks |
| Example 1 | P1 | Oxotitanium phtalocyanine | Exemplified compound 1 | 10/20 | — | T1 | 4.0 | ○○ | — |
| Example 2 | P2 | Oxotitanium phtalocyanine | Exemplified compound 61 | 10/20 | — | T1 | 4.0 | ○○ | — |
| Example 3 | P3 | Oxotitanium phtalocyanine | Exemplified compound 146 | 10/20 | — | T1 | 4.0 | ○ | — |
| Example 4 | P1 | Oxotitanium phtalocyanine | Exemplified compound 1 | 10/20 | — | T2 | 7.0 | ○ | — |
| Example 5 | P4 | Oxotitanium phtalocyanine | Exemplified compound 1 | 10/25 | — | T1 | 4.0 | ○○ | — |
| Example 6 | P5 | X-type non-metal phthalocyanine | Exemplified compound 1 | 10/20 | — | T1 | 4.0 | ○○ | — |
| Example 7 | P6 | X-type non-metal phthalocyanine | Exemplified compound 1 | 10/25 | — | T2 | 7.0 | ○ | — |
| Example 8 | P7 | X-type non-metal phthalocyanine | Exemplified compound 1 | 10/20 | Photosensitive layer single layer | T1 | 4.0 | ○○ | — |
| Comparative Example 1 | Q1 | Oxotitanium phtalocyanine | Comparative compound A | 10/20 | — | T1 | 4.0 | x | — |
| Comparative Example 2 | Q2 | Oxotitanium phtalocyanine | Comparative compound B | 10/20 | — | T1 | 4.0 | x | — |
| Comparative Example 3 | Q3 | X-type non-metal phthalocyanine | Comparative compound D | 10/20 | — | T1 | 4.0 | x | — |
| Comparative Example 4 | P1 | Oxotitanium phtalocyanine | Exemplified compound 1 | 10/20 | — | V1 | 8.0 | x | — |
| Comparative Example 5 | P1 | Oxotitanium phtalocyanine | Exemplified compound 1 | 10/20 | — | V2 | 3.4 | ○○ | Occurrence of image fogging, cleaning failure by toner scattering |

In view of Table 36, it was found that images at high resolution can be obtained, in a case of Examples 1 to 8 in which the photoconductor uses the enamine compound shown by the general formula (1) as the charge transportation substance and the volume average particle size of the toner is 7 μm or less, even when the rotational circumferential speed of the photoconductor is set to 140 mm per sec and the electrophotographic process is conducted at high speed.

On the contrary, in a case of Comparative Examples 1 to 3 in which the photoconductor uses other compounds than the enamine compound shown by the general formula (1) for the charge transportation substance, no sufficient resolution was obtained irrespective that the volume average particle size of the toner within a range of 4 to 7 μm suitable to improve the picture quality and resolution for the images. As apparent from the characteristic evaluation for the photoconductor, this is considered that the photoconductor using the Comparative Compound A, B or D as the charge transportation substance is poor in the sensitivity and the light responsivity compared with the photoconductor using the enamine compound shown by the general formula (1) as the charge transportation substance.

Further, in a case of Comparative Example 4, although the enamine compound shown by the general formula (1) was used for the charge transportation substance of the photoconductor, no sufficient resolution could be obtained. This is considered that the volume average particle size of the toner exceeds 7 μm.

Further, in a case of Comparative Example 5 while the result of evaluation for the resolution was excellent (OO), image fogging and cleaning failure occurred due to toner scattering which was unworthy of the evaluation for practical use. This is considered to be attributable to that the volume average particle size of toner was less than 4 μm.

As described above, images at high quality and high resolution could be formed at a high speed by using the enamine compound shown by the general formula (1) as the charge transportation substance for the photoconductor and by using the toner having the volume average particle size within a range of 4 μm to 7 μm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an electrophotographic photoconductor having a conductive support and a photosensitive layer disposed on the conductive support and containing a charge generation substance and a charge transportation substance;

charging means for charging the electrophotographic photoconductor;

exposure means for forming electrostatic latent images by applying exposure corresponding to image information to the charged electrophotographic photoconductor;

developing means containing toners, for developing the electrostatic latent images by supplying toners to the surface of the electrophotographic photoconductor thereby forming toner images; and transfer means for transferring the toner images from the surface of the electrophotographic photoconductor to a recording medium, wherein, the charge transportation substance contained in the photosensitive layer of the electrophotographic photoconductor contains an enamine compound represented by the following general formula (2), and a volume average particle diameter of the toners contained in the developing means is in a range from 4 μm to 7 μm (2)

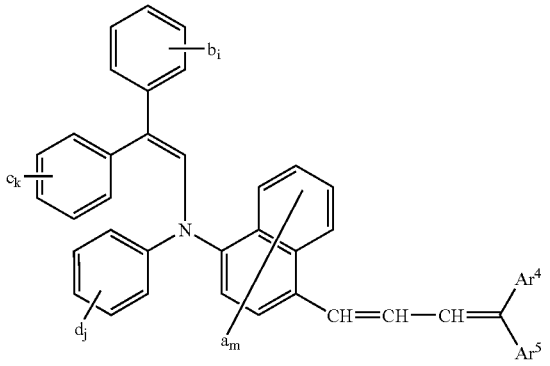

wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure;

$Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; "a" represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the "a"s may be the same or different and may bond to each other to form a cyclic structure.

2. The image forming apparatus of claim 1, wherein the charge generation substance contained in the photosensitive layer of the electrophotographic photoconductor contains a phthalocyanine compound.

3. The image forming apparatus of claim 2, wherein the phthalocyanine compound is an oxotitanium phthalocyanine compound.

4. The image forming apparatus of claim 1, wherein the photosensitive layer of the electrophotographic photoconductor is constituted by laminating a charge generation layer containing a charge generation substance and a charge transportation layer containing a charge transportation substance containing an enamine compound represented by the general formula (2).

5. The image forming apparatus of claim 4, wherein the charge transportation layer further contains a binder resin, and a ratio (A/B) between a weight A for the enamine compound represented by the general formula (2) and a weight B for the binder resin in the charge transportation layer is in a range from 10/30 to 10/12.

6. The image forming apparatus of claim 1, wherein the electrophotographic photoconductor further has an intermediate layer between the conductive support and the photosensitive layer.

* * * * *

UNITED STATES PATENT AND TRADEMARK OFFICE

CERTIFICATE OF CORRECTION

PATENT NO. : 7,457,565 B2
APPLICATION NO. : 11/051640
DATED : November 25, 2008
INVENTOR(S) : Fujii et al.

It is certified that error appears in the above-identified patent and that said Letters Patent is hereby corrected as shown below:

On the Title Page, left column, delete the following:

"(*) Notice: Subject to any disclaimer the term of this patent is extended or adjusted under 35 U.S.C. 154(b) by 356 days."

and insert the following therefor:

--(*) Notice: Subject to any disclaimer the term of this patent is extended or adjusted under 35 U.S.C. 154(b) by 356 days.

This patent is subject to a terminal disclaimer.--

Signed and Sealed this

Twelfth Day of January, 2010

David J. Kappos

David J. Kappos
*Director of the United States Patent and Trademark Office*